US005534978A

United States Patent [19]

Nakamura et al.

[11] Patent Number: 5,534,978

[45] Date of Patent: Jul. 9, 1996

[54] IMAGING APPARATUS AND PHOTOCONDUCTOR

[75] Inventors: Yasushige Nakamura; Norio Sawatari; Fumio Takei; Toru Takahashi; Katsura Sakamoto; Tsuneo Watanuki, all of Kawasaki, Japan

[73] Assignee: Fujitsu Limited, Kawasaki, Japan

[21] Appl. No.: 365,802

[22] Filed: Dec. 29, 1994

[30] Foreign Application Priority Data

Mar. 2, 1994 [JP] Japan ..... 6-032474

[51] Int. Cl.[6] ..... G03G 15/00

[52] U.S. Cl. ..... 355/211; 430/66; 430/83

[58] Field of Search ..... 355/211; 430/66, 430/83; 156/277

[56] References Cited

U.S. PATENT DOCUMENTS

| | | | |
|---|---|---|---|
| 3,535,381 | 10/1970 | Hauptschein et al. | 260/570.9 |
| 3,539,614 | 11/1970 | Ross et al. | 260/462 |
| 4,545,669 | 10/1985 | Hays et al. . | |
| 5,159,389 | 10/1992 | Minami et al. . | |

FOREIGN PATENT DOCUMENTS

| | | |
|---|---|---|
| 0120167 | 10/1984 | European Pat. Off. . |
| 0474220 | 3/1992 | European Pat. Off. . |
| 0488151 | 6/1992 | European Pat. Off. . |
| 1922277 | 11/1969 | Germany . |
| 2244297 | 3/1973 | Germany . |
| 3306933 | 8/1983 | Germany . |
| 54-84730 | 7/1979 | Japan . |
| 55-42752 | 11/1980 | Japan . |
| 58-41508 | 9/1983 | Japan . |
| 60-22145 | 2/1985 | Japan . |
| 62-145255 | 6/1987 | Japan . |
| 63-186253 | 8/1988 | Japan . |
| 1-142733 | 6/1989 | Japan . |
| 2-48674 | 2/1990 | Japan . |
| 2-221967 | 9/1990 | Japan . |
| 2-272461 | 11/1990 | Japan . |
| 3-6573 | 1/1991 | Japan . |
| 3-155565 | 7/1991 | Japan . |
| 5-150667 | 6/1993 | Japan . |
| 6-273964 | 9/1994 | Japan . |

*Primary Examiner*—Matthew S. Smith
*Attorney, Agent, or Firm*—Armstrong, Westerman, Hattori, McLeland & Naughton

[57] ABSTRACT

An electrification enhancer is either contained in the photoconductor, is present as a coating on the surface thereof, or is applied prior to use. A compound such as ammonium fluoride, a ferroelectric substance, a high molecular substance (fluorine resin) with an equivalent work function of 4.10 or greater, etc. are effective. The chargeability of the photoconductor is improved. The construction is best suited for the rear photorecording process, but is also effective in other types of contact charging recording systems.

21 Claims, 9 Drawing Sheets

(1) UNIFORM ELECTRIFICATION OF PHOTOCONDUCTOR SURFACE (2) LIGHT EXPOSURE: GENERATION AND TRANSPORTATION OF CHARGE (3) DEVELOPING BY BIAS FIELD
RETAINING TONER IN PRINTING SECTION
( ELECTRIC FORCE> MAGNETIC FORCE )
COLLECTING TONER FROM BACKGROUND SECTION
( ELECTRIC FORCE <MAGNETIC FORCE )

IMAGING APPARATUS AND PHOTOCONDUCTOR

BACKGROUND OF THE INVENTION

1. Field of the Invention

The present invention relates to imaging apparatuses and photoconductors, and especially to an imaging apparatus which performs development almost simultaneously with imaging light exposure of a photoconductor from the inside thereof to obtain a toner image on the photoconductor, for great improvement over the conventional Carlson process, with no generation of ozone which is harmful to humans, and which consistently provides satisfactory images at low cost. With the rapid developments in computer and communication technology in recent years, the demand for printers as output terminals has been increasing. Electrophotographic printers are rapidly becoming commonplace because of their excellent recording speed and print quality. The present invention is directed to the development of such printers, digital copiers and fax machines.

2. Description of the Related Art

In the conventional electrophotographic process (Carlson process), a photoconductor is used as a recording medium and the recording is carried out by a complicated series of steps including electrification, light exposure, development, transfer, fixation, destaticizing and cleaning, which have limited the miniature, low-cost and maintenance-free aspects of the devices, and created the desire for a more simple developing process. Recently, attempts have been made at development using transparent photoconductors, and it has been reported that by eliminating the electrifying mechanism of the above-mentioned conventional process and also situating the optical system inside the photoconductor, further miniaturization is possible. In Japanese Unexamined Patent Publication (Kokai) No. 6-273964 for example, an organic photoconductor is used for development with magnetic toner and a high resistance carrier.

This principle will now be explained.

The basic principle of an imaging apparatus employing the process described above is shown in FIG. 1 and FIGS. 2A to 2C. The photoconductor 1 comprises a transparent substrate 2, a transparent conductive layer 3 and a photoconductive layer 4, and the transparent conductive layer is grounded. The developing agent 5 used contains a high-resistance carrier 6 and insulating toner 7. A developing roller 8 is provided with a conductive sleeve 10 on a magnet roller 9, and the developing agent is pulled in the direction of the developing roller by magnetic force, and adheres to the sleeve while being carried to the photoconductor 1. Also, three successive steps are carried out almost instantaneously in the developing nip. First, in zone (1), the photoconductor 1 is electrified 12 by the developing agent 5. Next, in zone (2), imaging light exposure is performed on the electrified photoconductor 1 from the transparent substrate 2 side, to form a latent image. The number 11 indicates an optical system. Also, in zone (3), development occurs in the latent image-formed areas because the electrical adhesive force 13 of the toner 7 on the photoconductor 1 is stronger than the magnetic force 14 from the magnet roller 9, and conversely, in the background areas other than the image-formed areas the toner 7 is collected because the magnetic electrostatic force from the magnet roller 9 is stronger. The developed toner 7 is transferred to the recording medium, i.e. the paper or plastic plate, to obtain a print. Here, the direction of rotation of the photoconductor drum and the developing agent sleeve may be in the same or different directions. The image recording process described above will hereunder be referred to as "rear photorecording process".

The differences between this rear photorecording process and the Carlson process will now be discussed. FIG. 3 shows an apparatus used for the Carlson process, and FIG. 4 shows an apparatus used for the rear photorecording process.

In FIGS. 3 and 4, 21 is a photoconductor drum (non-transparent), 22 is an electrifier, 23 is the surface potential, 24 is an optical system, 25 is a developer, 25*a* is a developing agent, 26 is toner, 27 is a recording sheet, 28 is a transfer unit, 29 is a fixing unit, 30 is a destaticizing lamp, 31 is a cleaner, 32 is a photoconductor drum (transparent support) and 33 is a transfer roller.

As is well-known, in the Carlson process the electrification, exposure and development of the photoconductor are usually carried out in separate processing zones, and therefore the electrification potential (absolute value) of the photoconductor may be set higher than the developing bias, so that no fog occurs. That is, in the conventional process as shown in FIGS. 5 and 6, the toner is carried electrostatically to the latent image, but the toner does not adhere to the background sections because of electrical repulsion. However, in the rear photorecording process, it is believed that a surface potential is generated on the photoconductor by the charge injection and microdischarge due to the developing bias ($V_b$) upstream from the photoconductor in the developing nip; nevertheless, since the efficiency is low when using a common photoconductor, the potential of the photoconductor is lower than the developing bias. The difference between the developing bias and the surface potential of the photoconductor is more apparent the higher the toner concentration (FIG. 7). Consequently, when magnetic toner is used, lower toner concentrations (7 wt % or less) make the surface potential of the photoconductor closer to the developing bias and thus reducing fog, while higher toner concentrations (10 wt % or greater) lower the surface potential of the photoconductor and render it prone to fog. Thus, when the surface potential ($V_s$) becomes lower than the developing bias ($V_b$) due to the toner concentration, a developer construction which does not allow control of the toner concentration (such as in Japanese Unexamined Patent Publication No. 5-150667) cannot be used. Also, when a conventional two-component developer is used which employs a magnetic permeability sensor to control the toner concentration, since both the toner and carrier are magnetic, strict control is difficult even in the case of low toner concentrations, while lot differences tend to occur with the photoconductor, etc., making it thus difficult to achieve a satisfactory margin against fog.

In addition, since in the case of non-magnetic toner such as normal color toner, there is no dependence on the toner concentration and the magnetic collecting force of the toner does not apply, the surface potential ($V_s$) cannot be higher than the developing bias ($V_b$), and fog has resulted.

Consequently, with magnetic toner the surface potential ($V_s$) is either made to approach the developing bias ($V_b$) or is made higher than the developing bias ($V_b$), to provide satisfactory printing characteristics in a wide range of toner concentrations, and to increase the anti-fog margin. Furthermore, if the surface potential of the photoconductor can be made larger than the developing bias in the case of non-magnetic color toner as well, developing may be made without fog.

DESCRIPTION OF THE INVENTION

As a result of diligent research, the importance has been found of allowing instantaneous, efficient electrification of the photoconductor in rear photorecording even in the case of a high toner concentration, and by sufficiently increasing the surface potential of the photoconductor by the method described below, it has been possible to achieve satisfactory printing without fog with either magnetic or non-magnetic toner.

In other words, in an imaging apparatus comprising a photoconductor prepared by laminating a transparent or semi-transparent substrate, a transparent or semi-transparent conductive layer and a photoconductive layer, a developing agent comprising a carrier and toner situated on the photoconductive layer side of the photoconductor, and image exposure means for image exposure, provided on the transparent or semi-transparent substrate side of the photoconductor and positioned opposite the developing means, which apparatus performs light exposure and development with the developing agent roughly simultaneous with electrification of the photoconductor, and by having means for supplying an additional potential to the photoconductor, so that the absolute value of the surface potential ($V_s$) of the photoconductor either approaches the developing bias ($V_b$) or is larger than the developing bias ($V_b$), thereby eliminating fog in the background areas and also raising the printing density. Furthermore, by making the surface potential ($V_s$) of the photoconductor larger than the developing bias ($V_b$) in the case of non-magnetic toner such as normal color toner, background fog is eliminated and the printing density is increased.

Specifically, as the means for supplying the additional potential to the photoconductor, a substance for supplying the additional potential to the photoconductor (hereunder referred to as "electrification enhancer") is either included in the photoconductor, coated onto the surface of the photoconductor, or appropriately applied onto the surface of the photoconductor prior to the imaging.

At least the following substances have been confirmed to be effective as the electrification enhancer. They may also be used in admixture.

A) Ammonium fluoride salts represented by the following formula (I).

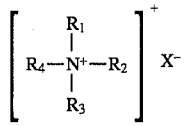

(I)

wherein each of $R_1$–$R_4$ is a hydrogen atom or organic group; at least one of groups $R_1$ to $R_4$ is a linear or branched fluorinated alkyl group of 1–69 carbon atoms and 3–66 fluorine atoms, which may have a hydroxyl group, chloromethyl group, carboxylic amide, sulfonic amide group, urethane group, amino group, $R_5$—O—$R_6$ group and/or $R_7$—$COOR_8$ group, in which case $R_5$, $R_6$, $R_7$ and $R_8$ are alkyl groups of 1–30 carbon atoms; at most three of groups $R_1$ to $R_4$ are independently hydrogen atoms or linear or branched alkyl, alkenyl or aryl groups of 1–30 carbon atoms (for example, phenyl, naphthyl, arylalkyl or benzyl groups); the aryl and aralkyl groups may be substituted at the aromatic nucleus with an alkyl group of 1–30 carbon atoms, an alkoxy group of 1–30 carbon atoms, a hydroxyl group or a halogen atom (for example, fluorine, chlorine or bromine); two of groups $R_1$ to $R_4$ may be bonded together to form a mononuclear or polynuclear cyclic system of 4–12 carbon atoms which may be broken with a hetero atom (for example, nitrogen, oxygen or sulfur), which may have 0–6 double bonds, and which is substituted with a fluorine atom, a chlorine atom, a bromine atom, an alkyl group of 1–6 carbon atoms, an alkoxy group of 1–6 carbon atoms, a nitro group or an amino group; $X^-$ is an organic or inorganic anion; and $R_1$ to $R_4$ may be substituted with a $COO^-$ or $SO^-_3$ group, in which case $X^-$ is unnecessary.

Some examples of preferred compounds are given below.

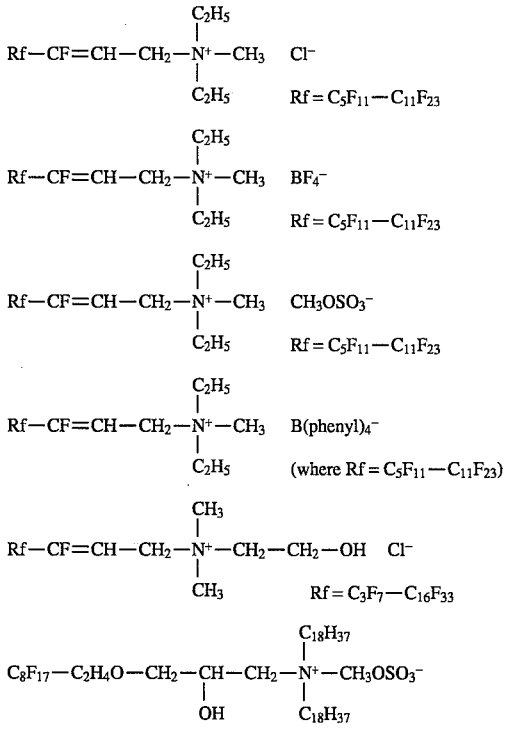

-continued

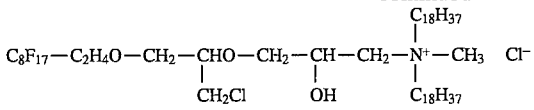

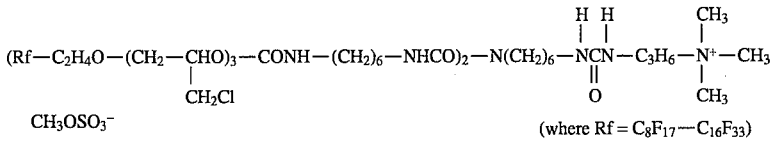

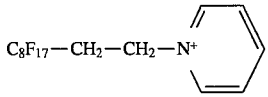

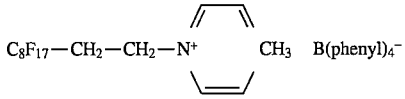

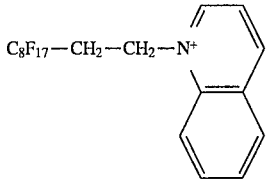

Specific methods for preparing these compounds are described in U.S. Pat. No. 3,535,381 and German Unexamined Patent Application No. 1,922,277, No. 2,244,297 and No. 3,306,933, but there is no instance of their use as photoconductor materials. Furthermore, although the use of small amounts of non-fluorinated quaternary ammonium salts as curing agents for the protective layers of photoconductors is publicly known (Japanese Unexamined Patent Publication No. 1-142733), non-fluorinated quaternary ammonium salts have absolutely no effect on rear photorecording, and even when added it is known that the surface potential ($V_s$) of the photoconductors is, rather, lowered by water absorption properties of the quaternary ammonium salts. This results because of the increased hydrophilicity and frictional electrification imparted by fluorination of the quaternary ammonium salts.

B) Boron complexes represented by the following formula (II).

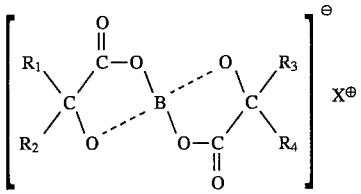

(II)

wherein $R_1$ and $R_4$ are hydrogen atoms, alkyl groups or substituted or non-substituted aromatic rings (including fused rings); $R_2$ and $R_3$ are substituted or non-substituted aromatic rings (including fused rings); and X is a cation.

Some examples of preferred compounds represented by general formula (II) are given below.

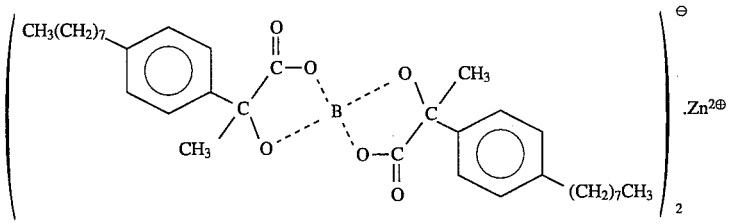

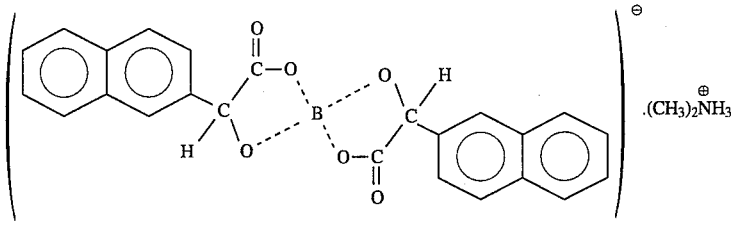

-continued
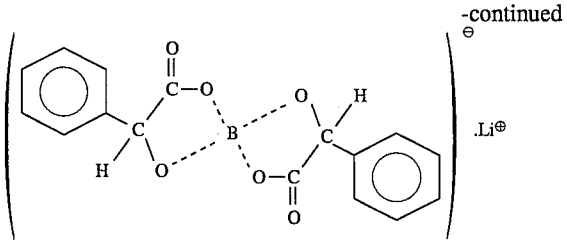
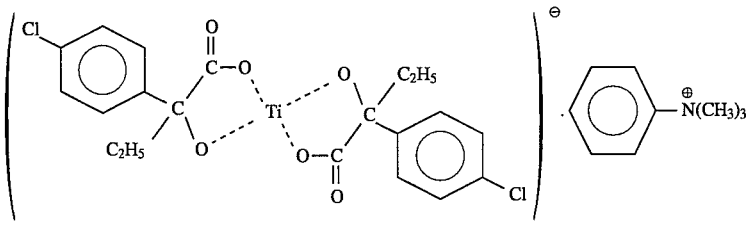
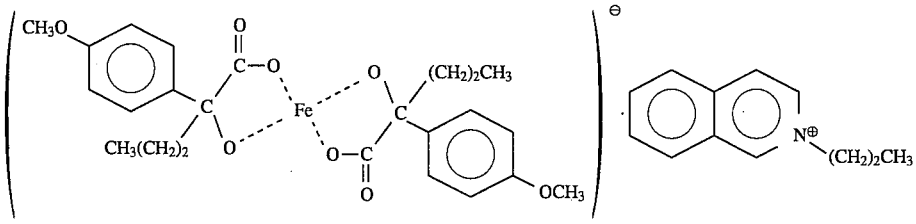
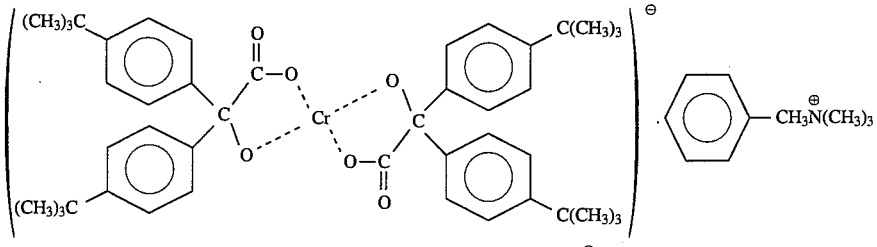
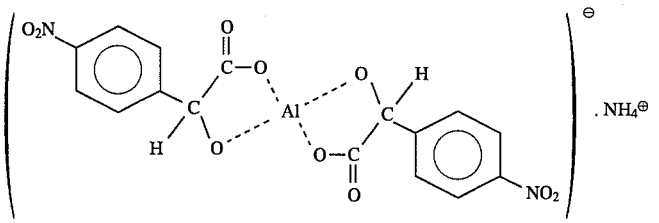
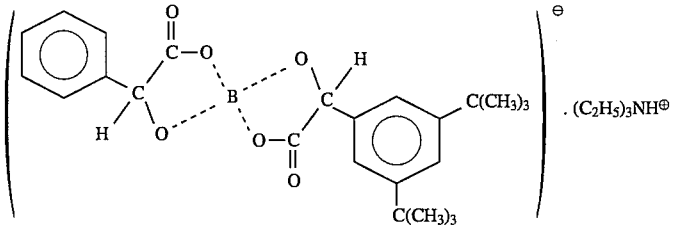
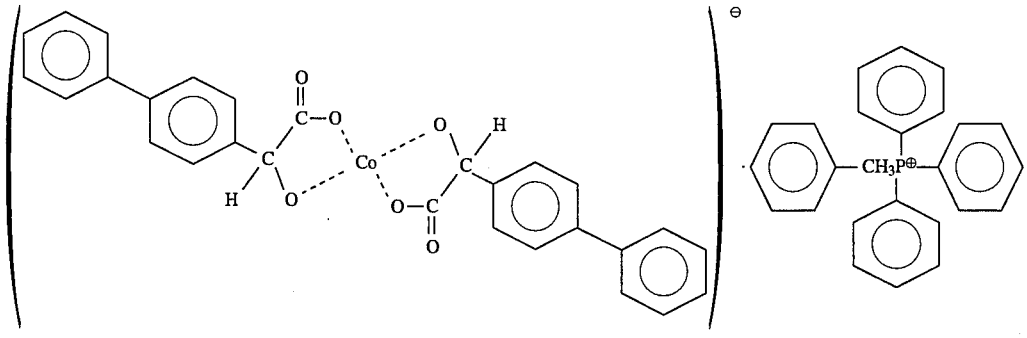

C) Boron complexes represented by the following formula (III).

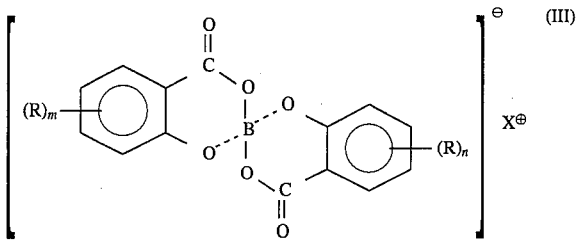

(III)

wherein R is a hydrogen atom, alkyl group, alkoxy group or halogen atom; m and n are 1, 2, 3 or 4; and X is a hydrogen ion, alkali metal ion, aliphatic ammonium ion (including substituted aliphatic ammonium ions), aromatic ammonium ion, alkylammonium ion, iminium ion, phosphonium ion or heterocyclic ammonium ion.

The following examples may be given as anions of the boron complexes represented by formula (III).

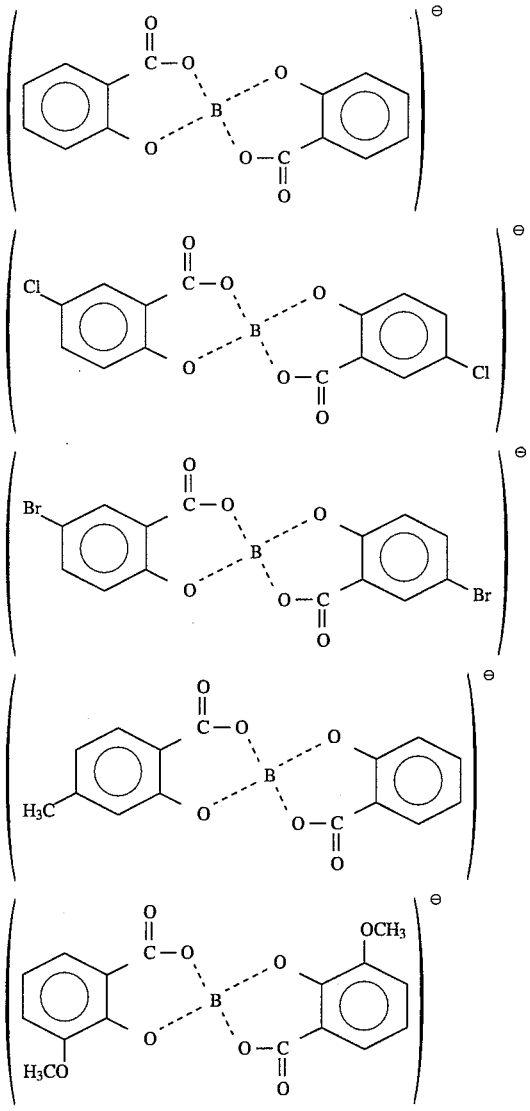

-continued

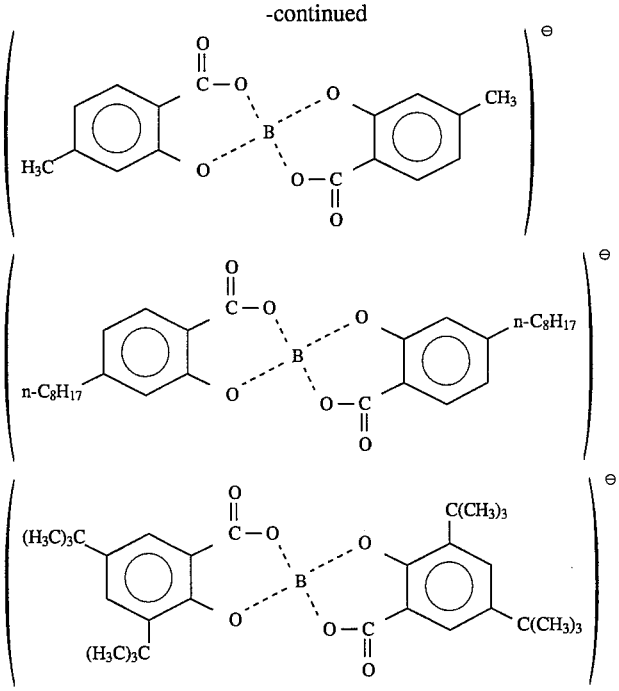

In addition, aromatic ammonium ions, aralkylammonium ions, iminium ions and phosphonium ions as cations of the boron complexes represented by formula (III) are represented by the following formulas

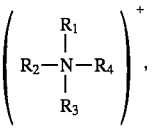

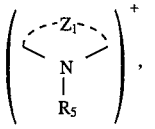

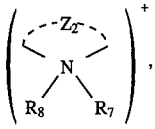

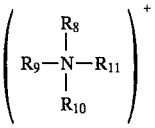

wherein each of $R_1$ to $R_{11}$ is hydrogen, a substituted or non-substituted aryl group or a substituted or non-substituted aralkyl group; at least one of $R_1$ to $R_4$ and at least one of $R_6$ to $R_7$ is an aryl group or aralkyl group; and $Z_1$ and $Z_2$ are non-metallic atom groups bonded to the respective nitrogen atoms in the above formulas to form five- or six-membered rings, and the following may be mentioned as specific examples.

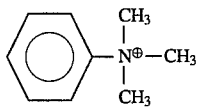

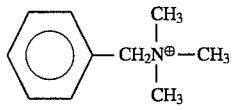

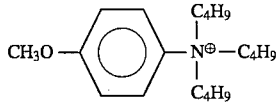

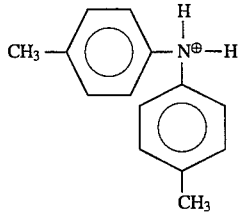

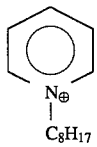

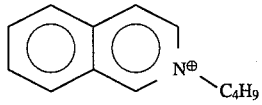

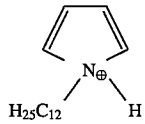

-continued

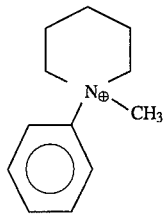

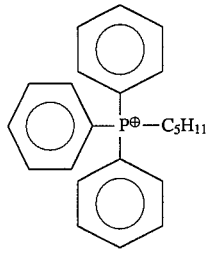

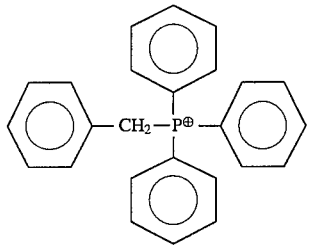

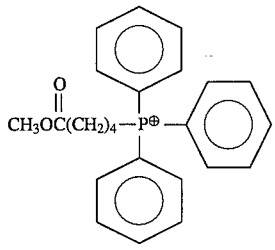

Specific methods for preparing the compounds of formulas (II) and (III) are described in U.S. Pat. No. 3,539,614, and methods of adding the materials to toner are found in Japanese Unexamined Patent Publication No. 2-48674 and No. 2-221967; nevertheless, no instances are found of their use as materials for photoconductors.

D) Metal complexes represented by the following formula (IV).

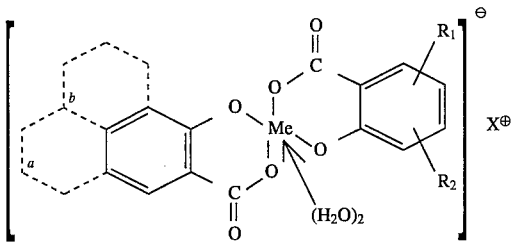

(IV)

wherein a or b is a benzene ring or cyclohexene ring which may have an alkyl group of 4–9 carbon atoms; each of $R_1$ and $R_2$ is H or an alkyl group of 4–9 carbon atoms (provided that both are not H), or a substituent which may have an alkyl group of 4–9 carbon atoms or which may form a benzene ring or cyclohexene ring; Me is Cr, Co or Fe; and X is a counter ion.

These metal complexes may be either symmetrical or asymmetrical, and as the compound to the left of the metal atom Me there may be mentioned as examples 2-hydroxy-3-naphthoic acid, alkyl ($C_4$–$C_9$)-2-hydroxy-3-naphthoic acid, 5,6,7,8-tetrahydro-2-hydroxy-3-naphthoic acid, alkyl ($C_4$–$C_9$)-5,6,7,8-tetrahydro-2-hydroxy-3-naphthoic acid, 1-hydroxy-2-naphthoic acid, alkyl ($C_4$–$C_9$)-1-hydroxy-2-naphthoic acid, 5,6,7,8-tetrahydro-1-hydroxy-2-naphthoic acid, etc., and as the compound to the right of the metal atom Me there may be mentioned as examples alkyl ($C_4$–$C_9$) salicylic acid, 3,5-dialkyl ($C_4$–$C_9$) salicylic acid, 2-hydroxy-3-naphthoic acid, alkyl ($C_4$–$C_9$)-2-hydroxy-3-naphthoic acid, 5,6,7,8-tetrahydro-2-hydroxy-3-naphthoic acid, alkyl ($C_4$–$C_9$)-5,6,7,8-tetrahydro-2-hydroxy-3-naphthoic acid 1-hydroxy-2-naphthoic acid, alkyl ($C_4$–$C_9$)-1-hydroxy-2-naphthoic acid, 5,6,7,8-tetrahydro-1-hydroxy-2-naphthoic acid, etc.

A method for adding the compounds of formula (IV) to toner is given in Japanese Examined Patent Publication No. 58-41508, but no instances are found of their use as materials for photosensors.

E) Metal complexes represented by the following formula (V).

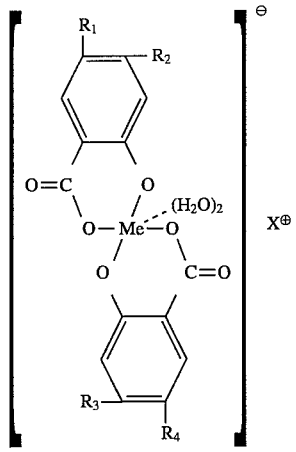

(V)

wherein each of $R_1$ to $R_4$ is H or an alkyl group, and Me is Cr, Cu or Fe.

In this formula, $R_1$ to $R_4$ are most easily hydrogen atoms, alkyl, tertiary butyl or tertiary amyl groups of 5 carbon atoms or less, or low carbon number alkyl groups.

A method for adding the compounds of formula (V) to toner is given in Japanese Examined Patent Publication No. 55-42752, but no instances are found of their use as materials for photoconductors.

F) Imide compounds represented by the following formula (VI).

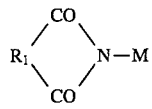

(VI)

wherein M is an alkali metal or ammonium ion; $R_1$ is

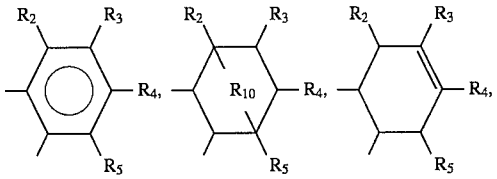

-continued

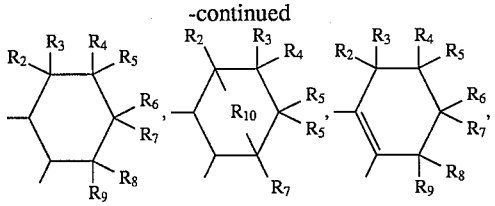

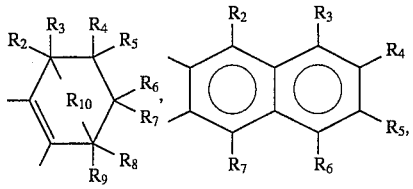

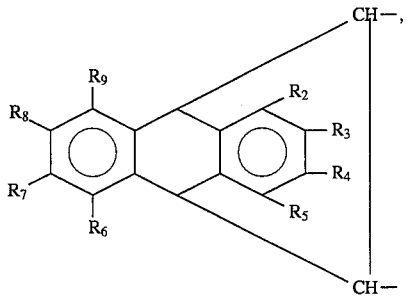

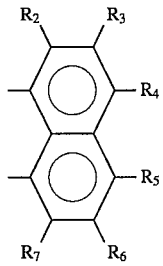

each of $R_2$, $R_3$, $R_4$, $R_5$, $R_6$, $R_7$, $R_8$ and $R_9$ is hydrogen, an alkyl group of 1–18 carbon atoms, a halogen,

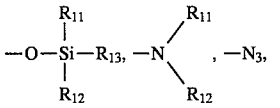

$—NO_2$ or $SO_3H$, and they may be the same or different; $R_{10}$ is

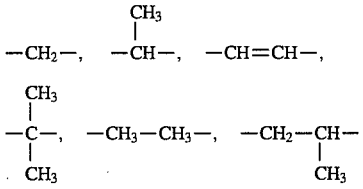

and each of $R_{11}$, $R_{12}$ and $R_{13}$ is hydrogen or an alkyl group of 1–5 carbon atoms, and they may be the same or different.

Examples of these imide compounds are given below.

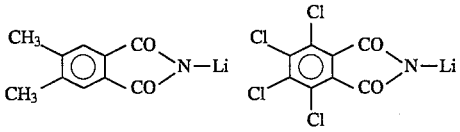

-continued

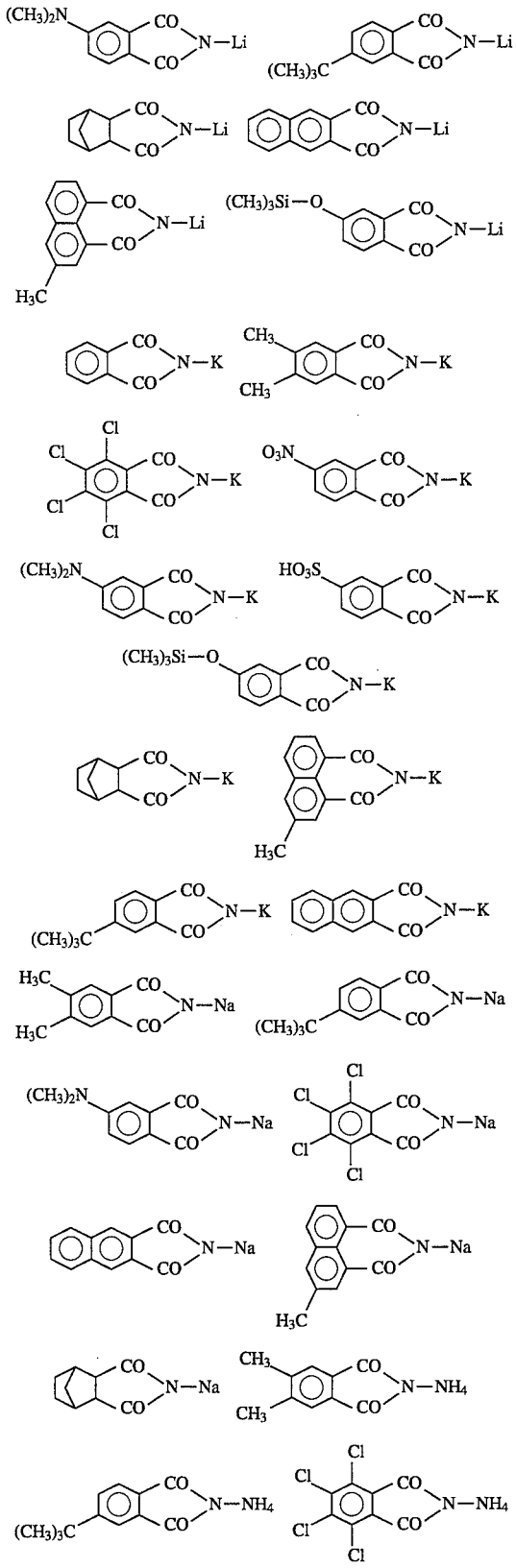

A method for adding the compounds of formula (VI) to toner is given in Japanese Unexamined Patent Publication No. 2-272461, but no instances are found of their use as materials for photoconductors.

G) Alkylphenol complexes represented by the following formula (VII).

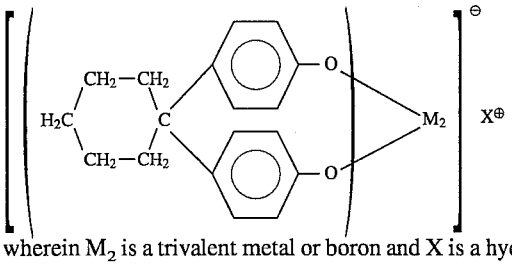

(VII)

wherein $M_2$ is a trivalent metal or boron and X is a hydrogen ion, alkali metal ion, an aliphatic ammonium ion (including substituted aliphatic ammonium ions), alicyclic ammonium ion or a heterocyclic ammonium ion.

A method for adding the compounds of formula (VII) to toner is given in Japanese Unexamined Patent Publication No. 3-6573, but no instances are found of their use as materials for photoconductors.

These alkylphenol complexes may be obtained by reacting alkylphenols with metal salts or boric acid. They may also be neutralized to obtain various salt compounds. As the metal salts there may be mentioned zinc chloride, nickel chloride, copper sulfate, cobalt chloride, manganese chloride, lead nitrate, tin sulfate, calcium chloride, magnesium sulfate, barium chloride, aluminum sulfate, chromium chloride, ferric chloride, titanium chloride, etc.

In addition, aliphatic and alicyclic ammonium ions as the cations of the alkylphenol complexes are represented by the following general formula

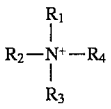

and the following may be mentioned as examples of $R_1$ to $R_4$ in the formula.

H, $CH_3$, n—$C_4H_9$, n—$C_6H_{13}$, tert—$C_6H_{13}$, $C_{10}H_{21}OC_3H_6$, $CH_3CH{=}CH(CH_2)_2$,

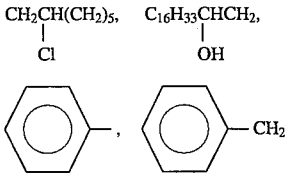

In addition, the following examples may be mentioned as heterocyclic ammonium ions.

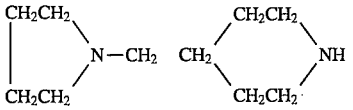

-continued

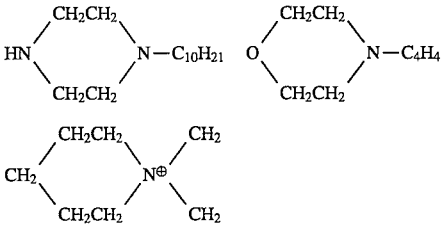

H) Zinc complexes represented by the following formula (VIII).

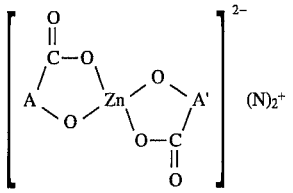

(VIII)

wherein each of A and A' is an aromatic oxycarboxylic residue selected from

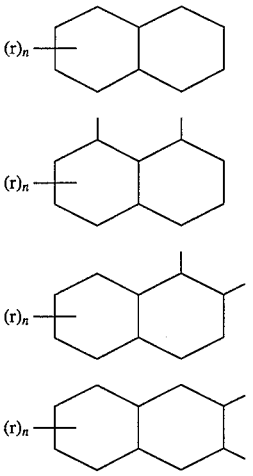

where (r) is an alkyl group or halogen atom and n is 0 or an integer 1 to 4; and M is hydrogen, an alkali metal, $NH_4$ or the ammonium of an amine.

As aromatic oxycarboxylic acids which may be substituted, forming part of the zinc complex, there may be mentioned alkyl ($C_4$–$C_9$) salicylic acid, 3,5-dialkyl ($C_4$–$C_9$) salicylic acid, 2-hydroxy-3-naphthoic acid, alkyl ($C_4$–$C_9$)-2-hydroxy-3-naphthoic acid, 5,6,7,8-tetrahalogen-2-hydroxy-3-naphthoic acid, etc.

A method for adding the compounds of formula (VIII) to toner is given in Japanese Unexamined Patent Publication No. 62-145255, but no instances are found of their use as materials for photoconductors.

I) Metal complexes represented by the following formula (IX).

(IX)

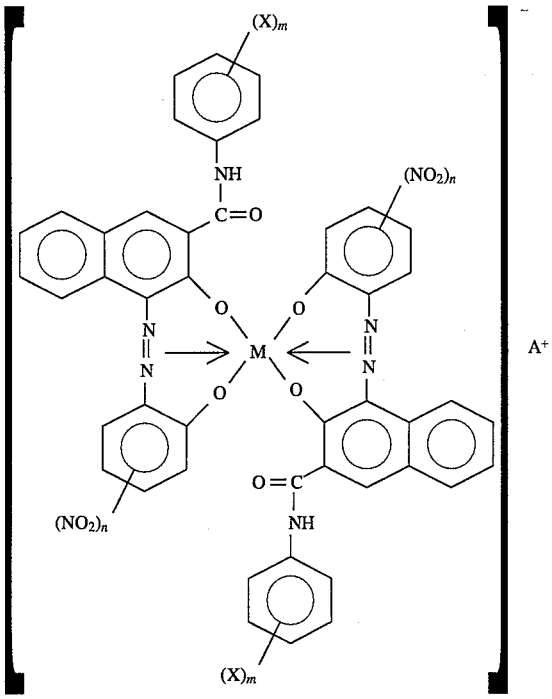

wherein X is hydrogen or a lower alkyl group, lower alkoxy group, nitro group or halogen atom; n is 1 or 2; m is an integer 1 to 3; each X may be the same or different; M is a chromium or cobalt atom; and $A^+$ is a hydrogen, sodium, potassium or ammonium ion.

The metal complex of formula (IX) may be obtained at a high yield by diazotizing a diazo component represented by formula (i) (where n is 1 or 2), using a common method to couple this diazotized compound with an azo component represented by formula (ii) (where X is hydrogen or a lower alkyl group, lower alkoxy group, nitro group or halogen atom and m is an integer 1 to 3) to synthesize a monoazo compound represented by formula (iii), and then thermally treating the monoazo compound with a chromating agent or a cobaltizing agent in water or an organic solvent. The diazo component of formula (i) to be used according to the present invention may be, for example, 5-nitro-2-aminophenol, 4,6-dinitro-2-aminophenol, etc. Also, the azo component of formula (ii) may be, for example, 3-hydroxy-2-naphthoanilide, 3-hydroxy-4'-chloro-2-naphthoanilide, 3-hydroxy-2-naphtho-p-anisidit, 3-hydroxy-2-naphtho-o-anisidit, 3-hydroxy-2-naphtho-o-phenetidit, 3-hydroxy-2',5'-dimethoxy-2-naphthoanilide, 3-hydroxy-2-naphtho-o-toluidit, 3-hydroxy-2-naphtho-2',4'-xylidit, 3-hydroxy-3'-nitro-2-naphthoanilide, 3-hydroxy-4'-chloro-2-naphtho-o-toluidit, 3-hydroxy-2',4'-dimethoxy-5'-chloro-2-naphthoanilide, etc.

(i)

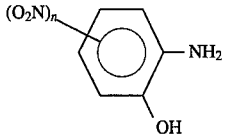

-continued (ii)

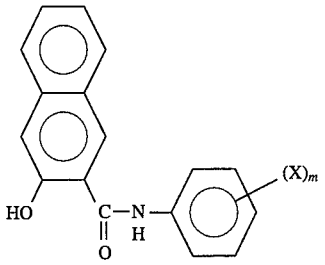

(iii)

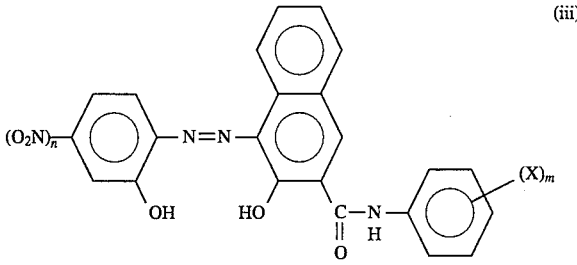

J) Metal complexes represented by the following formula (X).

(X)

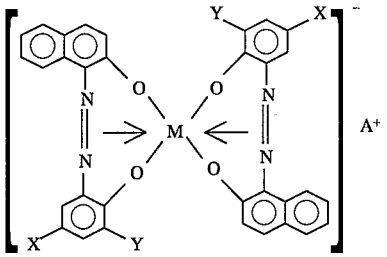

wherein X is a nitro group, sulfonamide group or halogen atom and Y is a halogen atom or nitro group (provided that X and Y are not both nitro groups); and M is a chromium or cobalt atom.

The metal complex salts of formula (X) are obtained by using a publicly known method for treatment of a monoazo compound obtained from a 2-aminophenol derivative represented by formula (iv), where X is a nitro group, sulfonamide group or halogen atom and Y is a hydrogen atom, halogen atom or nitro group (provided that X and Y are not both nitro groups) and a β-naphthol, with a chromating or cobaltizing agent. Generally, they may be easily obtained by dispersing a metal complex salt represented by formula (v) (where X and Y are as defined previously, and $A^+$ is an alkali metal ion or ammonium ion) in aqueous alcohol, and adding hydrochloric acid or sulfuric acid in slight stoichiometric excess to make the counter ion $H^+$. In this case, a lower alcohol such as methanol, ethanol, propanol or butanol is preferred for use as the alcohol, and the alcohol concentration is preferably in the range of 30–50%.

(iv)

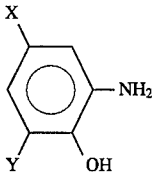

-continued (v)

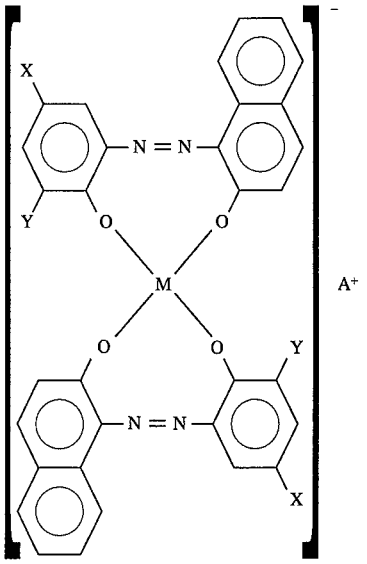

The compounds A) to J) described above are believed to have both effects of improving the charging rate and of improving the frictional electrification. The quaternary ammonium fluoride salts of A) are particularly preferred.

K) Ferroelectric material

Because ferroelectric materials have an effect of improving the charging rate, they make it possible to achieve a higher potential within the short space of time, e.g. about 0.1 second, from zone (1) to zone (2) in FIG. 1.

The inorganic and organic ferroelectric materials in the following table may be mentioned as specific examples.

TABLE I

Chemical formulas of ferroelectric materials

| No. | Chemical formula |
|---|---|
| 1 | $BaTiO_3$ |
| 2 | $Cd_2Nd_2O_7$ |

TABLE I-continued

Chemical formulas of ferroelectric materials

| No. | Chemical formula |
|---|---|
| 3 | $(—CH_2CF_2—)_n$ |
| 4 | $SrBi_2Ta_2O_9$ |
| 5 | $PbBi_2Ta_2O_9$ |
| 6 | $BiBi_3Ti_2TiO_{12}(Bi_4Ti_3O_{12})$ |
| 7 | $BaBi_4Ti_4O_{15}$ |
| 8 | $Sr_2Bi_4Ti_4O_{18}$ |
| 9 | $Ni_3B_7O_{13}Cl$ |
| 10 | SbSBr |
| 11 | BiSI |
| 12 | BiSBr |
| 13 | $NaNO_2$ |
| 14 | $CH_3NH_3Al(SO_4)$ |
| 15 | $NaNH_4(SO_4).2H_2O$ |
| 16 | $NH_4Fe(SO_4)_2.12H_2O$ |
| 17 | $NH_4V(SO_4)_2.12H_2O$ |
| 18 | $NH_4In(SO_4)_2.12H_2O$ |
| 19 | $KNO_2$ |
| 20 | SbSI |
| 21 | $Ni_3B_7O_{13}I$ |
| 22 | $Mg_3B_7O_{13}Cl$ |
| 23 | $Ba_2Bi_4Ti_4O_{18}$ |
| 24 | $Pb_2Bi_4Ti_4O_{18}$ |
| 25 | $BiBi_3Ti_2TiO_{12}(Bi_4Ti_3O_{12})$ |
| 26 | $PbTiO_3$ |
| 27 | $SrTiO_3$ |
| 28 | $PbZrO_3$ |
| 29 | $KTaO_3$ |
| 30 | $KNbO_3$ |
| 31 | $Sm_2(MoO_4)_3$ |
| 32 | $Eu_2(MoO_4)_3$ |
| 33 | $Gd_2(MoO_4)_3$ |
| 34 | $Tb_2(MoO_4)_3$ |
| 35 | $(CH_3NHCH_2COOH)_3CaCl_2$ |
| 36 | $Ca_2Sr(CH_3CH_2COO)_6$ |
| 37 | $NaNH_4(SO_4).2H_2O$ |
| 38 | $Pb(Fe_{2/3}W_{1/3})O_3$ |
| 39 | $Pb(Mn_{1/3}W_{1/3})O_3$ |
| 40 | $Pb(Mg_{1/3}Nb_{1/3})O_3$ |
| 41 | |

The following ferroelectric liquid crystal materials may also be used.

TABLE II

Ferroelectric liquid crystal materials

| No. | Structural formula |
|---|---|
| 1 | 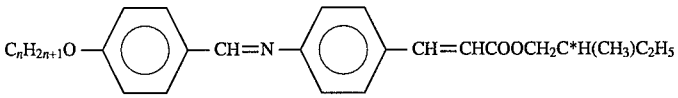 |
| 2 | 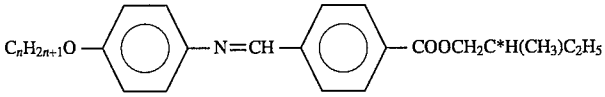 |
| 3 | 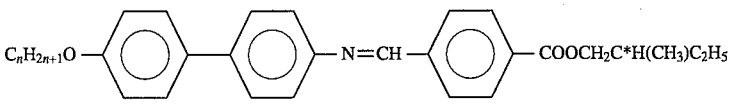 |
| 4 | 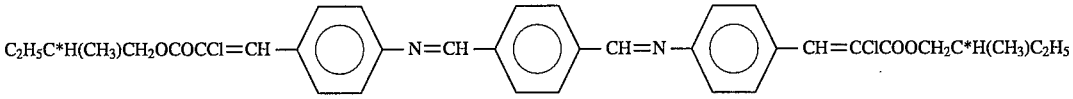 |

TABLE II-continued

| No. | Ferroelectric liquid crystal materials<br>Structural formula |
|---|---|
| 5 | $C_2H_5C^*H(CH_3)C_nH_{2n}O$ — ⬡ — N=NO — ⬡ — $OC_nH_{2n}C^*H(CH_3)C_2H_5$ |
| 6 | $C_{16}H_{33}O$ — ⬡ — N=N — ⬡ — $OCH_2C^*H(CH_3)C_2H_5$ |
| 7 | $C_8H_{17}O$ — ⬡ — ⬡ — $COOC_2H_4C^*H(CH_3)C_2H_5$ |
| 8 | $C_nH_{2n+1}O$ — ⬡ — COO — ⬡ — $COOCH_2C^*H(CH_3)C_2H_5$ |
| 9 | $C_nH_{2n+1}O$ — ⬡ — OCO — ⬡ — $OC_5H_{10}C^*H(CH_3)C_2H_5$ |
| 10 | $C_nH_{2n+1}O$ — ⬡ — ⬡ — COO — ⬡ — $CH_2C^*H(CH_3)C_2H_5$ |
| 11 | $C_nH_{2n+1}O$ — ⬡ — OCO — ⬡ — ⬡ — $CH_2C^*H(CH_3)C_2H_5$ |
| 12 | $C_nH_{2n+1}O$ — ⬡ — ⬡ — OCO — ⬡ — $OC^*H(CH_3)C_6H_{13}$ |
| 13 | $C_nH_{2n+1}O$ — ⬡ — COO — ⬡ — ⬡ — $OC^*H(CH_3)C_4H_{13}$ |
| 14 | $C_8H_{17}O$ — ⬡ — COO — ⬡ — COO — ⬡ — $COOCH_2C^*H(CH_3)C_2H_5$ |
| 15 | $C_6H_{13}O$ — ⬡ — OCO — ⬡ — OCO — ⬡ — $OCH_2C^*H(CH_3)C_2H_6$ |
| 16 | $C_2H_5C^*H(CH_3)C_3H_6O$ — ⬡ — COO — ⬡ — OCO — ⬡ — $OC_3H_6C^*H(CH_3)C_2H_5$ |
| 17 | $C_2H_5C^*(CH_3)CH_2OCO$ — ⬡ — OCO — ⬡ — COO — ⬡ — $COOCH_2C^*H(CH_3)C_2H_5$ |
| 18 | $C_nH_{2n+1}O$ — ⬡ — ⬡ — COO — ⬡ — ⬡ — $OCH_2C^*H(CH_3)C_2H_5$ |

TABLE II-continued

Ferroelectric liquid crystal materials

| No. | Structural formula |
|---|---|
| 19 | $C_8H_{17}O$ — OCO — $OC^*H(CH_3)C_6H_{13}$ |
| 20 | $C_8H_{17}O$ — COO — $OCH_2C^*H(CH_3)C_2H_5$ |
| 21 | $C_5H_{11}$ — OCO — $CH_2C^*H(CH_3)C_2H_5$ |
| 22 | $C_7H_{15}O$ — CN, $C_2H_4C^*H(CH_3C_3H_6CH(CH_3)_2$ |
| 23 | $C_8H_{17}O$ — $OCH_2$ — $COOC^*H(CH_3)C_3H_7$ |
| 24 | $C_7H_{15}O$ — $CH_2O$ — $COOC^*H(CH_3)C_6H_{13}$ |
| 25 | $C_8H_{17}O$ — $CH_2O$ — $OC_3H_6C^*H(CH_3)_2H_5$ |
| 26 | $C_8H_{17}O$ — $OCH_2$ — $CH_2C^*H(CH_3)C_2H_5$ |
| 27 | $C_nH_{2n+1}O$ — CH=CHCOO — $OCH_2C^*H(CH_3)C_2H_5$ |
| 28 | $C_nH_{2n+1}O$ — SCO — $OC_mH_{2m}C^*H(CH_3)C_2H_5$ |
| 29 | $C_nH_{2n+1}O$ — COS — $OCH_2C^*H(CH_3)C_2H_5$ |
| 30 | $C_nH_{2n+1}O$ — CH=N—N=CH — $OCH_2C^*H(CH_3)C_2H_5$, OH, OH |
| 31 | $C_8H_{17}$ — N, N — $OC_5H_{10}C^*H(CH_3)_2H_5$ |
| 32 | $C_8H_{17}$ — N, N — $OCOC_4H_8C^*H(CH_3)C_2H_5$ |

TABLE II-continued

| No. | Structural formula |
|---|---|
| 33 | 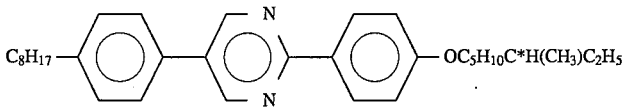 |
| 34 | 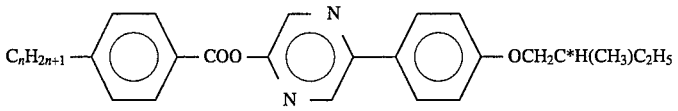 |
| 35 | 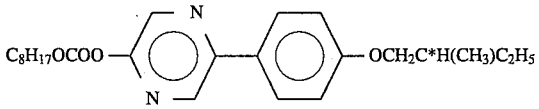 |
| 36 | 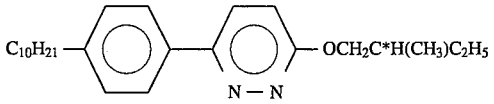 |
| 37 | 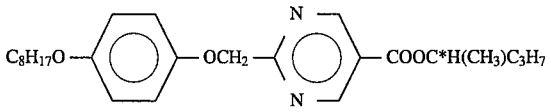 |
| 38 | 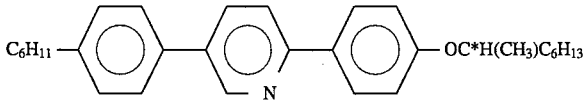 |
| 39 | 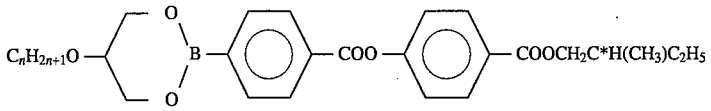 |
| 40 | 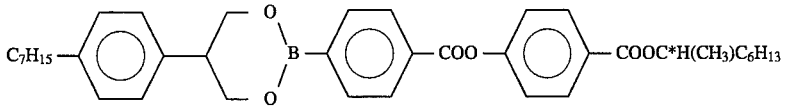 |
| 41 | 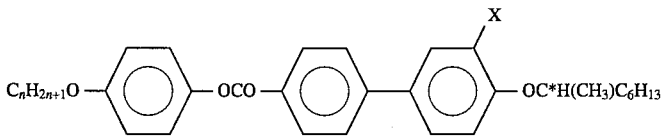 X: H. F. Cl. Br. CN |
| 42 | 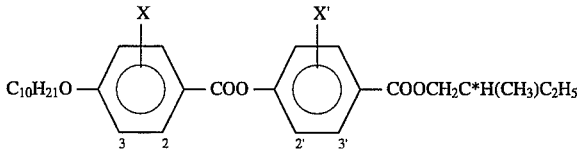 X: H. H. X': 3'-F. 3'-Cl. |
| 43 | 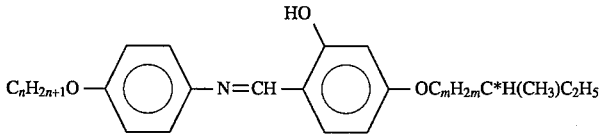 |

L) High molecular substances with an equivalent work function of 4.10 or greater.

High molecular substances with an equivalent work function of 4.10 or greater, and preferably 4.20 or greater were discovered to be effective for increasing to some degree the difference in the work functions of the conductors, which is the motive power for generating the frictional electrification.

Problems with the electrification phenomenon of insulators presently involve high molecular compounds almost exclusively. High molecular substances are very easily electrified; however, rather than assume that high molecular compounds are particularly prone to generation of electric charge, it is more natural to assume that the phenomenon occurs because their insulating properties are very good and thus they do not allow generated charges to escape.

A charge generated when a high molecular compound contacts a metal, as in the case of an organic semiconductor, depends on the work function of the contacting metal, and there is a tendency toward negative charges with metals with small work functions, and positive charges with metals with large work functions.

When a correlation diagram between work function and electrification of a high molecular compound is drawn and the work function calculated when the charge is zero, it becomes the work function of a metal which does not electrify even upon contact, and this is taken as the work function of the high molecular compound.

Specifically, there may be mentioned polyethylene resins, polypropylene resins, polybutene resins, polybutylpentene resins, polyvinylbutyral resins, epoxy resins, polycarbonate resins, polyacrylonitrile resins, polyvinyl chloride resins, polyimide resins, polyethylene fluoride resins, polypropylene fluoride resins, perfluoroalkyl resins, ethylene fluoride/propylene copolymer resins, polyvinyl fluoride resins, after which fluorine resins, polystyrene resins, nitrile rubber, fluoride rubber, etc.

M) High molecular substance with electret-forming capabilities.

Since electret materials have permanent poles, the frictional electrification is improved as in J) above.

Materials with such properties include polyvinylidene fluoride, polyvinyl fluoride, polyethylene fluoride, ethylene fluoride/propylene copolymers, poly γ-methylglutamic acid, polyvinyl chloride, polymethyl methacrylate, nylon, polyvinyl acetate, polystyrene, polyethylene terephthalate, polypropylene, polyethylene, and the like. The ferroelectric substances mentioned previously also have electret-forming capabilities.

The high molecular substances of L) and M) include substances which may be used as binders, but according to the present invention they are used not as binders but as electrification enhancers. For example, when they are used as a coating over a photosensor or as dispersed particles in a photosensitive layer they are clearly not binders, and likewise in a normal mixing ratio of 10 wt % or less in a photosensitive layer, they cannot be considered to be functioning as binders.

When the electrification enhancer such as described above is included in the photoconductor, it is present as a charge carrier layer in cases where the photoconductor is a laminated type, and it is included in the photosensitive layer in cases where it is a monolayer type. Also, in cases where it coats the surface of the photoconductor, it is dispersed in a binder (styrene acrylic, polyester, silicone resin, urethane resin, epoxy resin, etc.) or applied after dissolution, or alternatively the material is dispersed or dissolved in ethanol, acetone or the like and applied directly. Also, in cases where the photosensor has an overcoat layer, the material may be dispersed or dissolved in a solvent such as ethanol or acetone and then applied directly either in the overcoat layer or as a further coating over the overcoat layer.

However, while photosensors prepared in this manner have improved electrification in the present rear photorecording process, in developing methods using the conventional Carlson process which employ a corona charger, it has been found that the surface potential is, rather, lowered, and thus this type of photoconductor cannot be used. This is believed to be because of the difference between contact electrification and noncontact electrification.

A publicly known method (Japanese Patent Application No. 5-059057) may be used as the method of preparing the photoconductor, and an organic photosensitive layer of phthalocyanine or an azo system may be employed. The photoconductor substrate may be a transparent or semi-transparent material such as glass or acrylic resin. Also, the method of forming the transparent or semi-transparent conductive layer of the photoconductor may be by (a) vapor deposition of an inorganic material such as ITO or $SnO_2$, (b) dispersion of ITO, $SnO_2$ or the like in a resin and application, or (c) application of a soluble organic material such as polyaniline or the like; from a cost standpoint, the application methods of (b) and (c) are preferred.

There may be employed either a monolayer organic photoconductive layer, or a multi-layered organic photoconductive layer laminated in the order charge generating layer/charge carrier layer or charge carrier layer/charge generating layer; however, an organic photoconductive layer laminated in the order charge generating layer/charge carrier layer is preferred as the construction of the present photoconductor. Each of these layers may be obtained by binding a common charge generating substance or charge carrier substance with a binder resin, and may be applied using a publicly known method such as dip coating, spray coating, doctor blade coating, or the like. In addition, the charge generating layer preferably has a film thickness on the order of 0.1 to 5 μm, and particularly 1 μm or less, and the charge carrier layer preferably has a thickness on the order of 5 to 30 μm.

The charge generating substance may be a publicly known simple or mixed organic pigment such as a phthalocyanine, azo, squarilium or perylene pigment, which is selected on consideration of the spectral sensitivity characteristics. The charge carrier substance is a simple or complex compound which can carry either holes or electrons, of the photocarrier produced by the charge generating layer. As hole-carrying charge carrier substances there are known, for example, hydrazone, triarylamine, trinitrofluorenone, and the like. There may also be used photoconductive polymers which themselves have charge carrying ability, such as polyvinylcarbazole and polysilane, in which case the binder resin may be omitted.

The binder resin used may be one or a mixture of publicly known resins including polyester resins, epoxy resins, silicone resins, polyvinylacetal resins, polycarbonate resins, acrylic resins, urethane resins, etc. Also, the solvent for application of the layers by the methods mentioned above may be one or a mixture of various organic solvents including alcohol, tetrahydrofuran, chloroform, methyl cellosolve, toluene, dichloromethane, and the like.

In this case, the above-mentioned electrification enhancer may be used as the charge carrier layer after dispersal in a binder. The electrification enhancer may also be applied onto the photoconductor after dispersal in ethanol or acetone. In cases where the photosensor is covered by an overcoat layer, the material may be dispersed or dissolved in a solvent such as ethanol or acetone and then applied directly either in the overcoat layer or as a further coating over the overcoat layer.

An intermediate layer comprising a resin such as cellulose, pullulan, casein, PVA or the like may be formed between the conductive layer and the photosensitive layer. The preferred thickness for this intermediate layer is 0.1 to 5 μm, with 1 to 2 μm being more preferred, and it may be applied by a publicly known method as for the photosensitive layer mentioned above.

An insulator layer may be formed on the photosensitive layer if necessary to prevent mechanical and chemical deterioration of the surface of the photosensitive layer or to increase the dark resistance of the photoconductor. Materials which may be used as the insulator layer include thermoplastic, thermosetting and photocuring resins made of polycarbonate, polyesters (polyethylene terephthalate, polybutylene terephthalate), polymethyl methacrylate, polyvinyl acetate, polyvinyl alcohol, polysulfone, polyethyl ether ketone, polyvinyl chloride, polyvinyl butyral, polyvinyl formal, silicone, epoxys, etc., and any publicly known material may be used as the insulator layer of the photosensor. The thickness of the insulator layer is 0.01 to 5 μm, with 0.1 to 1 μm being preferred, and it may be applied by a publicly known method as for the photosensitive layer mentioned above.

The amount of the electrification enhancer contained in the above-mentioned photosensitive layer or insulator layer is 0.001 to 50 wt %, preferably 0.01 to 10 wt % and more preferably 0.1 to 5 wt % with respect to the photosensitive layer or insulator layer. Also, an electrification enhancer layer may be formed over the photosensitive layer or insulator layer. The layer may be formed by using a publicly known method such as dip application, spray coating, doctor blade coating, or the like. If a subliming substance such as phthalocyanine is used, the electrification enhancer layer may be formed by vapor deposition. The solvent for application forming may be one or a mixture of various organic solvents including alcohol, tetrahydrofuran, chloroform, ethanol, methanol, and the like. An electrification enhancer layer used to coat the photosensitive layer or insulator layer is about 0.01 to 10 μm, and particularly 0.1 μm or less.

Furthermore, the toner used may be common ground toner, a publicly known suspension polymerization toner (spherical: see Japanese Unexamined Patent Publication Nos. 54-84730 and 3-155565), or a publicly known emulsion polymerization toner (see Japanese Unexamined Patent Publication No. 63-186253), and any toner may be used so long as the form of the toner, its method of preparation, its degree of charge and its base material (styrene acrylic, polyester, epoxy, etc.) do not affect the electrification of the photoconductor. Also, there is no problem with using toners containing other publicly known additives such as silica, titanium oxide, alumina, styrene acrylic resin powders, melamine powders, etc.

The type of carrier used may be of a common material such as magnetite, ferrite or the like, and these materials may also be coated with a widely used acrylic, styreneacrylic or silicone resin, etc. The resin may also include a "resin carrier" containing magnetite powder. However, iron powder, having the highest degree of magnetism, is preferred from the point of view of carrier adhesion. Also, regarding the grain size, an average grain size of 10 to 50 μm is preferred, and 25 to 40 μm is more preferred. Since with a size of less than 10 μm there are more fine grains, the adhesion of the carrier to the photoconductor is increased, the amount of carrier is reduced, and the printing quality is lowered. Also, with a size of greater than 50 μm charge irregularities occur in the photoconductor during the rear photorecording process, making it impossible to achieve satisfactory high-resolution printing. The electrical resistance of the carrier is preferably $10^5$ to $10^{10}$ Ωcm, and more preferably $10^7$ to $10^9$ Ωcm. Printing is possible even at less than $10^5$ Ωcm, but with continuous printing damage to the photoconductor sometimes occurs due to leaking of the developing bias. Also, an electrical resistance of more than $10^{10}$ Ωcm is not preferred because of difficulty in applying a charge to the photoconductor. The method of measuring the electrical resistance of the carrier was carried out in the following manner. The resistance R is the value calculated by the equation R=100/i, where i is the measured current value (A) flowing when 1 $cm^3$ of the above-mentioned carrier is placed between 1 $cm^3$ parallel electrodes (spaced 1 cm apart) with a constant magnetic field (magnetic flux density: 950 gauss, field strength: 3400 e) and a direct current voltage of 100 V is applied.

As described above, it is possible to produce high-concentration printing without fog of the magnetic toner, if, by the effect of the electrification enhancer, i.e. an additional potential, the absolute value of the surface potential ($V_s$) of the photoconductor either approaches or is larger than the developing bias. Also, if the surface potential ($V_s$) is larger than the developing bias ($V_b$), then printing is possible even with non-magnetic color toner.

Except for the aspects of having a thus-constructed photosensor layer either containing or coated with an electrification enhancer, or having means for applying the electrification enhancer on the photoconductor layer, it may otherwise be identical to a conventional rear exposure-type imaging apparatus.

As mentioned above, according to the present invention there is provided a photoconductor containing or coated with an electrification enhancer.

Furthermore, although the above explanation was limited to describing rear photorecording, the effect of the electrification enhancement means is not limited thereto, and it is effective for electrophotographic recording which employs contact charging methods instead of corona charging methods. Such contact charging methods include brush charging, roller charging and blade charging.

In this case, the conductive support of the photosensor is not limited to a transparent or semi-transparent material, and any commonly known material employed in photoconductors may be used. Specific examples thereof include metal drums, sheets of aluminum, stainless steel or copper, and laminates or vapor deposition products of these metal foils. Other examples include insulator films and drums such as glass drums, plastic films and plastic drums conductively treated by forming thereon an electrically conductive substance such as metal powder, indium tin oxide, tin oxide, carbon black, copper iodide or a conductive polymer, either alone or in combination with an appropriate resin.

The mechanism of the improvement in the charge potential of the photosensor is believed to be due to the following.

① Improvement in the charging rate of the photosensor

② Increase in the potential due to frictional electrification between the surface of the photoconductor and the developing agent Point ① above may be explained as follows.

The present inventors have found that the problems mentioned above may be resolved in the following manner. In rear photorecording, a higher surface potential is achieved with a higher charging rate, because the electrification, light exposure and developing are performed with the developing nip (about 2 mm). In the process of electrification of the interface with the photoconductor of an electrophotographic recording apparatus, the charge efficiency is believed to be influenced by the apparent surface resistance, i.e. the contact resistance which is determined by the potential barrier of the surface layer between the roller and the photoconductor (in the case of roller charging), the brush and the photosensor (in the case of brush charging), the blade and the photoconductor (in the case of blade charging) or the tip of the developing agent and the photoconductor surface (in the case of contact charging with a developing agent in the rear photo process), and by the capacitance of the photoconductor.

Defining $C_0$ as the capacitance of the photoconductor and $R_s$ as the contact resistance, the surface potential $V_s$ after t seconds from the application of a voltage $V_0$ is expressed as $$V_s = V_0 \{1 - \text{experiment}(-t/C_0R_s)\}$$

Here, if a polarizable capacitance layer is provided on the surface, it receives the charging from the contact resistance as well as the potential distribution determined by the capacity of the capacitance layer, and therefore the potential elevating rate is substantially increased. At such time the surface potential $V_s'$ is expressed as $$V_s' = V_0 \left[ \left( 1 - \exp\left\{ \frac{-t}{(C_0 + C_1)R_6} \right\} + \frac{C_1}{(C_0 + C_1)} \exp \frac{-t}{(C_0 + C_1)R_6} \right\} \right]$$

Thus, due to the contribution of $V_0$ $\{C_1/C_0+C_1)\}$, the surface potential is greater than when no capacitance layer is provided. That is, it is believed that the charging rate of the photoconductor is improved by the presence of the polarizable dielectric material provided on the surface of the photoconductor.

When such a polarizable material is actually used as the surface layer, an actual measured increase in the absorption current is observed as a result of the electrical double layer thought to be formed near the surface, and its function as a capacitance layer has been confirmed. FIG. 8 shows a curve which demonstrates the difference. This indicates an absorption current flowing after a voltage of 20 V is applied and maintained for 30 seconds in a sandwiched cell constructed by a photoconductor substrate, a photoconductor and the electrode formed on its surface. In this graph, curve 1 shows the results obtained when a photoconductor with a normal construction was used, and curve 2 shows the results when an ammonium salt compound layer (film thickness: 0.1 μm) of formula (I) was formed on the photoconductor surface. When a barium titanium oxide ($BaTiO_3$) layer (0.1 μm thickness) was used instead of the ammonium salt compound layer, or 2-methylbutyl-p-[p-(decyloxybenzylidene)-amino]-cinnamate (hereunder abbreviated to DOBAMBC), listed as No. 1 in Table 2 was added to the photoconductor in an amount of 5–10 wt %, the curve obtained matched curve 2 in FIG. 8 almost exactly.

From these results, it was substantiated that the use of an electrification enhancer improves the chargeability of the photoconductor, and it was found that a photoconductor with this construction exhibits satisfactory charging properties when employed in the contact charging method. The relationship $V_s \geqq V_b$ was not satisfied only in ①. Here, it is believed that ② occurs as a synergistic effect.

In other words, it is because the electrification based on the difference in the Fermi standard of the surface layers upon friction between the developing agent nip and the surface layer of the photoconductor surface, in the case of contact charging of the developing agent, increases as the difference between them increases. The equivalent work function exhibited according to the present invention has this critical value, and the chargeability may be improved by contact charging with this difference.

Thus, the increase in the $V_s$ of the photosensor is believed to be the result of the synergistic effect of 1 and ② by addition of materials A–K to the photoconductor.

In corona charging, not only is there no effect of the electrification enhancer, but the electrification is inferior.

EXAMPLES

Figure 9:
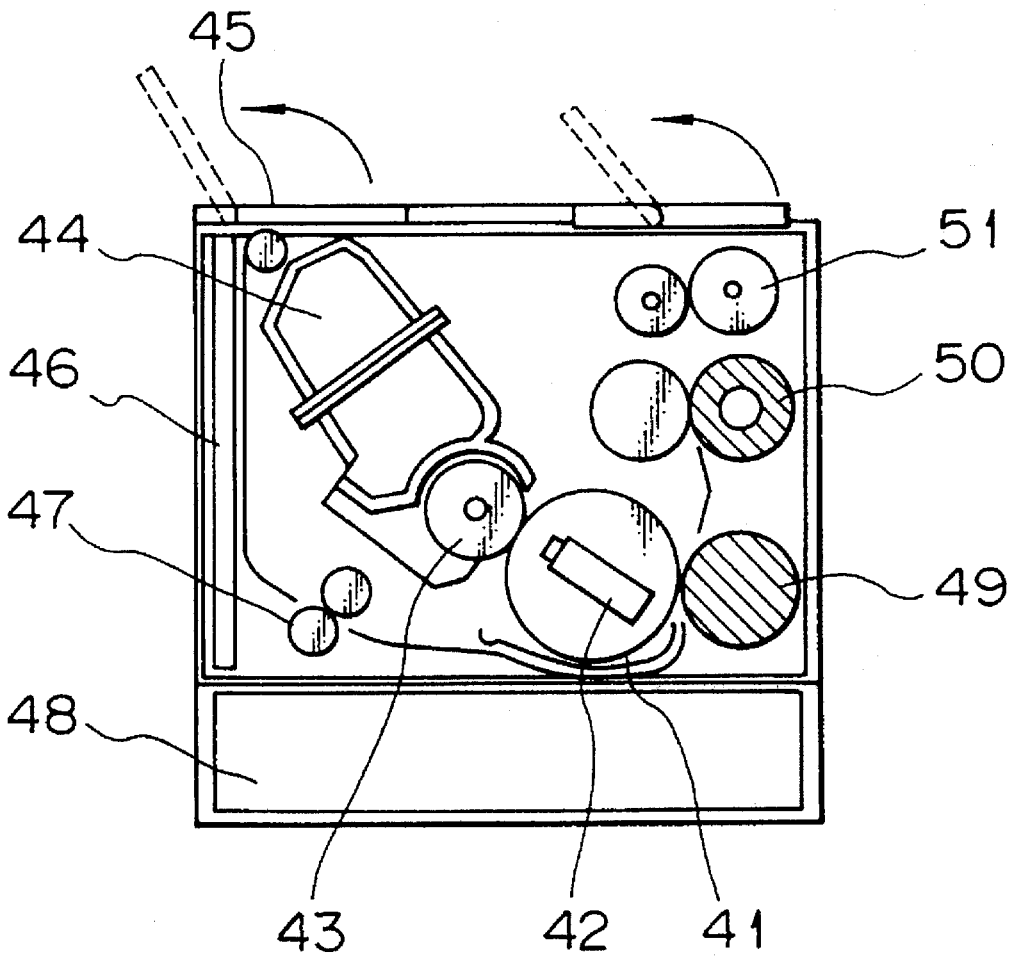
FIG. 9 is a schematic diagram of a rear photoprinter.

Apparatuses (1) Rear photoprinter (FIG. 9)

FIG. 9 shows the construction (sectional view) of a rear photorecording device. In this drawing, 41 is a photosensor drum, 42 is an LED, 43 is a developing roller, 44 is a toner cartridge, 45 is a hand-operated guide, 46 is a PT plate, 47 is a resist roller, 48 is a power source, 49 is a transfer roller, 50 is a thermal fixer and 51 is a paper ejector roller.

As a more detailed description, it has an anchored magnet, a developing roller 43 of which only the sleeve is rotatable, and only a high-resistance carrier is present on the developing roller and only toner is supplied. Light exposure means used the LED 42 built inside the photoconductor 41, and it is oriented in the direction of the photoconductor 41 and the nip of the developing roller 43. The developing is carried out by an alternating current voltage $V_{AC}$ from the sleeve on the developing roller side set to a peak to peak voltage $V_{PP}$ of 700 V, a frequency of 800 Hz and a direct current voltage $V_{DC}$ of −350 V. Here, the gap between the photoconductor and the developing roller was 0.3 mm.

In this apparatus, the electrifier, destaticizing lamp and cleaner of the conventional type of apparatus may be eliminated, while the optical system is placed inside the transparent photoconductor. Furthermore, the transferring is carried out by a roller transfer rather than corona transfer, which allows a smaller size (100 mm square section), lighter weight and lower cost, without generation of ozone which is harmful to humans.

However, when using this apparatus, an alternating voltage with a DC voltage superposed on an AC voltage may be applied to the sleeve, as described previously, or constant voltage control or constant current control may be effected.

In addition, the developing method may be a so-called two-component developing method wherein the toner concentration is strictly controlled and the carrier and toner are present on the entire developer, or it may be a developing method such as described in Japanese Unexamined Patent Publication No. 5-150667, with a small amount of the carrier and wherein the toner concentration is not strictly controlled, as opposed to the two-component method. This apparatus employs the latter method. However, the toner used contained 40% magnetic powder. Also, the cycle rate of the photoconductor was 24 mm/s.

Figure 10:
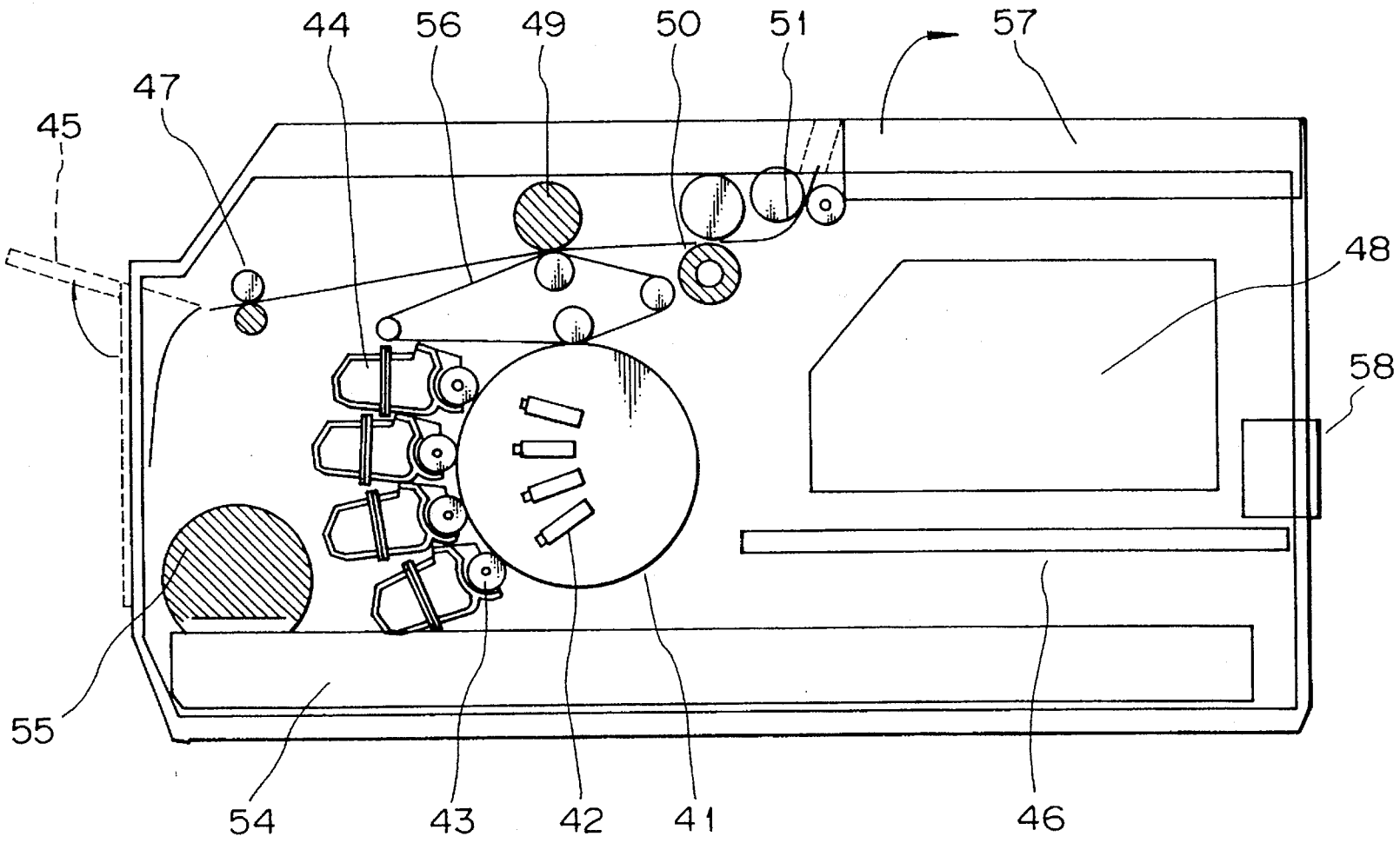
FIG. 10 is a schematic diagram of a color rear photoprinter.

(2) Rear color photoprinter (FIG. 10)

An example of a color printer using non-magnetic color toner is shown in FIG. 10. The developing is carried out using the common two-component method, and the construction is such that one color of the non-magnetic color toner is developed for each rotation of the photoconductor. Four LEDs are built inside the photoconductor, and are oriented in the direction of the developing agents. It may also have a mechanism for rotating one LED in the direction of the developing agent corresponding to the color to be developed.

The parts in FIG. 10 which correspond to those in FIG. 9 have the same reference numbers (same hereunder). 54 is a paper cassette, 55 is a pickup roller, 56 is an intermediate transfer belt, 57 is a stacker, and 58 is a connector.

Figure 11:
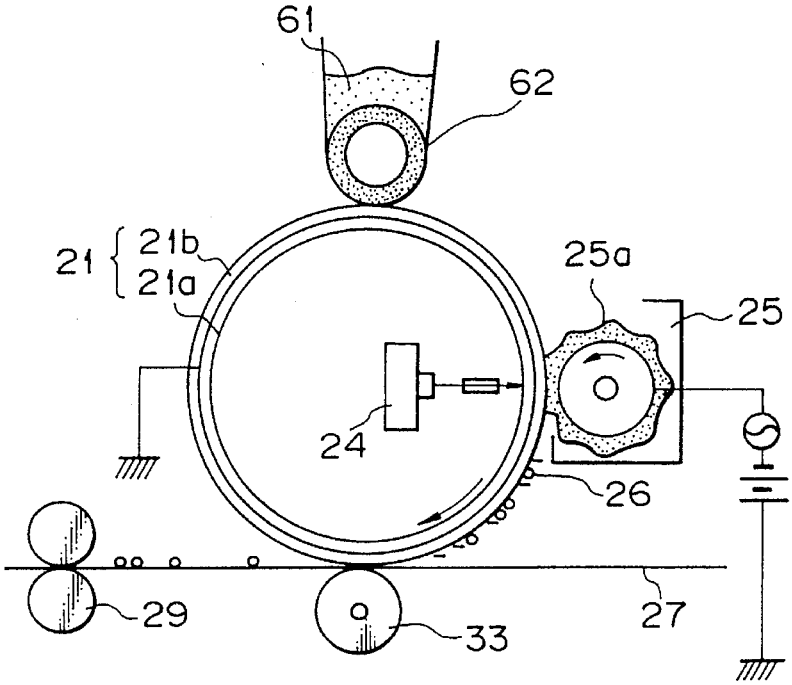
FIG. 11 shows a rear photorecording apparatus equipped with means for applying an electrification enhancer.

(3) Rear photoprinter with electrification enhancer applying means (FIG. 11)

This apparatus is experimental, and has means for applying an electrification enhancer onto the photoconductor. The applying means is preferably a rotating sponge roller.

Figure 4:
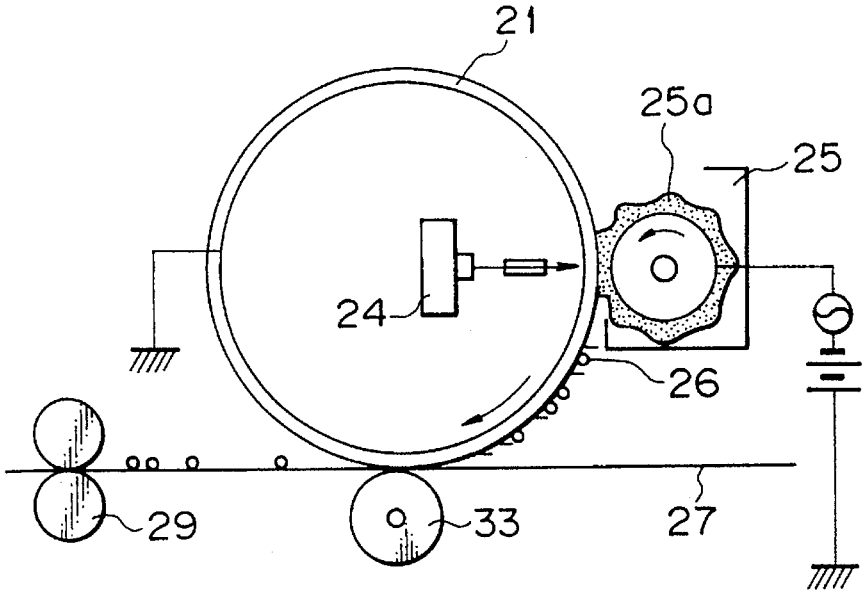
FIG. 4 shows the construction of an apparatus used in rear photorecording.
Figure 5:
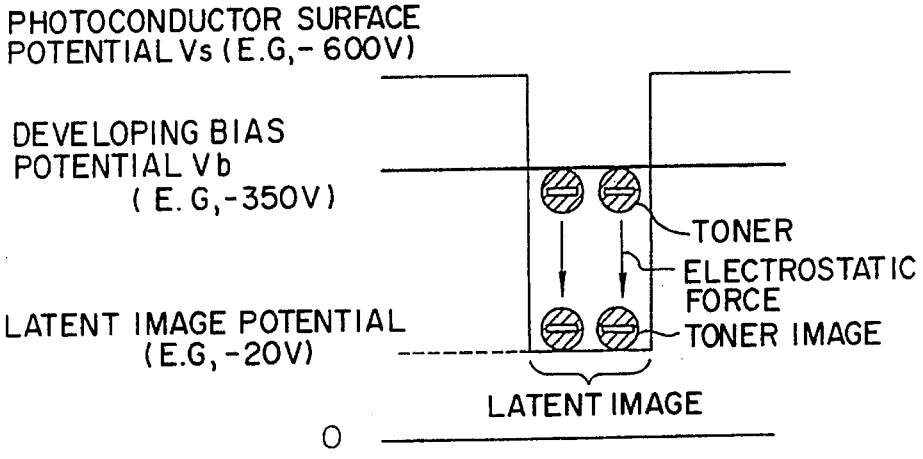
FIG. 5 shows the relationship of the potentials in imaging by the Carlson process.

This apparatus is the same as the one in FIG. 4, except that it has a case containing the electrification enhancer 61 and a sponge roller 62 on the photoconductor drum 21. The photoconductor drum 21 comprises a support 21*a* and a photosensitive layer 21*b*.

Figure 1:
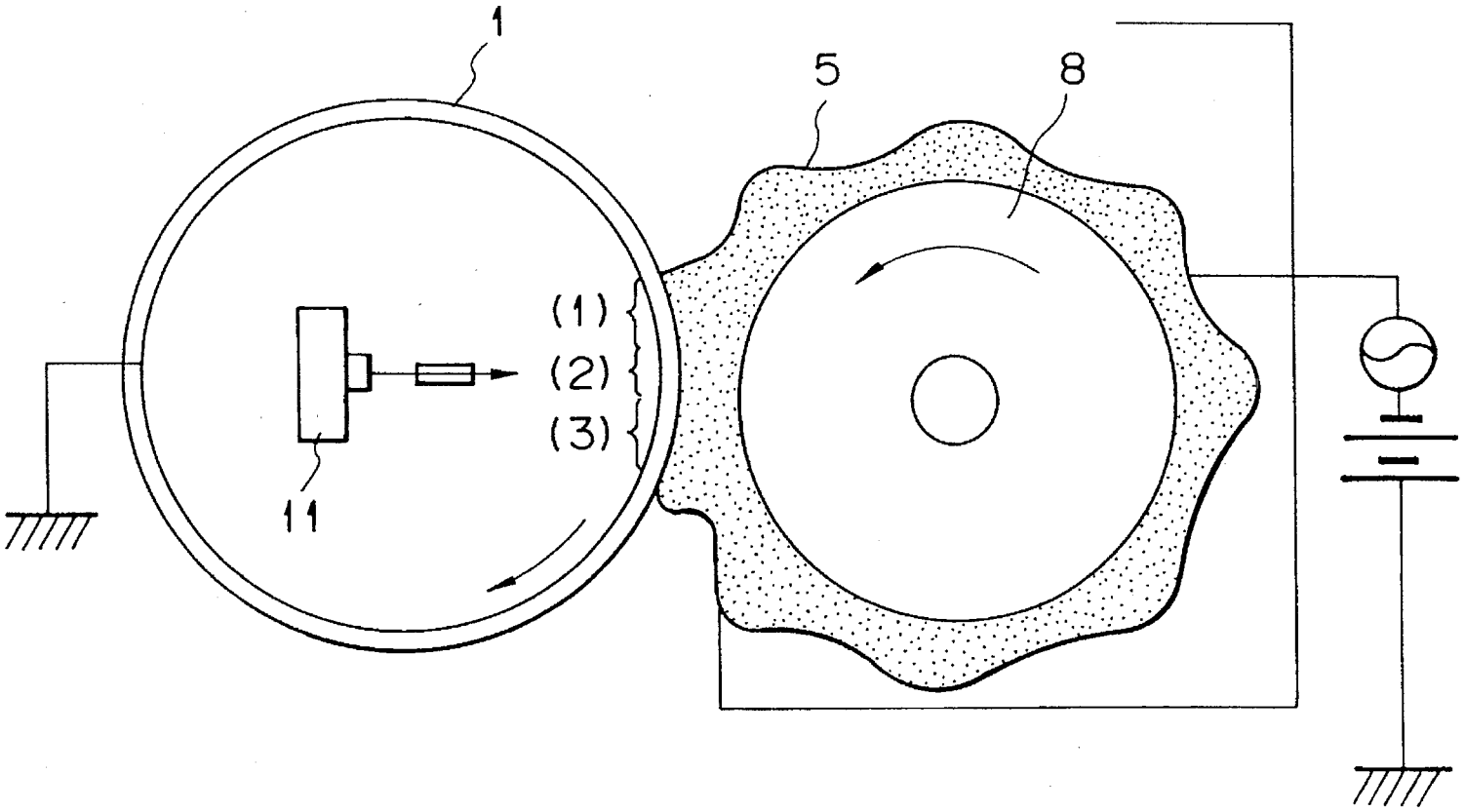
FIG. 1 is a schematic diagram for explanation of the principle of rear photorecording.
Figure 2A:
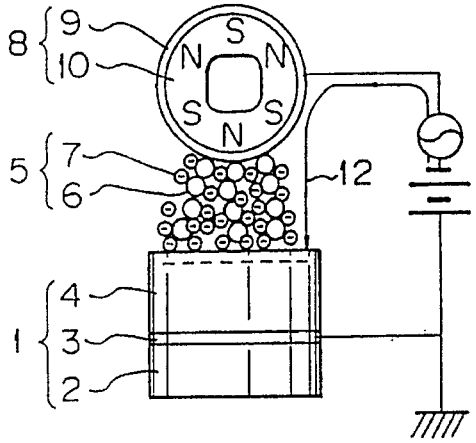
FIGS. 2A to 2C illustrate the basic principles of imaging in rear photorecording.
Figure 2B:
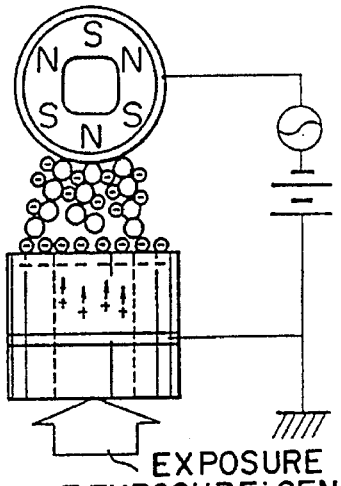
Figure 2C:
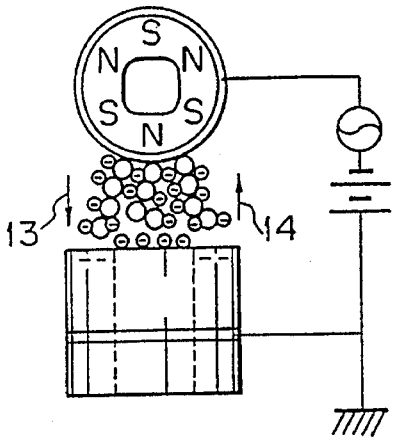
Figure 3:
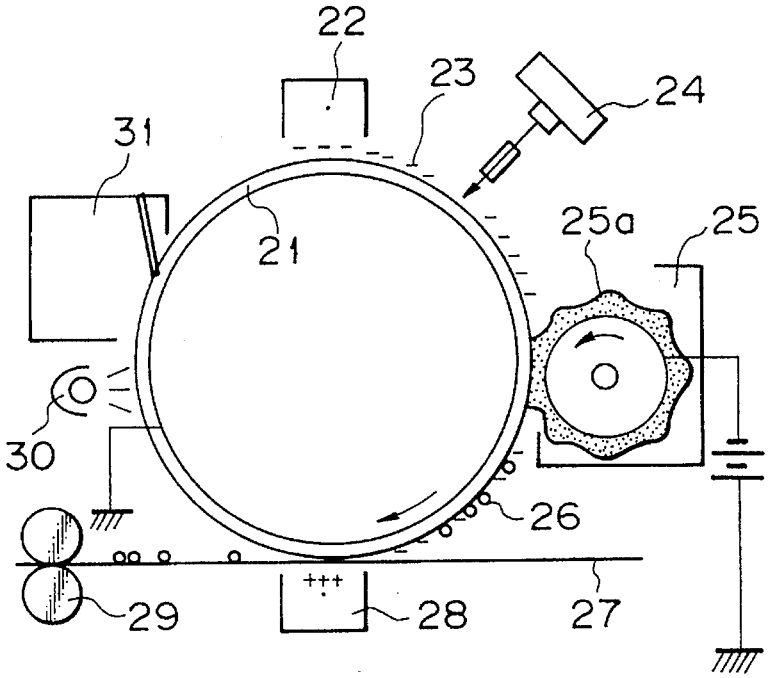
FIG. 3 shows the construction of an apparatus used in the conventional Carlson process.

(4) Experimental corona charge-type Carlson apparatus (FIG. 3)

FIG. 3 shows an experimental apparatus with a corona charger for carrying out the common Carlson process.

Example 1: Ammonium salt of formula (I)

Preparation of photoconductors

Conventional photoconductor (1)

The support used for the photoconductor was a transparent glass cylinder. A conductive layer of soluble polyaniline was formed to a thickness of 0.1 μm. Next, one part of cyanoethylated pullulan was dissolved in 10 parts (by weight) of acetone, and this was dip coated onto the conductive layer and dried at 100° C. for one hour to form a 1 μm thick intermediate layer. A mixture containing one part of α-oxothitalphthalocyanine, one part of polyester and 20 parts of 1,1,2-trichloroethane was dispersed and mixed for 24 hours using a hard glass bowl and a hard glass pot was then applied onto the above-mentioned intermediate layer and dried at 100° C. for one hour to form a charge generating layer with a thickness of about 0.3 μm (this is referred to as the transparent drum ① with a charge generating layer). Next, to form the charge carrier layer, an application solution was prepared by dissolving one part of a butadiene derivative and one part of a polycarbonate in 17 parts of dichloromethane. The above-mentioned charge generating layer was dip coated with this solution, and dried at 90° C. for one hour to prepare a charge carrier layer with a thickness of about 15 μm, and a photosensitive layer was formed thereon to obtain a conventional photoconductor.

Photoconductor (2)—Compound 1

One part of a butadiene derivative, one part of a polycarbonate and 0.02 part of compound 1 shown below (prepared according to the method described in U.S. Pat. No. 3,535,381) were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (2).

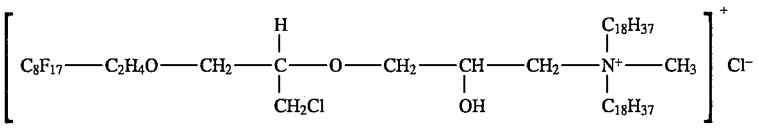

(Compound 1)

(Compound 1)

Photoconductor (3)—Application of compound 1

Compound 1 was applied at 0.01 part onto 1 part of a polyester resin (Kao) as the overcoat layer on the photosensor (1), and the application was dried at 90° C. for one hour forming a layer with a thickness of about 1 Ìm, to obtain photoconductor (3).

Photoconductor (4)—Application of compound 1 (ethanol)

The photoconductor (1) was dip coated with a solution prepared by dissolving one part of compound 1 in 100 parts of ethanol, forming a film with a thickness of 100 to obtain photoconductor (4).

Photoconductor (5)—Compound 1 (overcoat layer)

Photoconductor (1) was dip coated with TOSUPURAIPU (product of Toshiba Silicone) as an adhesive layer for the overcoat layer and dried at 90° C. for 30 minutes, and then dip coated with one part of the silicon-based coating agent TOSUGADO (product of Toshiba Silicone) and allowed to harden at 90° C. for one hour to form a layer with a thickness of about 1 Ìm. It was then dip coated with a solution prepared by dissolving one part of compound 1 in 100 parts of ethanol, forming a film with a thickness of 100 to obtain photoconductor (5).

Photoconductor (6)

One part of a butadiene derivative, one part of a polycarbonate and 0.02 part of tetramethylammonium hydroxide were dissolved in 17 parts of dichloromethane to prepare an application solution. A transparent drum ① with a charge generating layer was dip coated with this solution, and dried at 90° C. for one hour to prepare a charge carrier layer with a thickness of about 15 Ìm, and a photosensitive layer was formed thereon to obtain a photoconductor (6).

Photoconductor (7)—Application of compound 1

Tetramethylammonium hydroxide was applied at 0.01 part onto 1 part of a polyester resin (Kao) as the overcoat layer on the photoconductor (1), and the application was dried at 90° C. for one hour forming a layer with a thickness of about 1 Ìm, to obtain photoconductor (7).

Photoconductor (8)—Application of compound 1 (ethanol)

The photoconductor (1) was dip coated with a solution prepared by dissolving one part of tetramethylammonium hydroxide in 100 parts of ethanol, forming a film with a thickness of 100 to obtain photoconductor (8).

Photoconductor (9)—Compound 1 (overcoat layer)

Photoconductor (1) was dip coated with TOSUPURAIPU (product of Toshiba Silicone) as an adhesive layer for the overcoat layer and dried at 90° C. for 30 minutes, and then dip coated with one part of the silicon-based coating agent TOSUGADO (product of Toshiba Silicone) and allowed to harden at 90° C. for one hour to form a layer with a thickness of about 1 Ìm. It was then dip coated with a solution prepared by dissolving one part of tetramethylammonium hydroxide in 100 parts of ethanol, forming a film with a thickness of 100 to obtain photosensor (9).

Preparation of toner

| Emulsion polymerization toner (black magnetic toner) | |
|---|---|
| [Monomer] | |
| Styrene (Wako Junyaku) | 50 parts by weight |
| Butyl acrylate (Wako Junyaku) | 10 parts by weight |
| [Polymerization initiator] | |
| N-50 (Wako Junyaku) | 2.5 parts by weight |
| [Emulsifier] | |
| Neogen SC (Daiichi Kogyo Seiyaku) | 0.2 parts by weight |

These components were used for emulsion polymerization at 70° C. for 3 hours to obtain 1 to 2 Ìm

| | |
|---|---|
| Resin beads | 55 parts by weight |
| [Coloring agent] | |
| Carbon (BPL) | 5 parts by weight |
| [Magnetic powder] | |
| Magnetite (MTZ-703, Toda Kogyo, K.K.) | |

These components were mixed and the mixture was kept at 90° C. for 6 hours while being dispersed and stirred with a slasher. During this time, 10–12 Ìm growth of the complex (toner) was confirmed. The mixture was then heated in water at 90° C. for one hour, and the toners were centrifuged and filtered. The toners were repeatedly washed with water until the pH reached 8 or lower, to obtain toner magnetic toner with a volume average grain size 7.2 Ìm.

Color toner

Yellow toner:

To 91 parts by weight of a polyester resin (NE-2150, Kao, K.K.) as the binder and 5 parts by weight of Color index No. 21090 (Pigment Yellow 12, KET Yellow 406, Dainihon Ink Kagaku Kogyo) as the coloring agent, was added 4 parts by weight of propylene wax (BISCORU 550P, Sanyo Kasei), and the mixture was fused and kneaded at 160° C. for 30 minutes with a pressure kneader, to obtain a toner lump. The cooled toner lump was made into approximately 2 mm crude toner with a rotoplex grinder. Next, the crude toner was made into fine powder using a jet mill (PJM grinder, Nihon Pneumatic Kogyo), and the ground product was separated with an air classifier (product of Alpine Co.) to obtain toner with a volume average grain size of 7.2 Ìm.

Magenta toner:

Magenta toner with a volume average grain size of 7.1 Ìm was obtained by the same method used to obtain the yellow toner, except that instead of pigment yellow as the coloring agent there was used 5 parts by weight of Color index No. 73916 (pigment red 122, KET Red 309, Dainihon Ink Kagaku Kogyo).

Cyan toner:

Cyan toner with a volume average grain size of 7.3 Ìm was obtained by the same method used to obtain the yellow toner, except that instead of pigment yellow as the coloring agent there was used 5 parts by weight of Color index No. 74160 (pigment blue 15, KET Blue 102, Dainihon Ink Kagaku Kogyo).

Black toner:

Black toner with a volume average grain size of 7.3 Ìm was obtained by the same method used to obtain the yellow toner, except that instead of pigment yellow as the coloring agent there was used 5 parts by weight of carbon black (Mogaru L, Cavot Co.).

Method for producing carrier

One gram of methyltriethoxysilane was diluted with 1 liter of methanol to make a coating solution, which was used to coat 5 kg of a carrier core material (iron powder; spherical, average grain size 30 Ìm) by the rotary dry method. After coating, heat treatment was effected for one hour at a temperature of 120° C. in an air atmosphere, to obtain a sample carrier. The electrical resistance of the carrier was $10^9$ Ωcm.

Imaging

The photoconductors and apparatuses described above were used to form images for evaluation. The results are shown in Tables III to VI.

TABLE III

| | | Different photoconductors | | | | | |
|---|---|---|---|---|---|---|---|
| Photo-conductor | Apparatus | Toner | Toner conc. (wt %) | $V_b$ (V) | $V_s$ (V) | Printing density | Fog |
| (1) | (1) | ① | 30 | −350 | −293 | o | x |
| (2) | (1) | ① | 30 | −350 | −366 | o | o |
| (3) | (1) | ① | 30 | −350 | −356 | o | o |
| (4) | (1) | ① | 30 | −350 | −343 | o | o |
| (5) | (1) | ① | 30 | −350 | −376 | o | o |
| (6) | (1) | ① | 30 | −350 | −265 | o | x |
| (7) | (1) | ① | 30 | −350 | −256 | o | x |
| (8) | (1) | ① | 30 | −350 | −276 | o | x |
| (9) | (1) | ① | 30 | −350 | −262 | o | x |

Evaluation was made with different photoconductors, and when the conventional photoconductor (1) and non fluorinated ammonium salt were used, the surface potential ($V_s$) was low and fog was produced. With the other photoconductors, satisfactory printing density and fog characteristics were obtained.

The evaluation of the printing was made in the following manner.

1. A printing density of 1.3 or greater with OD was indicated as o. The printing density was measured using a Konica densitometer (PDA-65, Konica).

2. Fog of 0.02 or less was indicated as o, in terms of the change in density ΔOD due to fog on the photoconductor at normal temperature and humidity (25° C., 50% RH). Here, the change in printing density (ΔOD) for evaluation of the fog refers to the value obtained by taking a dust figure on tape (Scotch mending tape) from the photosensor prior to transfer onto paper, measuring the density of the white paper sections, and subtracting the density of the tape.

TABLE IV

| | | Different toner concentrations | | | | | |
|---|---|---|---|---|---|---|---|
| Photo-conductor | Apparatus | Toner | Toner conc. (wt %) | $V_b$ (V) | $V_s$ (V) | Printing density | Fog |
| (1) | (1) | ① | 10 | −350 | −320 | o | x |
| (1) | (1) | ① | 50 | −350 | −285 | o | x |
| (1) | (1) | ① | 70 | −350 | −280 | x | x |
| (1) | (1) | ① | 90 | −350 | −280 | x | x |
| (2) | (1) | ① | 10 | −350 | −377 | o | o |
| (2) | (1) | ① | 50 | −350 | −356 | o | o |
| (2) | (1) | ① | 70 | −350 | −342 | o | o |
| (2) | (1) | ① | 90 | −350 | −330 | o | o |
| (6) | (1) | ① | 10 | −350 | −312 | o | x |
| (6) | (1) | ① | 50 | −350 | −250 | o | x |
| (6) | (1) | ① | 70 | −350 | −243 | o | x |
| (6) | (1) | ① | 90 | −350 | −231 | o | x |

With conventional photoconductors (1) and (6), good printing density was obtained in a low toner concentration range, but the fog was considerable. With the other photoconductors, the surface potential ($V_s$) increased, and both the printing density and fog were satisfactory.

TABLE IV

| | | Non-magnetic color toner | | | | | |
|---|---|---|---|---|---|---|---|
| Photo-conductor | Apparatus | Toner | Toner conc. (wt %) | $V_b$ (V) | $V_s$ (V) | Printing density | Fog |
| (2) | (2) | ② | 5 | −350 | −370 | o | o |
| (1) | (2) | ② | 5 | −350 | −325 | x | x |
| (1) | (3) | ② | 5 | −350 | −351 | o | o |

Note: The electrification enhancer used in apparatus (3) was compound (I).

Satisfactory properties are obtained with the photoconductor (2) even with non-magnetic color toner. Also, satisfactory properties are obtained even with photoconductor (1) if apparatus (3) is used.

TABLE VI

| | | Differences between rear photorecording and Carlson process | | | | | |
|---|---|---|---|---|---|---|---|
| Photo-conductor | Apparatus | Toner | Toner conc. (wt %) | $V_b$ (V) | $V_s$ (V) | Printing density | Fog |
| (1) | (4) | ② | 5 | −350 | −600 | ○ | ○ (conv. method) |
| (2) | (4) | ② | 5 | −350 | −342 | ○ | x |

When a photoconductor which exhibited satisfactory surface potential ($V_s$) with the rear photorecording method was used in the Carlson method (Corona charging), the surface potential ($V_s$) decreased and fog was produced, making it unusable.

Example 2: Compounds of formulas (II)–(VIII)

Preparation of compounds (1) Boron complexes represented by formulas (II) and (III) (Compounds 2 and 3)

The following compounds A and B were reacted together in an aqueous solution of boric acid and amine to prepare boron complexes.

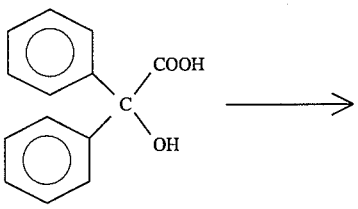

Compound A Boric acid Amine

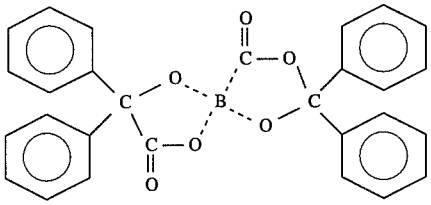

Compound 2

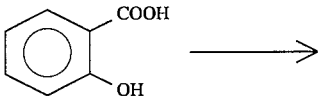

Salicylic acid Boric acid Amine

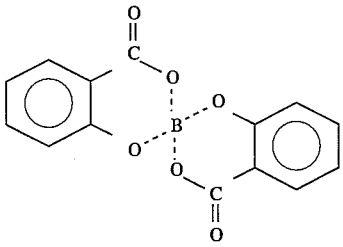

Compound 3

(2) Cr complex represented by formula (IV) (Compound 4)

(Synthesis of 2-hydroxy-3-naphthoic acid chromium complex)

A 750 g portion of 2-hydroxy-3-naphthoic acid is dispersed in 1500 g of water, to which dispersion a 40% aqueous solution of $Cr_2(SO_4)_3$ is then added to a proportion of 98%, prior to heating at 95°–98° C. To this mixture is added over one hour a solution of 25 g of caustic soda in 200 g of water. This is stirred for 3 hours while at 95°–98° C. The reaction product becomes a very light yellow-green slurry, with a pH of about 3.2. The slurry is filtered, washed with water until the pH reaches 6–7, and then dried to obtain 88 g of a chromium complex with 2-hydroxy-3-naphthoic acid.

(3) Complex represented by formula (V) (Compound 5)

(3,5-ditertiarybutylsalicylic acid chromium complex)

A 250 g portion of 3,5-ditertiarybutylsalicylic acid is dissolved in 2250 g of methanol, to which solution 225 g of a 40% aqueous solution of $Cr_2(SO_4)_3$ is then added. To this mixture is added a 25% aqueous solution of caustic soda to adjust the pH to 4–5. 24 g of the caustic soda solution is required. This is refluxed for 3 hours at about 70° C. A very light green precipitate is produced during this time. The solution containing this precipitate is filtered while heating at about 50° C., to collect the precipitate. Next, the obtained cake is washed with 1% diluted sulfuric acid, and further washed with water until the pH reaches 6–7. This was dried to obtain the object reaction product. Thus is obtained 85 g of a chromium complex with 3,5-ditertiarybutylsalicylic acid.

(4) Imide compound represented by formula (VI)

(Compound 6)

29.4 parts of phthalimide and 13 parts of potassium hydroxide were dissolved in 300 parts of water, and the solution was heated at 80° C. It was then continuously stirred for 2 hours and subsequently cooled to room temperature. The water was removed, and the residue was dried under reduced pressure at 50°–60° C. to obtain 30 parts of a colorless powdery imide compound.

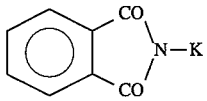

(Compound 6)

(5) Alkylphenol complex represented by formula (VII)

(Compound 7)

26.8 parts of 1,1-bis-(4-hydroxyphenyl)-cyclohexane and 8 parts of caustic soda were dissolved in 300 parts of water, and the solution was heated at 80° C. There was then slowly added thereto a solution of 12.1 parts of aluminum chloride in 100 parts of water. The solution was continuously stirred at 80° C. for 2 hours and subsequently cooled to room temperature and neutralized. The reaction product was filtered out and washed with water, and then dried under reduced pressure at 50°–60° C. to obtain 27 parts of a colorless powdery alkylphenol metal complex (compound 7).

(6) Zinc complex represented by formula (VIII)

(Compound 8)

(Synthesis of 2-hydroxy-3-naphthoic acid zinc complex)

A 42.2 g (0.22 mole) portion of 2-hydroxy-3-naphthoic acid was completely dissolved in 500 g of a 2.7% aqueous solution of caustic soda, and the solution was heated to about 70° C. Next, 35.5 g (0.13 mole) of zinc sulfate was dissolved in 100 g of water and added thereto dropwise over a period of 30 minutes. The mixture was kept at 70°–80° C. for 2 hours, the pH was adjusted to 7.0±0.5, and the reaction was allowed to go to completion. The mixture was filtered, washed and dried to obtain a light yellow fine powder of a zinc complex with 2-hydroxy-3-naphthoic acid (compound 8).

Preparation of photoconductors

Photoconductor (10)—Compound 2

One part of a butadiene derivative, one part of a polycarbonate and 0.02 part of compound 2 were dissolved in 17 parts of dichloromethane to prepare an application solution. A transparent drum with a charge generating layer was dip coated with this solution, and dried at 90° C. for one hour to prepare a charge carrier layer with a thickness of about 15 μm, and a photosensitive layer was formed thereon to obtain a photoconductor (10).

Photoconductor (11)—Application of compound 2

Compound 2 was applied at 0.01 part onto 1 part of a polyester resin (Kao) as the overcoat layer on the photoconductor (1), and the application was dried at 90° C. for one hour forming a layer with a thickness of about 1 μm, to obtain photoconductor (11).

Photoconductor (12)—Application of compound 2 (ethanol) p The photoconductor (1) was dip coated with a solution prepared by dissolving one part of compound 2 in 100 parts of ethanol, forming a film with a thickness of 100 Å to obtain photosensor (12).

Photoconductor (13)—Compound 2 (overcoat layer)

Photoconductor (1) was dip coated with TOSUPURAIPU (product of Toshiba Silicone) as an adhesive layer for the overcoat layer and dried at 90° C. for 30 minutes, and then dip coated with one part of the silicon-based coating agent TOSUGADO (product of Toshiba Silicone) and allowed to harden at 90° C. for one hour to form a layer with a thickness of about 1 μm. It was then dip coated with a solution prepared by dissolving one part of compound 2 in 100 parts of ethanol, forming a film with a thickness of 100 Å to obtain photosensor (13).

Photoconductor (14)

Compound 2 of photoconductor (10) was replaced with compound 3 to prepare photoconductor (14).

Photoconductor (15)

Compound 2 of photoconductor (11) was replaced with compound 3 to prepare photoconductor (15).

Photoconductor (16)

Compound 2 of photoconductor (12) was replaced with compound 3 to prepare photoconductor (16).

Photoconductor (17)

Compound 2 of photoconductor (13) was replaced with compound 3 to prepare photoconductor (17).

Photoconductor (18)

Compound 2 of photoconductor (10) was replaced with compound 4 to prepare photoconductor (18).

Photoconductor (19)

Compound 2 of photoconductor (11) was replaced with compound 4 to prepare photoconductor (19).

Photoconductor (20)

Compound 2 of photoconductor (12) was replaced with compound 4 to prepare photoconductor (20).

Photoconductor (21)

Compound 2 of photoconductor (13) was replaced with compound 4 to prepare photoconductor (21).

Photoconductor (22)

Compound 2 of photoconductor (10) was replaced with compound 5 to prepare photoconductor (22).

Photoconductor (23)

Compound 2 of photoconductor (11) was replaced with compound 5 to prepare photoconductor (23).

Photoconductor (24)

Compound 2 of photoconductor (12) was replaced with compound 5 to prepare photoconductor (24).

Photoconductor (25)

Compound 2 of photoconductor (13) was replaced with compound 5 to prepare photoconductor (25).

Photoconductor (26)

Compound 2 of photoconductor (10) was replaced with compound 6 to prepare photoconductor (26).

Photoconductor (27)

Compound 2 of photoconductor (11) was replaced with compound 6 to prepare photoconductor (27).

Photoconductor (28)

Compound 2 of photoconductor (12) was replaced with compound 6 to prepare photoconductor (28).

Photoconductor (29)

Compound 2 of photoconductor (13) was replaced with compound 6 to prepare photoconductor (29).

Photoconductor (30)

Compound 2 of photoconductor (10) was replaced with compound 7 to prepare photoconductor (30).

Photoconductor (31)

Compound 2 of photoconductor (11) was replaced with compound 7 to prepare photoconductor (31).

Photoconductor (32)

Compound 2 of photoconductor (12) was replaced with compound 7 to prepare photoconductor (32).

Photoconductor (33)

Compound 2 of photoconductor (13) was replaced with compound 7 to prepare photoconductor (33).

Photoconductor (34)

Compound 2 of photoconductor (11) was replaced with compound 8 to prepare photoconductor (34).

Photoconductor (35)

Compound 2 of photoconductor (12) was replaced with compound 8 to prepare photoconductor (35).

Photoconductor (36)

Compound 2 of photoconductor (12) was replaced with compound 8 to prepare photoconductor (36).

Photoconductor (37)

Compound 2 of photoconductor (13) was replaced with compound 8 to prepare photoconductor (37).

Preparation of toner and carrier

Same as in Example 1.

Imaging

The photoconductors and apparatuses .described above were used to form images for evaluation. The results are shown in Tables VII to IX.

TABLE VII

| Photo-conductor | Apparatus | Different photoconductors: Toner | Toner conc. (wt %) | $V_b$ (V) | $V_s$ (V) | Printing density | Fog |
|---|---|---|---|---|---|---|---|
| (1) | (1) | ① | 30 | −350 | −293 | o | x |
| (10) | (1) | ① | 30 | −350 | −365 | o | o |
| (11) | (1) | ① | 30 | −350 | −376 | o | o |
| (12) | (1) | ① | 30 | −350 | −373 | o | o |
| (13) | (1) | ① | 30 | −350 | −376 | o | o |
| (14) | (1) | ① | 30 | −350 | −375 | o | o |
| (15) | (1) | ① | 30 | −350 | −366 | o | o |
| (16) | (1) | ① | 30 | −350 | −372 | o | o |
| (17) | (1) | ① | 30 | −350 | −372 | o | o |
| (18) | (1) | ① | 30 | −350 | −383 | o | o |
| (19) | (1) | ① | 30 | −350 | −356 | o | o |
| (20) | (1) | ① | 30 | −350 | −366 | o | o |
| (21) | (1) | ① | 30 | −350 | −363 | o | o |
| (22) | (1) | ① | 30 | −350 | −376 | o | o |
| (23) | (1) | ① | 30 | −350 | −375 | o | o |
| (24) | (1) | ① | 30 | −350 | −386 | o | o |
| (25) | (1) | ① | 30 | −350 | −376 | o | o |
| (26) | (1) | ① | 30 | −350 | −362 | o | o |
| (27) | (1) | ① | 30 | −350 | −373 | o | o |
| (28) | (1) | ① | 30 | −350 | −366 | o | o |
| (29) | (1) | ① | 30 | −350 | −356 | o | o |
| (30) | (1) | ① | 30 | −350 | −362 | o | o |
| (31) | (1) | ① | 30 | −350 | −366 | o | o |
| (32) | (1) | ① | 30 | −350 | −372 | o | o |
| (33) | (1) | ① | 30 | −350 | −356 | o | o |
| (34) | (1) | ① | 30 | −350 | −366 | o | o |
| (35) | (1) | ① | 30 | −350 | −362 | o | o |
| (36) | (1) | ① | 30 | −350 | −371 | o | o |
| (37) | (1) | ① | 30 | −350 | −361 | o | o |

Evaluation was made with different photoconductors, and when the conventional photoconductor (1) was used, the surface potential ($V_s$) was low and fog was produced. With the other photoconductors, satisfactory printing density and fog characteristics were obtained.

The evaluation of the printing was made in the following manner.

1. A printing density of 1.3 or greater with OD was indicated as o. The printing density was measured using a Konica densitometer (PDA-65, Konica).

2. Fog of 0.02 or less was indicated as o, in terms of the change in density ΔOD due to fog on the photoconductor at normal temperature and humidity (25° C., 50% RH). Here, the change in printing density (ΔOD) for evaluation of the fog refers to the value obtained by taking a dust figure on tape (Scotch mending tape) from the photoconductor prior to transfer onto paper, measuring the density of the white paper sections, and subtracting the density of the tape.

TABLE VIII

| Photo-conductor | Apparatus | Non-magnetic color toner: Toner | Toner conc. (wt %) | $V_b$ (V) | $V_s$ (V) | Printing density | Fog |
|---|---|---|---|---|---|---|---|
| (10) | (2) | ② | 5 | −350 | −371 | o | o |
| (1) | (2) | ② | 5 | −350 | −325 | x | x |
| (1) | (3) | ② | 5 | −350 | −351 | o | o |

Note: The electrification enhancer used in apparatus (3) was compound (II).

Satisfactory properties are obtained with the photoconductor (10) even with non-magnetic color toner. Also, satisfactory properties are obtained even with photoconductor (1) if apparatus (3) is used.

TABLE IX

| Photo-conductor | Apparatus | Toner | Toner conc. (wt %) | $V_b$ (V) | $V_s$ (V) | Printing density | Fog |
|---|---|---|---|---|---|---|---|
| | | Differences between rear photorecording and Carlson process | | | | | |
| (1) | (4) | ② | 5 | −400 | −600 | ○ | ○ (conv. method) |
| (10) | (4) | ② | 5 | −400 | −322 | ○ | x |

When a photoconductor which exhibited satisfactory surface potential ($V_s$) with the rear photorecording method was used in the Carlson method (Corona charging), the surface potential ($V_s$) decreased and fog was produced, making it unusable.

Example 3 [Compounds (IX)–(X)]

Preparation of compounds (1) Chromium complex represented by formula (IX) (Compound 9)

20 parts of 4,6-dinitro-2-aminophenol was stirred together with 1 part of concentrated sulfuric acid and 40 parts of water, after which the mixture was cooled on ice to 0°–5° C., 0.7 part of nitrous acid was added, and the mixture was further stirred for 2 hours for diazotization. The diazotized product was poured into a mixed solution at 0°–5° C. containing 30 parts of water, 1 part of sodium hydroxide and 2.6 parts of 3-hydroxy-2-naphthoanilide for a coupling reaction, after which the monoazo compound represented by the following formula (vi) was isolated. A paste of this monoazo compound was dissolved in 15 parts of ethylene glycol, 0.5 part of sodium hydroxide and 1.7 part of sodium chromium salicylate was added thereto, and the mixture was stirred for 2 hours at 110°–120° C. for chromation and then cooled to 50° C., after which the Congo Red acidic product was filtered at room temperature for isolation and dried under reduced pressure at 50°–60° C. to obtain 4.9 parts of a black powdery chromium complex represented by the following formula (vii), thus preparing compound 9. The parts refer to parts by weight.

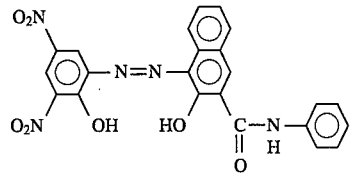

(vi)

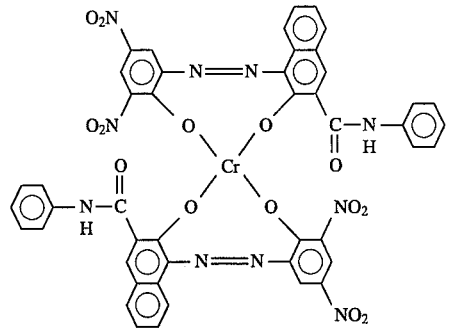

(vii)

(2) Metal complexes represented by formula (IX) (Compounds 10–16)

The monoazo compounds, metals and complexes shown in Table X were used to obtain the metal complexes of compounds 10 to 16 by the same method used to obtain compound 9.

TABLE X

Monoazo compound

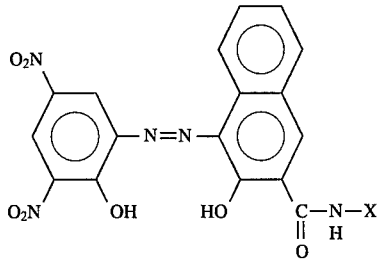

| Compound | Metal | Solvent for forming a complex salt |
|---|---|---|
| 10 X: 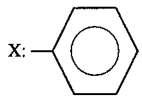 | Co | Water |

TABLE X-continued

| Compound | Monoazo compound | Metal | Solvent for forming a complex salt |
|---|---|---|---|
| 11 | 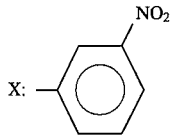 | Cr | Ethylene glycol Water |
| 12 | 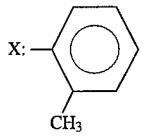 | Cr | Diethylene glycol |
| 13 | 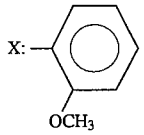 | Cr | Dimethylformamide |
| 14 | 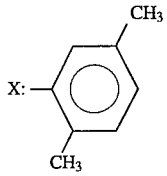 | Cr | Methyl cellosolve |
| 15 | 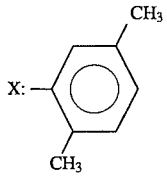 | Co | Formamide |
| 16 | 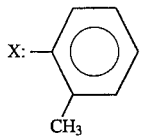 | Co | Dimethylsulfoxide |

(3) Chromium complex of compound (IX) (Compound 17)

1.5 part of 5-nitro-2-aminophenol was diazotized in the same manner as compound 9, and was coupled with 2.6 parts of 3-hydroxy-2-naphthoanilide, upon which the monoazo compound having the following formula (viii) was isolated. A paste of this monoazo compound was treated in the same manner as compound 9 to obtain 4.4 parts of a black powdery chromium complex represented by the following formula (ix) (compound 17).

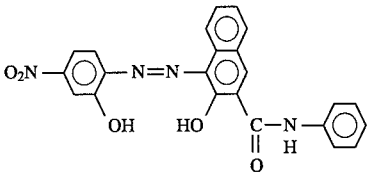

(viii)

-continued (ix)

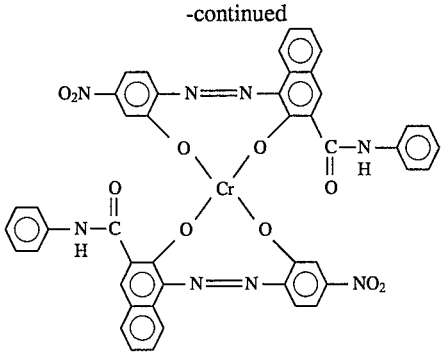

(4) Metal complexes of formula (IX)

(Compounds 18–24)

The monoazo compounds, metals and complexes shown in Table XI were used to obtain the metal complexes of compounds 18 to 24 by the same method used to obtain compound 9.

TABLE XI

| Compound | Monoazo compound | Metal | Solvent for forming a complex salt |
|---|---|---|---|
| 18 | 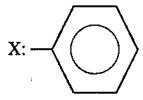 | Co | Water |
| 19 | 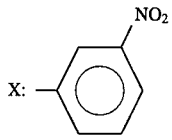 | Cr | Methyl cellosolve |
| 20 | 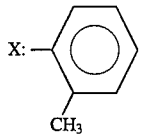 | Cr | Dimethylformamide |
| 21 | 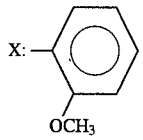 | Cr | Ethylene glycol |
| 22 | 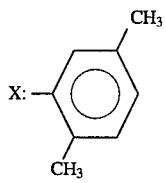 | Cr | Methyl cellosolve |

TABLE XI-continued

| Compound | Monoazo compound | Metal | Solvent for forming a complex salt |
|---|---|---|---|
| 23 | 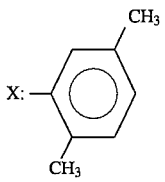 | Co | Dimethylformamide water |
| 24 | 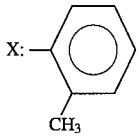 | Co | Diethylene glycol |

(5) Metal complex of formula (X) (Compound 25)

Ten parts of the pigment represented by the following formula (x) was dispersed in 75 parts of a 50% aqueous solution of ethanol, 1.5 parts of 36% hydrochloric acid was added while stirring, and after 5 hours of further stirring the mixture was placed in 100 parts of water and filtered. After washing with water, the residue was dried to obtain 9 parts of the metal complex compound 25 represented by the following formula (xi).

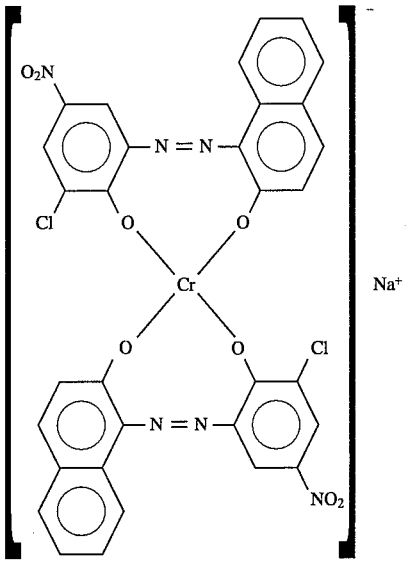

(x)

-continued

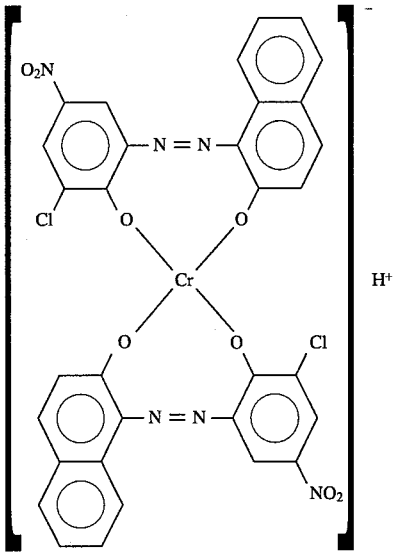

(xi)

Preparation of photoconductors

Photoconductor (38)—Compound 9

One part of a butadiene derivative, one part of a polycarbonate and 0.02 part of compound 9 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (38).

Photoconductor (39)—Application of compound 9

Photoconductor (1) was dip coated with TOSUPURAIPU (product of Toshiba Silicone) as an adhesive layer for the overcoat layer and dried at 90° C. for 30 minutes, and then dip coated with one part of the silicon-based coating agent TOSUGADO (product of Toshiba Silicone) and 0.01 part of compound 9 and allowed to harden at 90° C. for one hour, forming a layer with a thickness of about 1 μm to obtain photoconductor (39).

Photoconductor (40)—Application of compound 9 (ethanol)

The photoconductor (1) was dip coated with a solution prepared by dissolving one part of compound 9 in 100 parts of ethanol, forming a film with a thickness of 100 Å to obtain photoconductor (40).

Photoconductor (41)—Compound 9 (overcoat layer)

Photoconductor (1) was dip coated with TOSUPURAIPU (product of Toshiba Silicone) as an adhesive layer for the overcoat layer and dried at 90° C. for 30 minutes, and then dip coated with one part of the silicon-based coating agent TOSUGADO (product of Toshiba Silicone) and allowed to harden at 90° C. for one hour to form a layer with a thickness of about 1 μm. It was then dip coated with a solution prepared by dissolving one part of compound 9 in 100 parts of ethanol, forming a film with a thickness of 100 Å to obtain photoconductor (41).

Photoconductor (42)—Compound 10

One part of a butadiene derivative, one part of a polycarbonate and 0.02 part of compound 10 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (42).

Photoconductor (43)—Compound 11

One part of a butadiene derivative, one part of a polycarbonate and 0.02 part of compound 11 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (43).

Photoconductor (44)—Compound 12

One part of a butadiene derivative, one part of a polycarbonate and 0.02 part of compound 12 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (44).

Photoconductor (45)—Compound 13

One part of a butadiene derivative, one part of a polycarbonate and 0.02 part of compound 13 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (45).

Photoconductor (46)—Compound 14

One part of a butadiene derivative, one part of a polycarbonate and 0.02 part of compound 14 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (46).

Photoconductor (47)—Compound 15

One part of a butadiene derivative, one part of a polycarbonate and 0.02 part of compound 15 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (47).

Photoconductor (48)—Compound 16

One part of a butadiene derivative, one part of a polycarbonate and 0.02 part of compound 16 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (48).

Photoconductor (49)—Compound 17

One part of a butadiene derivative, one part of a polycarbonate and 0.02 part of compound 17 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (49).

Photoconductor (50)—Compound 18

One part of a butadiene derivative, one part of a polycarbonate and 0.02 part of compound 18 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (50).

Photoconductor (51)—Compound 19

One part of a butadiene derivative, one part of a polycarbonate and 0.02 part of compound 19 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (51).

Photoconductor (52)—Compound 20

One part of a butadiene derivative, one part of a polycarbonate and 0.02 part of compound 20 were dissolved in 17 parts of dichloromethane to prepare an application solution. A transparent drum ① with a charge generating layer was dip coated with this solution, and dried at 90° C. one hour to prepare a charge carrier layer with a thickness of about 15 μm, and a photosensitive layer was formed thereon to obtain a photoconductor (52).

Photoconductor (53)—Compound 21

One part of a butadiene derivative, one part of a polycarbonate and 0.02 part of compound 21 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (53).

Photoconductor (54)—Compound 22

One part of a butadiene derivative, one part of a polycarbonate and 0.02 part of compound 22 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (54).

Photoconductor (55)—Compound 23

One part of a butadiene derivative, one part of a polycarbonate and 0.02 part of compound 23 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (55).

Photoconductor (56)—Compound 24

One part of a butadiene derivative, one part of a polycarbonate and 0.02 part of compound 24 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (56).

Photoconductor (57)—Compound 25

One part of a butadiene derivative, one part of a polycarbonate and 0.02 part of compound 25 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (57).

Preparation of toner and carrier

Same as in the previous Examples.

Imaging

The photoconductors and apparatuses described above were used to form images for evaluation. The results are shown in Tables XII to XIII.

TABLE XII

| Photo-conductor | Apparatus | Different photoconductors: Toner | Toner conc. (wt %) | $V_b$ (V) | $V_s$ (V) | Printing density | Fog |
|---|---|---|---|---|---|---|---|
| (1) | 1 | ① | 30 | −350 | −293 | o | x |
| (38) | 1 | ① | 30 | −350 | −366 | o | o |
| (39) | 1 | ① | 30 | −350 | −356 | o | |
| (40) | 1 | ① | 30 | −350 | −343 | o | o |
| (41) | 1 | ① | 30 | −350 | −376 | o | o |
| (42) | 1 | ① | 30 | −350 | −365 | o | o |
| (43) | 1 | ① | 30 | −350 | −356 | o | o |
| (44) | 1 | ① | 30 | −350 | −376 | o | o |
| (45) | 1 | ① | 30 | −350 | −362 | o | o |
| (46) | 1 | ① | 30 | −350 | −356 | o | o |
| (47) | 1 | ① | 30 | −350 | −391 | o | o |
| (48) | 1 | ① | 30 | −350 | −386 | o | o |
| (49) | 1 | ① | 30 | −350 | −346 | o | o |
| (50) | 1 | ① | 30 | −350 | −346 | o | o |
| (51) | 1 | ① | 30 | −350 | −352 | o | o |
| (52) | 1 | ① | 30 | −350 | −357 | o | o |
| (53) | 1 | ① | 30 | −350 | −352 | o | o |
| (54) | 1 | ① | 30 | −350 | −347 | o | o |
| (55) | 1 | ① | 30 | −350 | −357 | o | o |
| (56) | 1 | ① | 30 | −350 | −347 | o | o |
| (57) | 1 | ① | 30 | −350 | −353 | o | o |

Evaluation was made with different photoconductors, and when the conventional photoconductor (1) was used, the surface potential ($V_s$) was low and fog was produced. With the other photoconductors, satisfactory printing density and fog characteristics were obtained.

The evaluation of the printing was made in the following manner.

1. A printing density of 1.3 or greater with OD was indicated as o. The printing density was measured using a Konica densitometer (PDA-65, Konica).

2. Fog of 0.02 or less was indicated as o, in terms of the change in density ΔOD due to fog on the photoconductor at normal temperature and humidity (25° C., 50% RH). Here, the change in printing density (ΔOD) for evaluation of the fog refers to the value obtained by taking a dust figure on tape (Scotch mending tape) from the photoconductor prior to transfer onto paper, measuring the density of the white paper sections, and subtracting the density of the tape.

TABLE XIII

| Photo-conductor | Apparatus | Non-magnetic color toner: Toner | Toner conc. (wt %) | $V_b$ (V) | $V_s$ (V) | Printing density | Fog |
|---|---|---|---|---|---|---|---|
| (1) | 2 | ② | 5 | −350 | −325 | x | x |
| (38) | 2 | ② | 5 | −350 | −402 | o | o |
| (1) | 3 (a) | ② | 5 | −350 | −490 | o | o |
| (1) | 3 (b) | ② | 5 | −350 | −491 | o | o |
| (1) | 4 | ② | 5 | −350 | −410 | o | o |
| (4) | 2 | ② | 5 | −350 | −430 | o | o |

Satisfactory properties are obtained with the photoconductors (38) and (40) even with non-magnetic color toner. Also, satisfactory properties are obtained even with the conventional photoconductor (1) if the apparatuses (3) or (4) are used. Compound 9 was applied with apparatus 3(*a*), and compound 25 was applied with apparatus 3(*b*).

Example 4: (Ferroelectric material)

Preparation of photoconductors

Photoconductor (58)

One part of a butadiene derivative, one part of a polycarbonate and 0.02 part of compound No. 1 in Table I were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (58).

Photoconductor (59)

Compound No. 1 in Table I of photoconductor (58) was replaced with compound No. 10 to prepare photoconductor (59).

Photoconductor (60)

Compound No. 1 in Table I of photoconductor (58) was replaced with compound No. 20 to prepare photoconductor (60).

Photoconductor (61)

Compound No. 1 in Table I of photoconductor (58) was replaced with compound No. 31 to prepare photoconductor (61).

Preparation of toner and carrier

Same as in Example 1.

Imaging

The results of evaluation of images formed using the photoconductors and apparatuses described above are shown in Tables VII to IX.

TABLE XIV

| Photo-conductor | Apparatus | Different photoconductors: Toner | Toner conc. (wt %) | $V_b$ (V) | $V_s$ (V) | Printing density | Fog |
|---|---|---|---|---|---|---|---|
| (1) | (1) | ① | 30 | −350 | −293 | o | x |
| (58) | (1) | ① | 30 | −350 | −358 | o | o |
| (59) | (1) | ① | 30 | −350 | −352 | o | o |
| (60) | (1) | ① | 30 | −350 | −356 | o | o |
| (61) | (1) | ① | 30 | −350 | −354 | o | o |

Evaluation was made with different photoconductors, and when the conventional photoconductor (1) was used, the surface potential ($V_s$) was low and fog was produced. With the other photoconductors, satisfactory printing density and fog characteristics were obtained.

The evaluation of the printing was made in the following manner.

1. A printing density of 1.3 or greater with OD was indicated as o. The printing density was measured using a Konica densitometer (PDA-65, Konica).

2. Fog of 0.05 or less was indicated as o, in terms of the change in density ΔOD due to fog on the photoconductor at normal temperature and humidity (25° C., 50% RH). Here, the change in printing density (ΔOD) for evaluation of the fog refers to the value obtained by taking a dust figure on tape (Scotch mending tape) from the photoconductor prior to transfer onto paper, measuring the density of the white paper sections, and subtracting the density of the tape.

TABLE XV

| Photo-conductor | Apparatus | Non-magnetic color toner: Toner | Toner conc. (wt %) | $V_b$ (V) | $V_s$ (V) | Printing density | Fog |
|---|---|---|---|---|---|---|---|
| (58) | (2) | ② | 5 | −350 | −352 | o | o |
| (1) | (3) | ② | 5 | −350 | −351 | o | o |

Note:
The electrification enhancer used in apparatus (3) was compound No. 1 in Table I.

Satisfactory properties are obtained with the photoconductor (10) even with non-magnetic color toner. Also, satisfactory properties are obtained even with the conventional photoconductor (1) if apparatus (3) is used.

Example 5: (Ferroelectric liquid crystal material)

Preparation of photoconductors

Photoconductor (62)—liquid crystal material CTL

One part of a butadiene derivative, one part of a polycarbonate and 0.02 part of compound 26 shown below were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (62).

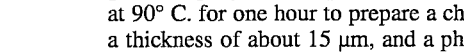

$$C_2H_5O—C_6H_4—N{=}CH—C_6H_4—COOCH_2C^*H(CH_3)C_2H_5$$

(Compound 9)

Photoconductor (63)—Application of liquid crystal material

Photoconductor (1) was dip coated with TOSUPURAIPU (product of Toshiba Silicone) as an adhesive layer for the insulator layer and dried at 90° C. for 30 minutes, and then dip coated with one part of the silicon-based coating agent TOSUGADO (product of Toshiba Silicone) and 0.01 part of compound 26 and allowed to harden at 90° C. for one hour, forming a layer with a thickness of about 1 μm to obtain photoconductor (63).

Compound 26 used for photoconductor (62) was replaced with compound No. 8 in Table II to prepare photoconductor (65).

Photoconductor (66)

Compound 26 used for photoconductor (62) was replaced with compound No. 17 in Table II to prepare photoconductor (66).

Photoconductor (67)

Compound 26 used for photoconductor (62) was replaced with compound No. 22 in Table II to prepare photoconductor (67).

Photoconductor (68)

Compound 26 used for photoconductor (62) was replaced with compound No. 37 in Table II to prepare photoconductor (68).

Photoconductor (69)

Compound 26 used for photoconductor (62) was replaced with compound No. 42 in Table II to prepare photoconductor (69).

Photoconductor (70)

Compound 26 used for photoconductor (62) was replaced with compound No. 17 in Table II to prepare photoconductor (70).

Preparation of toner and carrier

Same as in Example 1.

Imaging

The results of evaluation of images formed using the photoconductors and apparatuses described above are shown in Tables XVI to XVIII.

TABLE XVI

| Photo-conductor | Apparatus | Different photoconductors: Toner | Toner conc. (wt %) | $V_b$ (V) | $V_s$ (V) | Printing density | Fog |
|---|---|---|---|---|---|---|---|
| (1) | (1) | ① | 30 | −350 | −293 | o | x |
| (62) | (1) | ① | 30 | −350 | −352 | o | o |
| (63) | (1) | ① | 30 | −350 | −356 | o | o |
| (64) | (1) | ① | 30 | −350 | −353 | o | o |
| (65) | (1) | ① | 30 | −350 | −356 | o | o |
| (66) | (1) | ① | 30 | −350 | −355 | o | o |
| (67) | (1) | ① | 30 | −350 | −356 | o | o |
| (68) | (1) | ① | 30 | −350 | −356 | o | o |
| (69) | (1) | ① | 30 | −350 | −352 | o | o |
| (70) | (1) | ① | 30 | −350 | −356 | o | o |

Photoconductor (64)—Application of liquid crystal material (ethanol)

The photoconductor (1) was dip coated with a solution prepared by dissolving one part of compound 26 in 100 parts of ethanol, forming a film with a thickness of 100 Å to obtain photoconductor (64).

Photoconductor (65)

Evaluation was made with different photoconductors, and when the conventional photoconductor (1) was used, the surface potential ($V_s$) was low and fog was produced. With the other photoconductors, satisfactory printing density and fog characteristics were obtained.

The evaluation of the printing was made in the following manner.

1. A printing density of 1.3 or greater with OD was indicated as o. The printing density was measured using a Konica densitometer (PDA-65, Konica).

2. Fog of 0.05 or less was indicated as o, in terms of the change in density ΔOD due to fog on the photoconductor at normal temperature and humidity (25° C., 50% RH). Here, the change in printing density (ΔOD) for evaluation of the fog refers to the value obtained by taking a dust figure on tape (Scotch mending tape) from the photoconductor prior to transfer onto paper, measuring the density of the white paper sections, and subtracting the density of the tape.

TABLE XVII

| | | Non-magnetic color toner | | | | | |
|---|---|---|---|---|---|---|---|
| Photo-conductor | Apparatus | Toner | Toner conc. (wt %) | $V_b$ (V) | $V_s$ (V) | Printing density | Fog |
| (62) | (2) | ② | 5 | −350 | −353 | o | o |
| (1) | (2) | ② | 5 | −350 | −325 | x | x |
| (1) | (3) | ② | 5 | −350 | −351 | o | o |

Note:
The electrification enhancer used in apparatus (3) was compound 9.

Satisfactory properties are obtained with the photoconductor (2) even with non-magnetic color toner. Also, satisfactory properties are obtained even with the conventional photoconductor (1) if apparatus (3) is used.

TABLE XVIII

| | | Differences between rear photorecording and Carlson process | | | | | |
|---|---|---|---|---|---|---|---|
| Photo-conductor | Apparatus | Toner | Toner conc. (wt %) | $V_b$ (V) | $V_s$ (V) | Printing density | Fog |
| (1) | (4) | ② | 5 | −400 | −500 | o | o |
| (62) | (4) | ② | 5 | −400 | −388 | o | x |

When a photoconductor which exhibited satisfactory surface potential ($V_s$) with the rear photorecording method is used in the Carlson method (Corona charging), the surface potential ($V_s$) decreased and fog are produced, making it unusable.

Example 6: [Fluorine resin with equivalent work function of 4.10 or greater]

Preparation of photoconductors

Photoconductor (71)

One part of a butadiene derivative, one part of a polycarbonate and 0.02 part of 0.2 um Teflon particles were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (71).

Photoconductor (72)

The 0.2 μm Teflon (polytetrafluoroethylene) particles were applied at 0.01 part onto 1 part of a polyester resin (Kao) as the overcoat layer on the photosensor (1), and the application was dried at 90° C. for one hour forming a layer with a thickness of about 1 μm, to obtain photoconductor (72).

Photoconductor (73)

The photoconductor (1) was dip coated with a solution prepared by dissolving one part of 0.2 μm Teflon particles in 100 parts of ethanol, forming a film with a thickness of 100 Å to obtain photoconductor (73).

Photoconductor (74)

Photoconductor (1) was dip coated with TOSUPURAIPU (product of Toshiba Silicone) as an adhesive layer for the overcoat layer and dried at 90° C. for 30 minutes, and then dip coated with one part of the silicon-based coating agent TOSUGADO (product of Toshiba Silicone) and allowed to harden at 90° C. for one hour to form a layer with a thickness of about 1 μm. It was then dip coated with a solution prepared by dissolving one part of 0.2 μm Teflon particles in 100 parts of ethanol, forming a film with a thickness of 100 Å to obtain photoconductor (74).

Photoconductor (75)

Publicly known emulsion polymerization was conducted using 60 parts of $CH_2{=}CHCOOCH_2CH_2{-}C_8F_{17}$, 10 parts of styrene and 30 parts of butyl acrylate, to obtain 0.2 μm particles 1.

Next, one part of a butadiene derivative, one part of a polycarbonate and 0.02 part of the particles 1 were dissolved in 17 parts of dichloromethane to prepare an application solution. A transparent drum ① with a charge generating layer was dip coated with this solution, and dried at 90° C. for one hour to prepare a charge carrier layer with a thickness of about 15 μm, and a photosensitive layer was formed thereon to obtain a photoconductor (75).

Preparation of toner and carrier

Same as in Example 1.

Imaging

The results of evaluation of images formed using the photoconductors and apparatuses described above are shown in Tables XIX to XX.

TABLE XIX

| Photo-conductor | Apparatus | Different photoconductors Toner | Toner conc. (wt %) | $V_b$ (V) | $V_s$ (V) | Printing density | Fog |
|---|---|---|---|---|---|---|---|
| (1) | (1) | ① | 30 | −350 | −293 | o | x |
| (71) | (1) | ① | 30 | −350 | −368 | o | o |
| (72) | (1) | ① | 30 | −350 | −358 | o | o |
| (73) | (1) | ① | 30 | −350 | −346 | o | o |
| (74) | (1) | ① | 30 | −350 | −374 | o | o |
| (75) | (1) | ① | 30 | −350 | −362 | o | o |

Evaluation was made with different photoconductors, and when the conventional photoconductor (1) was used, the surface potential ($V_s$) was low and fog was produced. With the other photoconductors, satisfactory printing density and fog characteristics were obtained.

The evaluation of the printing was made in the following manner.

1. A printing density of 1.3 or greater with OD was indicated as o. The printing density was measured using a Konica densitometer (PDA-65, Konica).

2. Fog of 0.02 or less was indicated as o, in terms of the change in density ΔOD due to fog on the photoconductor at normal temperature and humidity (25° C., 50% RH). Here, the change in printing density (ΔOD) for evaluation of the fog refers to the value obtained by taking a dust figure on tape (Scotch mending tape) from the photoconductor prior to transfer onto paper, measuring the density of the white paper sections, and subtracting the density of the tape.

TABLE XX

| Photo-conductor | Apparatus | Non-Magnetic color toner Toner | Toner conc. (wt %) | $V_b$ (V) | $V_s$ (V) | Printing density | Fog |
|---|---|---|---|---|---|---|---|
| (71) | (2) | ② | 5 | −350 | −372 | o | o |
| (75) | (2) | ② | 5 | −350 | −371 | o | o |
| (1) | (2) | ② | 5 | −350 | −315 | x | x |
| (1) | (2) | ② | 5 | −350 | −351 | o | o |

Note:
The electrification enhancer used in apparature (3) was Teflon particles.

Satisfactory properties are obtained with the photoconductors (71) and (75) even with non-magnetic color toner. Also, satisfactory properties are obtained even with the conventional photoconductor (1) if apparatus (3) is used.

Example 7 [Compounds of formulas (I)–(VIII)]

Preparation of photoconductors

Photoconductor (101)

The support used for the photoconductor was an aluminum cylinder (ϕ40 mm, A40S-$H_{14}$, product of Kobe Seitetsu, K.K.). The support was dip coated with a solution prepared by dissolving one part of cyanoethylated pullulan in 10 parts (parts by weight) of acetone, and then dried at 100° C. for one hour to obtain a 1 μm thick intermediate layer. A mixture containing one part of α-oxothitalphthalocyanine, one part of polyester and 20 parts of 1,1,2-trichloroethane dispersed and mixed for 24 hours using a hard glass bowl and a hard glass pot was then applied onto the above-mentioned intermediate layer and dried at 100° C. for one hour to form a charge generating layer with a thickness of about 0.3 μm (this is referred to as the non-transparent drum ② with a charge generating layer). Next, one part of a butadiene derivative, one part of a polycarbonate and the ammonium fluoride compound (compound 1) as the electrifying enhancer were dissolved in 17 parts of dichloromethane to prepare an application solution. The above-mentioned charge generating layer was dip coated with this solution, and dried at 90° C. for one hour to prepare a charge carrier layer with a thickness of about 15 μm, and a photosensitive layer was formed thereon to obtain a photoconductor (101).

Photoconductor (102)

Indium tin oxide was vapor deposited to a film thickness of 100 Å onto a glass cylinder (ϕ30 mm, 7740 product of Corning) to make a transparent conductive support. This transparent conductive support has an electrical conductivity in terms of surface resistance of $10^2$ Ω/□, and a transparency in terms of the total light transmittance of 90% or greater. A photoconductor (102) was prepared in exactly the same manner as the photoconductor (101), except that the support for the photoconductor was a transparent conductive support.

Photoconductor (103)

The same type of photoconductor support was used as for the photoconductor (101). The support was then dip coated with a solution prepared by dissolving one part of cyanoethylated pullulan in 10 parts (by weight) of acetone, and subsequently dried at 100° C. for one hour to obtain a 1 μm thick intermediate layer. A mixture containing one part of α-oxothitalphthalocyanine, one part of a butadiene derivative, one part of a polycarbonate, 0.03 parts of ammonium fluoride (compound 1) as the electrifying enhancer and 20 parts of 1,1,2-trichloroethane dispersed and mixed for 24 hours using a hard glass bowl and a hard glass pot was then applied onto the above-mentioned intermediate layer and dried at 100° C. for one hour, thus forming a photosensitive layer with a thickness of about 15 μm to obtain a photoconductor (103).

Photoconductor (104)

A photoconductor (104) was prepared in exactly the same manner as the photosensor (103), except that the support was the transparent conductive support used for photoconductor (102).

Photoconductor (105)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was dip coated with TOSUPURAIPU (product of Toshiba Silicone) as an adhesive layer for the insulator layer and dried at 90° C. for 30 minutes, and then dip coated with one part of the silicon-based coating agent TOSUGADO (product of Toshiba Silicone), after which it was dip coated with 0.01 part of ammonium fluoride (compound 1) as the electrification enhancer and allowed to harden at 90° C. for 1 hour, thus forming an insulator layer about 1 μm in thickness to obtain photoconductor (105).

Photoconductor (106)

A photoconductor (106) was prepared in exactly the same manner as the photoconductor (105), except that the support was the transparent conductive support used for photoconductor (102).

Photoconductor (107)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was dip coated with a solution prepared by dissolving 1 part of ammonium fluoride (compound 1) as the electrification enhancer in 100 parts of ethanol, thus forming a film with a thickness of 100 Å to obtain photoconductor (107).

Photoconductor (108)

A photoconductor (108) was prepared in exactly the same manner as the photoconductor (107), except that the support was the transparent conductive support used for photoconductor (102).

Photoconductor (109)

One part of a butadiene derivative and one part of a polycarbonate were dissolved in 17 parts of dichloromethane to prepare an application solution. The above-mentioned charge generating layer was dip coated with this solution, and dried at 90° C. for one hour to prepare a charge carrier layer with a thickness of about 15 μm, thus forming the photosensitive layer. This photosensitive layer was dip coated with TOSUPURAIPU (product of Toshiba Silicone) as an adhesive layer for the insulator layer and dried at 90° C. for 30 minutes, and then dip coated with one part of the silicon-based coating agent TOSUGADO (product of Toshiba Silicone), after which it was dip coated with 0.01 part of ammonium fluoride (compound 1) as the electrification enhancer, and allowed to harden at 90° C. for 1 hour to form an insulator layer with a thickness of about 1 μm. This insulator layer was then dip coated with a solution prepared by dissolving 1 part of ammonium fluoride (compound 1) in 100 parts of ethanol, thus forming a film with a thickness of 100 Å to obtain photoconductor (109).

Photoconductor (110)

A photoconductor (110) was prepared in exactly the same manner as the photoconductor (109), except that the support was the transparent conductive support used for photoconductor (102).

Photoconductor (111)

A photoconductor (111) was prepared in exactly the same manner as the photoconductor (101), except that the electrification enhancer was the imide compound (compound 6) used in Example 2.

Photoconductor (112)

A photoconductor (112) was prepared in exactly the same manner as the photoconductor (111), except that the support was the transparent conductive support used for photoconductor (102).

Photoconductor (113)

A photoconductor (113) was prepared in exactly the same manner as the photoconductor (101), except that the electrification enhancer was the 3,5-ditertiarybutylsalicylic acid chromium complex (compound 5) used in Example 2.

Photoconductor (114)

A photoconductor (114) was prepared in exactly the same manner as the photoconductor (113), except that the support was the transparent conductive support used for photoconductor (102).

Photoconductor (115)

A photoconductor (115) was prepared in exactly the same manner as the photoconductor (101), except that the electrification enhancer was the 2-hydroxy-3-naphthoic acid chromium complex (compound 4) used in Example 2.

Photoconductor (116)

A photoconductor (116) was prepared in exactly the same manner as the photoconductor (115), except that the support was the transparent conductive support used for photoconductor (102).

Photoconductor (117)

A photoconductor (117) was prepared in exactly the same manner as the photoconductor (101), except that the electrification enhancer was compound 2 in Example 2.

Photoconductor (118)

A photoconductor (118) was prepared in exactly the same manner as the photoconductor (117), except that the support was the transparent conductive support used for photoconductor (102).

Photoconductor (119)

A photoconductor (119) was prepared in exactly the same manner as the photoconductor (101), except that the electrification enhancer was compound 3 in Example 2.

Photoconductor (120)

A photoconductor (120) was prepared in exactly the same manner as the photoconductor (119), except that the support was the transparent conductive support used for photoconductor (102).

Photoconductor (121)

A photoconductor (121) was prepared in exactly the same manner as the photoconductor (120), except that the electrification enhancer was the 2-hydroxy-3-naphthoic acid zinc complex (compound 8) used in Example 2.

Photoconductor (122)

A photoconductor (122) was prepared in exactly the same manner as the photoconductor (121), except that the support was the transparent conductive support used for photoconductor (102).

Photoconductor (123)

A photoconductor (123) was prepared in exactly the same manner as the photoconductor (101), except that the electrification enhancer was the alkylphenol metal complex (compound 7) used in Example 2.

Photoconductor (124)

A photoconductor (124) was prepared in exactly the same manner as the photoconductor (123), except that the support was the transparent conductive support used for photoconductor (102).

Photoconductor (125)—Comparison photoconductor (1)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer to obtain photoconductor (125) as a comparison photoconductor 1.

Photoconductor (126)—Comparison photoconductor (2)

Photoconductor (126) as a comparison photoconductor (2) was prepared in exactly the same manner as the photoconductor (125), except that the support was the transparent conductive support used for photoconductor (102).

Photoconductor (127)—Comparison photoconductor (3)

The same type of photoconductor support was used as in Example 1. The support was then dip coated with a solution prepared by dissolving one part of cyanoethylated pullulan in 10 parts (by weight) of acetone, and subsequently dried at 100° C. for one hour to obtain a 1 μm thick intermediate layer. A mixture containing one part of α-oxothitalphthalocyanine, one part of a butadiene derivative, one part of a polycarbonate and 20 parts of 1,1,2-trichloroethane dispersed and mixed for 24 hours using a hard glass bowl and a hard glass pot was then applied onto the above-mentioned intermediate layer and dried at 100° C. for one hour, thus forming a photosensitive layer with a thickness of about 15 μm to obtain photoconductor (127) as a comparison photoconductor 3.

Photoconductor (128)—Comparison photoconductor (4)

Photoconductor (128) as a comparison photoconductor (4) was prepared in exactly the same manner as the photoconductor (127), except that the support was the transparent conductive support used for photoconductor (102).

Photoconductor (129)—Comparison photoconductor (5)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was further dip coated with TOSUPURAIPU (product of Toshiba Silicone) as an adhesive layer for the insulator layer and dried at 90° C. for 30 minutes, and then dip coated with one part of the silicon-based coating agent TOSUGADO (product of Toshiba Silicone) and allowed to harden at 90° C. for 1 hour, thus forming an insulator layer with a thickness of about 1 μm to obtain the photoconductor of Example 5.

Photoconductor (130)—Comparison photoconductor (6)

Photoconductor (130) as a comparison photoconductor (6) was prepared in exactly the same manner as the photoconductor (129), except that the support was the transparent conductive support used for photoconductor (102).

Printing test

Printing test (1)

Figure 12:
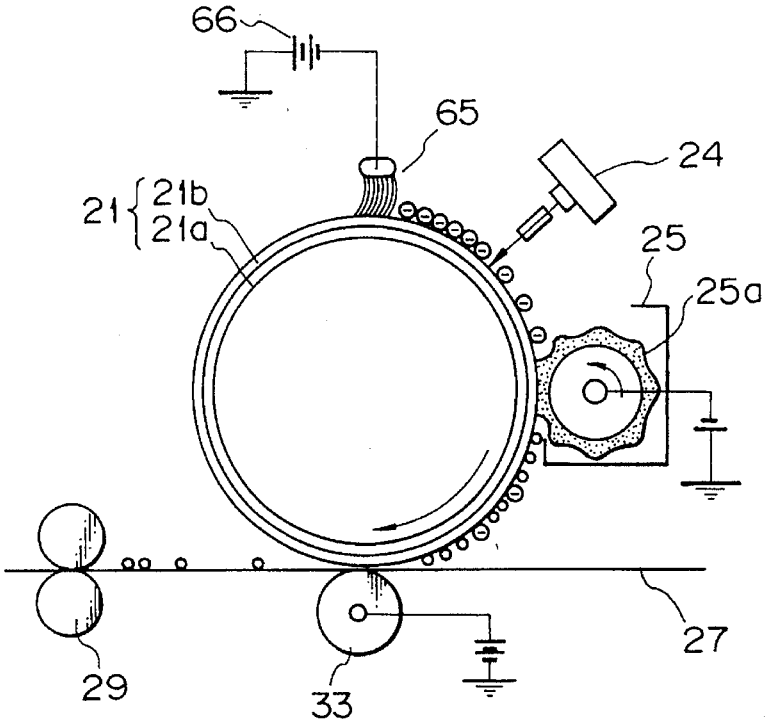
FIG. 12 shows a brush charging-type imaging apparatus.

An F6677C (product of Fujitsu) was used as the printing tester. FIG. 12 is a process diagram for the printing tester. The charging was carried out by brush charging. Brush charging involves electrification of the photoconductor surface by applying a voltage to a charging brush 65, for a printing test 1. The printing conditions were as follows.

Developing agent: Developing agent containing the above-mentioned carrier and emulsion polymerization toner (toner concentration: 10 wt %)

Printing speed: 4 ppm

Charging bias: −600 V

Developing bias: −500 V

Printing test (2)

Figure 13:
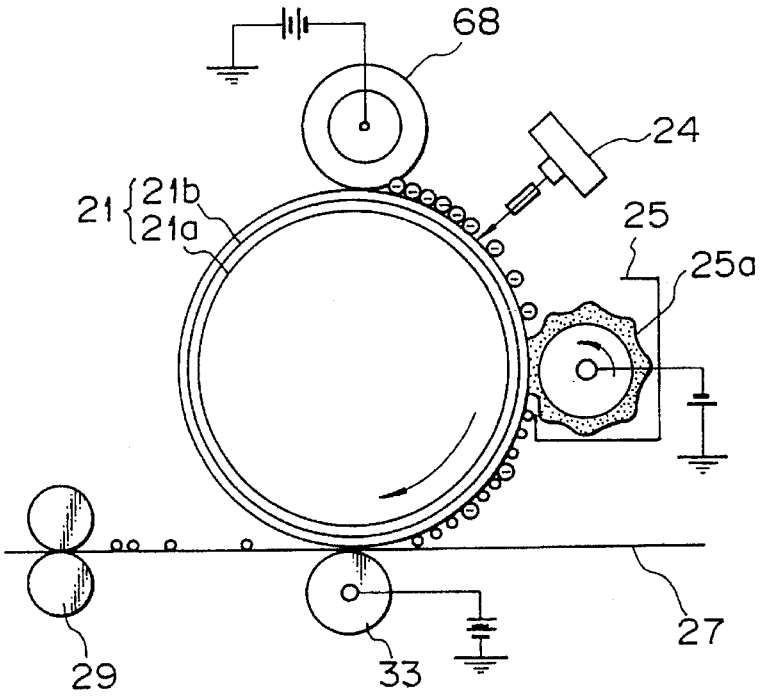
FIG. 13 shows a roller charging-type imaging apparatus.

Printing test (2) was conducted in exactly the same manner as printing test (1), except that a roller charging printing tester (roller: urethane material) was used for the charging step. FIG. 13 is a process diagram for the printing tester. A voltage is applied to the roller 68 to charge the photosensor surface 21.

Printing test (3)

Figure 14:
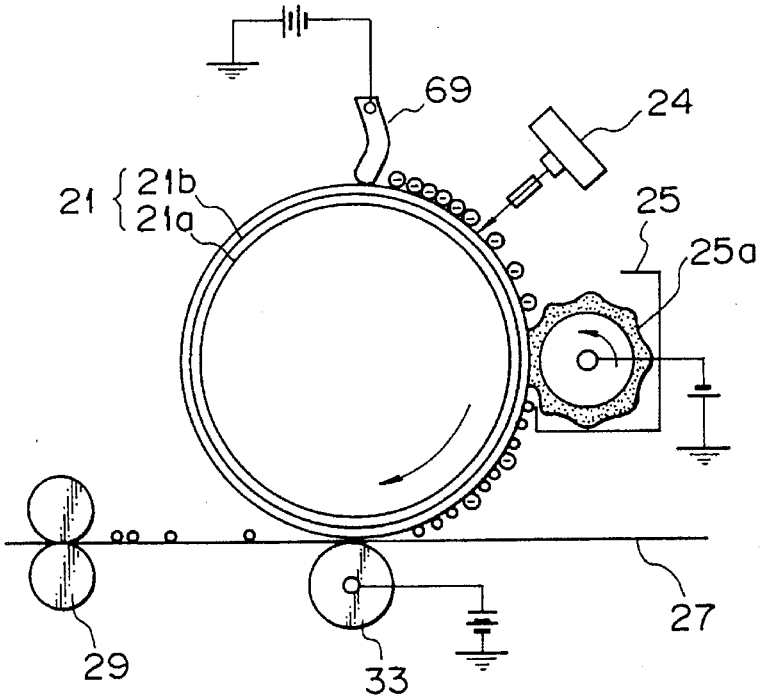
FIG. 14 shows a blade charging-type imaging apparatus.

Printing test (3) was conducted in exactly the same manner as printing test (1), except that blade charging (blade: urethane material) was used for the charging step. FIG. 14 is a process diagram for the printing tester. A charging blade 69 is used.

Printing test (4)

Figure 6:
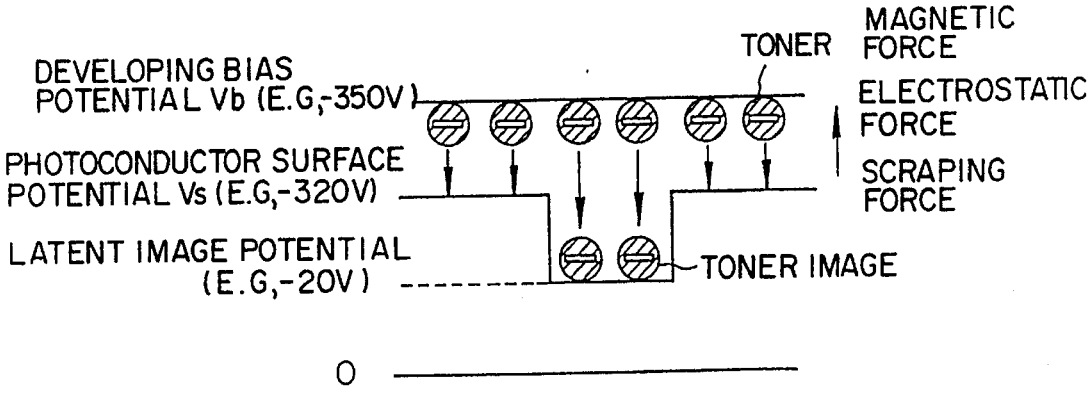
FIG. 6 shows the relationship of the potentials in imaging by rear photorecording.
Figure 7:
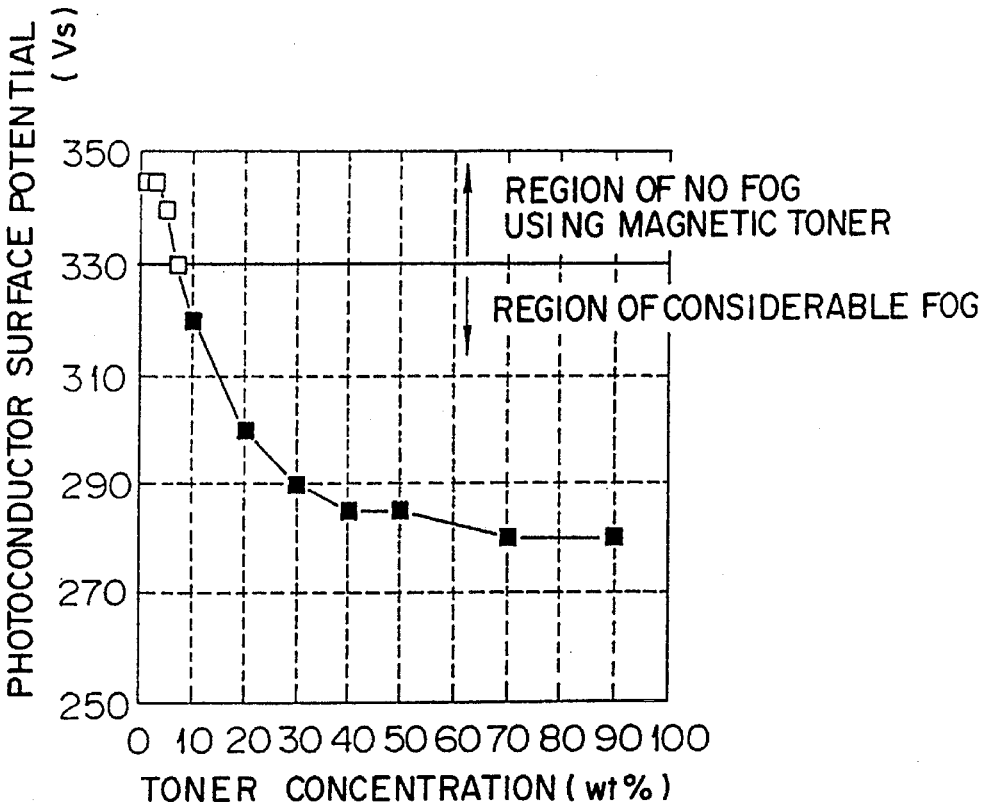
FIG. 7 shows the relationship between toner concentration and photoconductor surface potential for the rear photorecording process.
Figure 8:
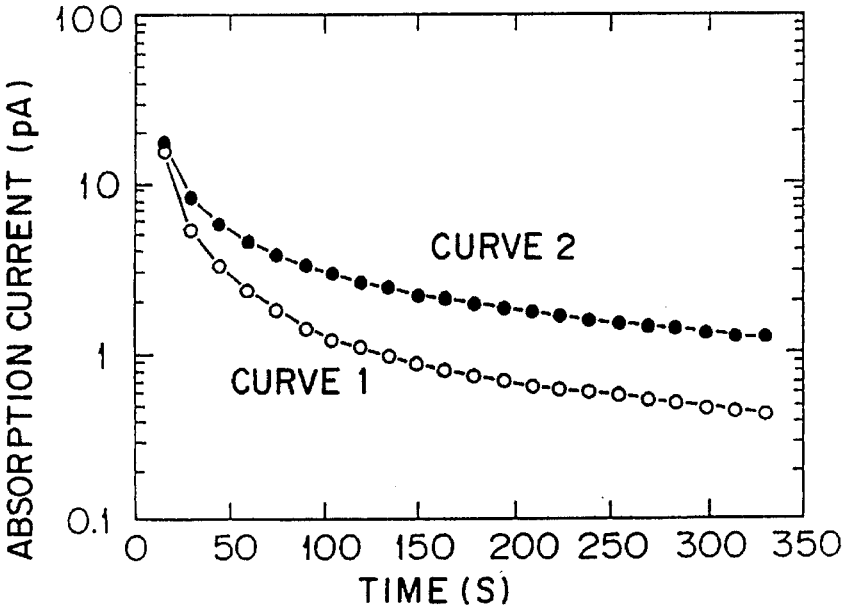
FIG. 8 shows the difference in the phenomenon of increase in the absorption current by an electric double layer, with the presence and absence of an electrification enhancer on the photoconductor surface.

Printing test (4) was conducted using a printing tester based on the rear photo process. FIG. 4 is a process diagram for the printing tester, and FIG. 6 shows the steps of imaging. In the figures, the photoconductor housing an optical system internally is anchored to an indium tin oxide layer as a transparent conductive layer. The developing agent used in the developer comprises a powder toner containing 30 wt % magnetic powder, with 30 μm of a magnetite carrier, and the developing was made with a toner concentration of 20 wt % and a $V_b$ of −600 V. The developed toner was transferred by a transfer roller onto a recording sheet (product of Fujitsu) for printing via an adhesion device to complete the printing test 4.

Printing test (5)

Printing test (5) was conducted in exactly the same manner as printing test (1), except that a Crotolone corona charger was used for the charging step. FIG. 3 is a process diagram for the printing tester.

Printing test

A printing test was conducted using the photoconductors described above. The evaluation of the printing test was made using a Sakura densitometer (PDA-65, product of Konica), and the optical density (O.D.) of the front and background sections of the print obtained by the printing test was measured and the printing concentration and background fog was evaluated. The front section printing concentration was defined as the O.D. value of the front sections, and the background fog was defined as the difference in O.D. values (ΔO.D.) between the background printing concentration and the O.D. value (0.12) of the recording sheet. For the evaluation of the printing quality, o was used to indicate a front section printing concentration of 1.3 (O.D.) or greater and a background fog of 0.02 (ΔO.D.) or less, and x as used for all other cases. In printing tests 1 to 3, the surface potential of the photoconductors immediately after charging with a charging bias of −600 V, and the deviation in the surface potential, were also measured. In printing test 4, the surface potential of the photoconductor immediately after separation of the photoconductor and the developing agent at a developing bias of −600 V was measured.

Table XXI shows the results of evaluation of the printing tests and the surface potentials of the photoconductors.

In printing tests 1 to 4, the fog was 0.1 or greater with the comparison photoconductor. Also, the surface potential of the comparison photoconductor was a high potential of 100 V or greater against the bias, independently of the printing tester used, and the deviation was 50 V or greater. In contrast, although the front section printing concentrations of the photoconductors of the examples were roughly the same as the comparison photoconductor, the background fog was reduced to 0.02 or less. Also, in printing tests 1 to 4, charging was effected to about the same voltage as the bias, while the deviation in surface potential was 5 V or less. The reduced background fog is believed to have been possible because of stable charging of the photoconductor. However, in printing test 5, the photoconductors of the examples had much lower surface potentials than the comparison photoconductor, with large deviations. Thus, the electrification enhancer clearly exhibited its effect only with contact charging.

TABLE XXI

| | | Evaluation of printing test and photoconductor surface potential | | | | |
|---|---|---|---|---|---|---|
| Photo-conductor | Printing test | Front section printing concentration (O.D.) | Background fog (ΔO.D.) | Surface potential ($V_s$) | Surface potential deviation (V) | Printing quality |
| (101) | (1) | 1.45 | 0.01 | 598 | 1 | o |
| | (2) | 1.36 | 0.01 | 595 | 2 | o |
| | (3) | 1.39 | 0.01 | 597 | 3 | o |
| (102) | (4) | 1.38 | 0.02 | 597 | 0 | o |
| (103) | (1) | 1.2 | 0.01 | 598 | 1 | o |
| | (2) | 1.39 | 0.01 | 595 | 1 | o |
| | (3) | 1.35 | 0.01 | 597 | 2 | o |
| (104) | (4) | 1.38 | 0.02 | 597 | 2 | o |
| (105) | (1) | 1.38 | 0.01 | 598 | 2 | o |
| | (2) | 1.37 | 0.01 | 595 | 2 | o |
| | (3) | 1.38 | 0.01 | 597 | 1 | o |
| (106) | (4) | 1.40 | 0.01 | 598 | 1 | o |
| (107) | (1) | 1.38 | 0.01 | 598 | 1 | o |
| | (2) | 1.38 | 0.01 | 595 | 2 | o |
| | (3) | 1.40 | 0.01 | 597 | 2 | o |
| (108) | (4) | 1.39 | 0.02 | 598 | 0 | o |
| (109) | (1) | 1.43 | 0.01 | 597 | 1 | o |
| | (2) | 1.42 | 0.01 | 597 | 2 | o |
| | (3) | 1.43 | 0.01 | 597 | 1 | o |
| (110) | (4) | 1.45 | 0.01 | 598 | 1 | o |
| (111) | (1) | 1.42 | 0.01 | 598 | 1 | o |
| | (2) | 1.35 | 0.01 | 596 | 1 | o |
| | (3) | 1.41 | 0.01 | 595 | 2 | o |
| (112) | (4) | 1.39 | 0.02 | 596 | 1 | o |
| (113) | (1) | 1.40 | 0.01 | 598 | 1 | o |
| | (2) | 1.38 | 0.01 | 595 | 2 | o |
| | (3) | 1.39 | 0.01 | 597 | 1 | o |
| (114) | (4) | 1.33 | 0.02 | 598 | 0 | o |
| (115) | (1) | 1.43 | 0.01 | 598 | 1 | o |
| | (2) | 1.42 | 0.01 | 598 | 2 | o |
| | (3) | 1.43 | 0.01 | 597 | 1 | o |
| (116) | (4) | 1.43 | 0.01 | 597 | 1 | o |
| (117) | (1) | 1.41 | 0.01 | 598 | 1 | o |
| | (2) | 1.40 | 0.01 | 596 | 1 | o |
| | (3) | 1.38 | 0.01 | 597 | 0 | o |
| (118) | (4) | 1.40 | 0.02 | 598 | 1 | o |
| (119) | (1) | 1.38 | 0.01 | 598 | 1 | o |
| | (2) | 1.36 | 0.01 | 597 | 2 | o |
| | (3) | 1.39 | 0.01 | 597 | 2 | o |
| (120) | (4) | 1.38 | 0.02 | 598 | 0 | o |
| (121) | (1) | 1.41 | 0.01 | 598 | 2 | o |
| | (2) | 1.42 | 0.01 | 597 | 2 | o |
| | (3) | 1.43 | 0.01 | 599 | 1 | o |
| (122) | (4) | 1.39 | 0.01 | 599 | 2 | o |
| (123) | (1) | 1.42 | 0.01 | 598 | 1 | o |
| | (2) | 1.42 | 0.01 | 595 | 1 | o |
| | (3) | 1.38 | 0.01 | 598 | 2 | o |
| (124) | (4) | 1.35 | 0.01 | 597 | 2 | o |
| (125) | (1) | 1.45 | 0.21 | 478 | 53 | x |
| Compar- | (2) | 1.36 | 0.24 | 482 | 64 | x |
| ison | (3) | 1.39 | 0.25 | 438 | 55 | x |
| (126) | (4) | 1.38 | 0.78 | 395 | 120 | x |
| Compar- | | | | | | |
| ison | | | | | | |
| (127) | (1) | 1.43 | 0.32 | 458 | 68 | x |
| Compar- | (2) | 1.42 | 0.34 | 467 | 58 | x |
| ison | (3) | 1.43 | 0.28 | 478 | 78 | x |
| (128) | (4) | 1.38 | 0.89 | 376 | 120 | x |
| Compar- | | | | | | |
| ison | | | | | | |
| (129) | (1) | 1.42 | 0.13 | 488 | 61 | x |
| Compar- | (2) | 1.39 | 0.14 | 485 | 65 | x |
| ison | (3) | 1.35 | 0.11 | 597 | 70 | x |

TABLE XXI-continued

| Photo-conductor | Printing test | Evaluation of printing test and photoconductor surface potential: Front section printing concentration (O.D.) | Background fog (ΔO.D.) | Surface potential ($V_s$) | Surface potential deviation (V) | Printing quality |
|---|---|---|---|---|---|---|
| (130) Comparison | (4) | 1.38 | 0.41 | 497 | 85 | x |
| (101) | (5) | 1.42 | 0.21 | 478 | 61 | x |
| (103) | | 1.35 | 0.15 | 487 | 70 | x |
| (105) | | 1.38 | 0.18 | 487 | 85 | x |
| (107) | | 1.37 | 0.32 | 458 | 38 | x |
| (109) | | 1.41 | 0.26 | 477 | 30 | x |
| (111) | | 1.40 | 0.32 | 466 | 41 | x |
| (113) | | 1.32 | 0.27 | 488 | 25 | x |
| (115) | | 1.28 | 0.21 | 490 | 21 | x |
| (117) | | 1.24 | 0.28 | 480 | 31 | x |
| (119) | (5) | 1.36 | 0.15 | 490 | 20 | o |
| (121) | | 1.41 | 0.17 | 490 | 21 | o |
| (123) | | 1.40 | 0.19 | 488 | 28 | o |
| (125) Comparison | | 1.40 | 0.01 | 599 | 0 | o |
| (127) Comparison | | 1.43 | 0.01 | 598 | 2 | o |
| (129) Comparison | | 1.41 | 0.01 | 597 | 2 | o |

Example 8 [Compounds of formulas (X)-(XI)]

Preparation of photoconductors

Photoconductor (131)—Compound 9

One part of a butadiene derivative, one part of a polycarbonate and 0.02 part of compound 1 were dissolved in 17 parts of dichloromethane to prepare an application solution. The above-mentioned non-transparent drum with a charge generating layer was dip coated with this solution, and dried at 90° C. for one hour to prepare a charge carrier layer with a thickness of about 15 μm, thus forming the photosensitive layer to obtain photoconductor (131).

Photoconductor (132)—Compound 9

Indium tin oxide was vapor deposited to a film thickness of 100 Å onto a glass cylinder (ϕ30 mm, 7740 product of Corning) to make a transparent conductive support. This transparent conductive support has an electrical conductivity in terms of surface resistance of $10^2$ Ω/□, and a transparency in terms of the total light transmittance of 90% or greater. A photoconductor (132) was prepared in exactly the same manner as the photoconductor (131), except that the support for the photoconductor was a transparent conductive support.

Photoconductor (133)—Compound 10

A photoconductor (133) was obtained in exactly the same manner as photoconductor (131), except that compound 9 used in photoconductor (131) was replaced with compound 10.

Photoconductor (134)—Compound 10

A photoconductor (134) was obtained in exactly the same manner as photoconductor (133), except that the support was the transparent conductive support used for photoconductor (132).

Photoconductor (135)—Compound 11

A photoconductor (135) was obtained in exactly the same manner as photoconductor (131), except that compound 9 used in photoconductor (131) was replaced with compound 11.

Photoconductor (136)—Compound 11

A photoconductor (136) was obtained in exactly the same manner as photoconductor (135), except that the support was the transparent conductive support used for photoconductor (132).

Photoconductor (137)—Compound 12

A photoconductor (137) was obtained in exactly the same manner as photoconductor (131), except that compound 9 used in photoconductor (131) was replaced with compound 12.

Photoconductor (138)—Compound 12

A photoconductor (138) was obtained in exactly the same manner as photoconductor (137), except that the support was the transparent conductive support used for photoconductor (132).

Photoconductor (139)—Compound 13

A photoconductor (139) was obtained in exactly the same manner as photoconductor (131), except that compound 9 used in photoconductor (131) was replaced with compound 13.

Photoconductor (140)—Compound 13

A photoconductor (140) was obtained in exactly the same manner as photoconductor (139), except that the support was the transparent conductive support used for photoconductor (132).

Photoconductor (141)—Compound 14

A photoconductor (141) was obtained in exactly the same manner as photoconductor (131), except that compound 9 used in photoconductor (131) was replaced with compound 14.

Photoconductor (142)—Compound 14

A photoconductor (142) was obtained in exactly the same manner as photoconductor (141), except that the support was the transparent conductive support used for photoconductor (132).

Photoconductor (143)—Compound 15

A photoconductor (143) was obtained in exactly the same manner as photoconductor (131), except that compound 9 used in photoconductor (131) was replaced with compound 15.

Photoconductor (144)—Compound 15

A photoconductor (144) was obtained in exactly the same manner as photoconductor (143), except that the support was the transparent conductive support used for photoconductor (132).

Photoconductor (145)—Compound 16

A photoconductor (145) was obtained in exactly the same manner as photoconductor (131), except that compound 9 used in photoconductor (131) was replaced with compound 16.

Photoconductor (146)—Compound 16

A photoconductor (146) was obtained in exactly the same manner as photoconductor (145), except that the support was the transparent conductive support used for photoconductor (132).

Photoconductor (147)—Compound 17

A photoconductor (147) was obtained in exactly the same manner as photoconductor (131), except that compound 9 used in photoconductor (131) was replaced with compound 17.

Photoconductor (148)—Compound 17

A photoconductor (148) was obtained in exactly the same manner as photoconductor (147), except that the support was the transparent conductive support used for photoconductor (132).

Photoconductor (149)—Compound 18

A photoconductor (149) was obtained in exactly the same manner as photoconductor (131), except that compound 9 used in photoconductor (131) was replaced with compound 18.

Photoconductor (150)—Compound 18

A photoconductor (150) was obtained in exactly the same manner as photoconductor (149), except that the support was the transparent conductive support used for photoconductor (132).

Photoconductor (151)—Compound 19

A photoconductor (151) was obtained in exactly the same manner as photoconductor (131), except that compound 9 used in photoconductor (131) was replaced with compound 19.

Photoconductor (152)—Compound 19

A photoconductor (152) was obtained in exactly the same manner as photoconductor (151), except that the support was the transparent conductive support used for photoconductor (132).

Photoconductor (153)—Compound 20

A photoconductor (153) was obtained in exactly the same manner as photoconductor (131), except that compound 9 used in photoconductor (131) was replaced with compound 20.

Photoconductor (154)—Compound 20

A photoconductor (154) was obtained in exactly the same manner as photoconductor (153), except that the support was the transparent conductive support used for photoconductor (132).

Photoconductor (155)—Compound 21

A photoconductor (155) was obtained in exactly the same manner as photoconductor (131), except that compound 9 used in photoconductor (131) was replaced with compound 21.

Photoconductor (156)—Compound 21

A photoconductor (156) was obtained in exactly the same manner as photoconductor (155), except that the support was the transparent conductive support used for photoconductor (132).

Photoconductor (157)—Compound 22

A photoconductor (157) was obtained in exactly the same manner as photoconductor (131), except that compound 9 used in photoconductor (131) was replaced with compound 22.

Photoconductor (158)—Compound 22

A photoconductor (158) was obtained in exactly the same manner as photoconductor (157), except that the support was the transparent conductive support used for photoconductor (132).

Photoconductor (159)—Compound 23

A photoconductor (159) was obtained in exactly the same manner as photoconductor (131), except that compound 9 used in photoconductor (131) was replaced with compound 23.

Photoconductor (160)—Compound 23

A photoconductor (160) was obtained in exactly the same manner as photoconductor (159), except that the support was the transparent conductive support used for photoconductor (132).

Photoconductor (161)—Compound 24

A photoconductor (161) was obtained in exactly the same manner as photoconductor (131), except that compound 9 used in photoconductor (131) was replaced with compound 24.

Photoconductor (162)—Compound 24

A photoconductor (162) was obtained in exactly the same manner as photoconductor (161), except that the support was the transparent conductive support used for photoconductor (132).

Photoconductor (163)—Compound 25

A photoconductor (163) was obtained in exactly the same manner as photoconductor (131), except that compound 9 used in photoconductor (131) was replaced with compound 25.

Photoconductor (164)—Compound 25

A photoconductor (164) was obtained in exactly the same manner as photoconductor (163), except that the support was the transparent conductive support used for photoconductor (132).

Photoconductor (165)—Compound 27

The support used for the photoconductor was an aluminum cylinder (ϕ40 mm, A40S-$H_{14}$, product of Kobe Seitetsu, K.K.). The support was dip coated with a solution prepared by dissolving one part of cyanoethylated pullulan in 10 parts (by weight) of acetone, and then dried at 100° C. for one hour to obtain a 1 μm thick intermediate layer. A mixture containing one part of α-oxothitalphthalocyanine, one part of polyester and 20 parts of 1,1,2-trichloroethane dispersed and mixed for 24 hours using a hard glass bowl and a hard glass pot was then applied onto the above-mentioned intermediate layer and dried at 100° C. for one hour to form a charge generating layer with a thickness of about 0.3 μm. Next, one part of a butadiene derivative and one part of a polycarbonate were dissolved in 17 parts of dichloromethane to prepare an application solution. The above-mentioned charge generating layer was dip coated with this solution, and dried at 90° C. for one hour to prepare a charge carrier layer with a thickness of about 15 μm, and a photosensitive layer was formed thereon to obtain a photoconductor (165).

Photoconductor (166)—Comparison photoconductor (8)

A photoconductor (166) was obtained in exactly the same manner as photoconductor (165), except that the support was the transparent conductive support used for photoconductor (132).

Printing test

The same printing tests as in Example 7 were conducted using the above-mentioned photoconductors. The printing testers and printing evaluation criteria were the same as in Example 7.

Table XXII shows the results of evaluation of the printing tests and the surface potentials of the photoconductors.

TABLE XXII

| | | Evaluation of printing test and photoconductor surface potential | | | | |
|---|---|---|---|---|---|---|
| Photo-conductor | Printing test | Front section printing concentration (O.D.) | Background fog (ΔO.D.) | Surface potential ($V_s$) | Surface potential deviation (V) | Printing quality |
| (131) | (1) | 1.45 | 0.01 | 598 | 1 | o |
| | (2) | 1.36 | 0.01 | 595 | 2 | o |
| | (3) | 1.39 | 0.01 | 597 | 3 | o |
| (132) | (4) | 1.38 | 0.02 | 597 | 0 | o |
| (133) | (1) | 1.42 | 0.01 | 598 | 1 | o |
| | (2) | 1.39 | 0.01 | 595 | 1 | o |
| | (3) | 1.35 | 0.01 | 597 | 2 | o |
| (134) | (4) | 1.38 | 0.02 | 597 | 2 | o |
| (135) | (1) | 1.38 | 0.01 | 598 | 2 | o |
| | (2) | 1.37 | 0.01 | 595 | 2 | o |
| | (3) | 1.38 | 0.01 | 597 | 1 | o |
| (136) | (4) | 1.40 | 0.01 | 598 | 2 | o |
| (137) | (1) | 1.38 | 0.01 | 598 | 1 | o |
| | (2) | 1.38 | 0.01 | 595 | 2 | o |
| | (3) | 1.40 | 0.01 | 597 | 2 | o |
| (138) | (4) | 1.39 | 0.02 | 598 | 0 | o |
| (139) | (1) | 1.43 | 0.01 | 597 | 1 | o |
| | (2) | 1.42 | 0.01 | 597 | 2 | o |
| | (3) | 1.43 | 0.01 | 597 | 1 | o |
| (140) | (4) | 1.45 | 0.01 | 598 | 1 | o |
| (141) | (1) | 1.42 | 0.01 | 598 | 1 | o |
| | (2) | 1.35 | 0.01 | 596 | 1 | o |
| | (3) | 1.41 | 0.01 | 595 | 2 | o |
| (142) | (4) | 1.39 | 0.02 | 596 | 1 | o |
| (143) | (1) | 1.40 | 0.01 | 598 | 1 | o |
| | (2) | 1.38 | 0.01 | 595 | 2 | o |
| | (3) | 1.39 | 0.01 | 597 | 1 | o |
| (144) | (4) | 1.33 | 0.02 | 598 | 0 | o |
| (145) | (1) | 1.43 | 0.01 | 598 | 1 | o |
| | (2) | 1.42 | 0.01 | 598 | 2 | o |
| | (3) | 1.43 | 0.01 | 597 | 1 | o |
| (146) | (4) | 1.43 | 0.01 | 597 | 1 | o |
| (147) | (1) | 1.41 | 0.01 | 598 | 1 | o |
| | (2) | 1.40 | 0.01 | 596 | 1 | o |
| | (3) | 1.38 | 0.01 | 597 | 0 | o |
| (148) | (4) | 1.40 | 0.02 | 598 | 1 | o |
| (149) | (1) | 1.38 | 0.01 | 598 | 1 | o |
| | (2) | 1.36 | 0.01 | 597 | 2 | o |
| | (3) | 1.39 | 0.01 | 597 | 2 | o |
| (150) | (4) | 1.38 | 0.02 | 598 | 0 | o |
| (151) | (1) | 1.41 | 0.01 | 598 | 2 | o |
| | (2) | 1.42 | 0.01 | 597 | 2 | o |
| | (3) | 1.43 | 0.01 | 599 | 1 | o |
| (152) | (4) | 1.39 | 0.01 | 599 | 2 | o |
| (153) | (1) | 1.42 | 0.01 | 598 | 1 | o |
| | (2) | 1.42 | 0.01 | 595 | 1 | o |
| | (3) | 1.38 | 0.01 | 598 | 2 | o |
| (154) | (4) | 1.35 | 0.01 | 597 | 2 | o |
| (155) | (1) | 1.42 | 0.01 | 595 | 0 | o |
| | (2) | 1.43 | 0.01 | 597 | 1 | o |
| | (3) | 1.44 | 0.01 | 598 | 1 | o |
| (156) | (4) | 1.38 | 0.02 | 599 | 0 | o |
| (157) | (1) | 1.44 | 0.01 | 599 | 1 | o |
| | (2) | 1.38 | 0.01 | 598 | 1 | o |
| | (3) | 1.45 | 0.01 | 599 | 1 | o |
| (158) | (4) | 1.38 | 0.02 | 597 | 2 | o |
| (159) | (1) | 1.39 | 0.01 | 598 | 1 | o |
| | (2) | 1.35 | 0.01 | 595 | 1 | o |
| | (3) | 1.36 | 0.01 | 597 | 1 | o |
| (160) | (4) | 1.40 | 0.01 | 598 | 1 | o |
| (161) | (1) | 1.40 | 0.01 | 598 | 1 | o |
| | (2) | 1.35 | 0.01 | 595 | 1 | o |
| | (3) | 1.40 | 0.01 | 597 | 0 | o |
| (162) | (4) | 1.39 | 0.02 | 598 | 0 | o |
| (163) | (1) | 1.41 | 0.01 | 597 | 1 | o |

TABLE XXII-continued

| Photo-conductor | Printing test | Evaluation of printing test and photoconductor surface potential: Front section printing concentration (O.D.) | Background fog (ΔO.D.) | Surface potential ($V_s$) | Surface potential deviation (V) | Printing quality |
|---|---|---|---|---|---|---|
| | (2) | 1.43 | 0.01 | 598 | 2 | o |
| | (3) | 1.42 | 0.01 | 597 | 1 | o |
| (164) | (4) | 1.44 | 0.01 | 598 | 1 | o |
| (165) | (1) | 1.45 | 0.21 | 478 | 53 | x |
| | (2) | 1.36 | 0.24 | 482 | 64 | x |
| | (3) | 1.39 | 0.25 | 438 | 55 | x |
| (166) | (4) | 1.38 | 0.78 | 395 | 120 | x |
| (131) | (5) | 1.42 | 0.21 | 478 | 61 | x |
| (132) | | 1.35 | 0.15 | 487 | 70 | x |
| (134) | | 1.38 | 0.18 | 487 | 85 | x |
| (136) | | 1.37 | 0.32 | 458 | 38 | x |
| (138) | | 1.41 | 0.26 | 477 | 30 | x |
| (140) | | 1.40 | 0.32 | 466 | 41 | x |
| (142) | | 1.32 | 0.27 | 488 | 25 | x |
| (144) | | 1.28 | 0.21 | 490 | 21 | x |
| (146) | | 1.24 | 0.28 | 480 | 31 | x |
| (148) | (5) | 1.36 | 0.15 | 490 | 20 | x |
| (150) | | 1.41 | 0.17 | 490 | 21 | x |
| (152) | | 1.40 | 0.19 | 488 | 28 | x |
| (154) | | 1.41 | 0.26 | 477 | 30 | x |
| (156) | | 1.40 | 0.32 | 466 | 41 | x |
| (158) | | 1.41 | 0.26 | 477 | 30 | x |
| (160) | | 1.40 | 0.32 | 466 | 41 | x |
| (162) | | 1.32 | 0.27 | 488 | 25 | x |
| (164) | | 1.28 | 0.21 | 490 | 21 | x |
| (166) | | 1.41 | 0.28 | 597 | 2 | o |

A printing test was conducted using the photoconductors described above. The evaluation of the printing test was made using a Sakura densitometer (PDA-65, product of Konica), and the optical density (O.D.) of the front and background sections of the print obtained by the printing test was measured and the printing concentration and background fog was evaluated. The front section printing concentration was defined as the O.D. value of the front sections, and the background fog was defined as the difference in O.D. values (ΔO.D.) between the background printing concentration and the O.D. value (0.12) of the recording sheet. For the evaluation of the printing quality, o was used to indicate a front section printing concentration of 1.3 (O.D.) or greater and a background fog of 0.02 (ΔO.D.) or less, and x as used for all other cases. In printing tests 1 to 3, the surface potential of the photoconductors immediately after charging with a charging bias of −600 V, and the deviation in the surface potential, were also measured. In printing test 4, the surface potential of the photoconductor immediately after separation of the photoconductor and the developing agent at a developing bias of −600 V was measured. In printing tests (1) to (4), the fog was 0.1 or greater with the photoconductors (165) and (166). Also, the surface potentials of photoconductors (165) and (166) were high potentials of 100 V or greater against the bias, independently of the printing tester used, and their deviations were 50 V or greater. In contrast, although the front section printing concentrations of the photoconductors of photoconductors (131) to (164) were roughly the same as photoconductors (165) and (166), the background fog was reduced to 0.02 or less. Also, in printing tests 1 to 4, charging was effected to about the same voltage as the bias, while the deviation in surface potential was 5 V or less. The reduced background fog is believed to have been possible because of stable charging of the photoconductor. However, in printing test 5, photoconductors (131) to (164) (even-numbered ones only) had much lower surface potentials than photoconductor (165), with large deviations. Thus, compounds 9 to 26 clearly exhibited their effects only with contact charging.

Example 9 [Ferroelectric material]

Preparation of photoconductors

Photoconductor (167)

One part of a butadiene derivative, one part of a polycarbonate and 0.02 part of compound No. 1 in Table I, barium titanate, as the electrification enhancer were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer to obtain the photoconductor of Example 6.

Photoconductor (168)

Indium tin oxide was vapor deposited to a film thickness of 100 Å onto a glass cylinder (ϕ30 mm, 7740 product of Corning) to make a transparent conductive support. This transparent conductive support has an electrical conductivity in terms of surface resistance of $10^2$ Ω/□, and a transparency in terms of the total light transmittance of 90% or greater. A photoconductor (168) was prepared in exactly the same manner as the photoconductor (167), except that the support for the photoconductor was a transparent conductive support.

Photoconductor (169)

The support used for the photoconductor was the same as used for photoconductor (167). The support was dip coated with a solution prepared by dissolving one part of cyanoethylated pullulan in 10 parts (by weight) of acetone, and then dried at 100° C. for one hour to form a 1 μm thick intermediate layer. A mixture containing one part of α-oxothitalphthalocyanine, one part of butadiene, one part of a polycarbonate, 0.03 part of compound No. 1 in Table I, barium titanate, as the electrification enhancer and 20 parts of 1,1,2-trichloroethane dispersed and mixed for 24 hours using a hard glass bowl and a hard glass pot was then applied onto the above-mentioned intermediate layer and dried at 100° C. for one hour, thus forming a photosensitive layer with a thickness of about 15 μm to obtain a photoconductor (169).

Photoconductor (170)

A photoconductor (170) was obtained in exactly the same manner as photoconductor (169), except that the support was the transparent conductive support used for photoconductor (168).

Photoconductor (171)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was further dip coated with TOSUPURAIPU (product of Toshiba Silicone) as an adhesive layer for the insulator layer and dried at 90° C. for 30 minutes, and then dip coated with a mixture containing one part of the silicon-based coating agent TOSUGADO (product of Toshiba Silicone) and 0.01 part of compound No. 1 in Table 1, barium titanate, as the electrification enhancer, and allowed to harden at 90° C. for 1 hour, thus forming an insulator layer with a thickness of about 1 μm to obtain photoconductor (171).

Photoconductor (172)

A photoconductor (172) was obtained in exactly the same manner as photoconductor (171), except that the support was the transparent conductive support used for photoconductor (168).

Photoconductor (173)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photoconductor layer was then dip coated with a solution prepared by dissolving one part of compound No. 1 in Table I, barium titanate, as the electrification enhancer in 100 parts of ethanol, thus forming a film with a thickness of 100 Å to obtain photoconductor (173).

Photoconductor (174)

A photoconductor (174) was obtained in exactly the same manner as photoconductor (173), except that the support was the transparent conductive support used for photoconductor (168).

Photoconductor (175)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was further dip coated with TOSUPURAIPU (product of Toshiba Silicone) as an adhesive layer for the insulator layer and dried at 90° C. for 30 minutes, and then dip coated with a mixture containing one part of the silicon-based coating agent TOSUGADO (product of Toshiba Silicone) and 0.01 part of compound 1, ammonium fluoride, as the electrification enhancer, and allowed to harden at 90° C. for 1 hour, thus forming an insulator layer with a thickness of about 1 μm. This insulator layer was then dip coated with a solution prepared by dissolving one part of compound No. 1 in Table I, barium titanate, as the electrification enhancer in 100 parts of ethanol, thus forming a film with a thickness of 100 Å to obtain photoconductor (175).

Photoconductor (176)

A photoconductor (176) was obtained in exactly the same manner as photoconductor (175), except that the support was the transparent conductive support used for photoconductor (168).

Photoconductor (177)

A photoconductor (177) was obtained in exactly the same manner as photoconductor (167), except that the electrification enhancer was compound No. 2 in Table 1, cadmium niobate ($Cd_2Nb_2O_7$).

Photoconductor (178)

A photoconductor (178) was obtained in exactly the same manner as photoconductor (167), except that the support was the transparent conductive support used for photoconductor (168).

Photoconductor (179)

A photoconductor (179) was obtained in exactly the same manner as photoconductor (167), except that the electrification enhancer was compound No. 3 in Table 1, polyvinylidene fluoride ($(—CH_2CF—)_n$).

Photoconductor (180)

A photoconductor (180) was obtained in exactly the same manner as photoconductor (179), except that the support was the transparent conductive support used for photoconductor (168).

Printing test

The same printing tests as in Example 7 were conducted using the above-mentioned photoconductors. The printing testers and printing evaluation criteria were the same as in Example 7.

Table XXIII shows the results of evaluation of the printing tests and the surface potentials of the photoconductors.

In printing tests 1 to 4, as previously, (see Example 7), the comparison photoconductor had a fog of 0.10 or greater. Also, the surface potential of the comparison photoconductor was a low voltage of an absolute value of 100 V or greater against the bias, independently of the printing tester used, and its deviation was 50 V or greater. In contrast, although the front section printing concentrations of the photoconductors of the examples were roughly the same as the comparison photoconductor, the background fog was reduced to 0.03 or less. Also, in printing tests 1 to 4, charging was effected to about the same voltage as the bias, while the deviation in surface potential was 5 V or less. The reduced background fog is believed to have been possible because of stable charging of the photoconductor. However, in printing test 5, the photoconductors prepared in the examples had much lower surface potentials the comparison photoconductor, with large deviations, and the background fog was increased. With corona charging, absolutely no effect of the electrification enhancer was obtained, and conversely the charging was poorer.

From the results described above, it is clear that the chargeability of photoconductors is improved and satisfactory charging properties are exhibited by using an electrification enhancer for contact charging.

TABLE XXIII

| Photo-conductor | Printing test | Front section printing concen-tration (O.D.) | Background fog (ΔO.D.) | Surface potential ($V_s$) | Surface potential deviation (V) | Printing quality |
|---|---|---|---|---|---|---|
| | | Evaluation of printing test and photoconductor surface potential (1) | | | | |
| (167) | (1) | 1.45 | 0.01 | 598 | 1 | o |
| | (2) | 1.36 | 0.01 | 595 | 2 | o |
| | (3) | 1.39 | 0.01 | 597 | 3 | o |
| (168) | (4) | 1.38 | 0.02 | 597 | 0 | o |
| | (1) | 1.42 | 0.01 | 598 | 1 | o |
| (169) | (2) | 1.39 | 0.01 | 595 | 1 | o |
| | (3) | 1.35 | 0.01 | 597 | 2 | o |
| (170) | (4) | 1.38 | 0.02 | 597 | 2 | o |
| (171) | (1) | 1.38 | 0.01 | 598 | 2 | o |
| | (2) | 1.37 | 0.01 | 595 | 2 | o |
| | (3) | 1.38 | 0.01 | 597 | 1 | o |
| (172) | (4) | 1.40 | 0.01 | 598 | 1 | o |
| | | Evaluation of printing test and photoconductor surface potential (2) | | | | |
| (173) | (1) | 1.38 | 0.01 | 598 | 1 | o |
| | (2) | 1.38 | 0.01 | 595 | 2 | o |
| | (3) | 1.40 | 0.01 | 597 | 2 | o |
| (174) | (4) | 1.39 | 0.02 | 598 | 0 | o |
| (175) | (1) | 1.43 | 0.01 | 597 | 1 | o |
| | (2) | 1.42 | 0.01 | 597 | 2 | o |
| | (3) | 1.43 | 0.01 | 597 | 1 | o |
| (176) | (4) | 1.45 | 0.01 | 598 | 1 | o |
| (177) | (1) | 1.42 | 0.01 | 598 | 1 | o |
| | (2) | 1.35 | 0.01 | 596 | 1 | o |
| | (3) | 1.41 | 0.01 | 595 | 2 | o |
| (178) | (4) | 1.39 | 0.02 | 596 | 1 | o |
| | | Evaluation of printing test and photoconductor surface potential (3) | | | | |
| (179) | (1) | 1.40 | 0.01 | 598 | 1 | o |
| | (2) | 1.38 | 0.01 | 595 | 2 | o |
| | (3) | 1.39 | 0.01 | 597 | 1 | o |
| (180) | (4) | 1.33 | 0.02 | 598 | 0 | o |
| (167) | (5) | 1.42 | 0.21 | 478 | 61 | x |
| (169) | | 1.35 | 0.15 | 487 | 70 | x |
| (171) | | 1.38 | 0.18 | 487 | 85 | x |
| (173) | | 1.37 | 0.32 | 458 | 38 | x |
| (175) | | 1.41 | 0.26 | 477 | 30 | x |
| (11) | (5) | 1.40 | 0.32 | 466 | 41 | x |
| (13) | | 1.32 | 0.27 | 488 | 25 | x |

Example 10 [Ferroelectric liquid crystal]

Preparation of photoconductors

Photoconductor (181)

One part of a butadiene derivative, one part of a polycarbonate and 0.02 part of DOBAMBC, one of the Schiff's base systems of Nos. 1 to 4 of Table II, were dissolved in 17 parts of dichloromethane to prepare an application solution. The above-mentioned non-transparent drum with a charge generating layer was dip coated with this solution, and dried at 90° C. for one hour to prepare a charge carrier layer with a thickness of about 15 μm, thus forming the photosensitive layer to obtain photoconductor (181).

Photoconductor (182)

Indium tin oxide was vapor deposited to a film thickness of 100 Å onto a glass cylinder (ϕ30 mm, 7740 product of Corning) to make a transparent conductive support. This transparent conductive support has an electrical conductivity in terms of surface resistance of $10^2$ Ω/□, and a transparency in terms of the total light transmittance of 90% or greater. A photoconductor (182) was prepared in exactly the same manner as the photoconductor (181), except that the support for the photoconductor was a transparent conductive support.

Photoconductor (183)

The support used for the photoconductor was the same as used for photoconductor (181). The support was dip coated with a solution prepared by dissolving one part of cyanoethylated pullulan in 10 parts (by weight) of acetone, and then dried at 100° C. for one hour to form a 1 μm thick intermediate layer. A mixture containing one part of α-oxothitalphthalocyanine, one part of butadiene, one part of a polycarbonate, 0.03 part of compound No. 1 in Table II, DOBAMBC, and 20 parts of 1,1,2-trichloroethane dispersed and mixed for 24 hours using a hard glass bowl and a hard glass pot was then applied onto the above-mentioned intermediate layer and dried at 100° C. for one hour, thus forming a photosensitive layer with a thickness of about 15 μm to obtain a photoconductor (183).

Photoconductor (184)

A photoconductor (184) was obtained in exactly the same manner as photoconductor (183), except that the support was the transparent conductive support used for photoconductor (182).

Photoconductor (185)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was further dip coated with TOSUPURAIPU (product of Toshiba Silicone) as an adhesive layer for the insulator layer and dried at 90° C. for 30 minutes, and then dip coated with a mixture containing one part of the silicon-based coating agent TOSUGADO (product of Toshiba Silicone) and 0.01 part of compound 1 in Table II, DOBAMBC (n=10), and allowed to harden at 90° C. for 1 hour, thus forming an insulator layer with a thickness of about 1 μm to obtain photoconductor (185).

Photoconductor (186)

A photoconductor (186) was obtained in exactly the same manner as photoconductor (185), except that the support was the transparent conductive support used for photoconductor (182).

Photoconductor (187)

A photoconductor (187) was obtained in exactly the same manner as photoconductor (181), except that 4-propionyl-4'-heptanoyloxy azobenzene, one of the azo or azoxy compounds of No.5 and No.6 in Table II, was used as the ferroelectric liquid crystal material.

Photoconductor (188)

A photoconductor (188) was obtained in exactly the same manner as photoconductor (146), except that 4-propionyl-4'-heptanoyloxy azobenzene, one of the azo or azoxy compounds of No.5 and No.6 in Table II, was used as the ferroelectric liquid crystal material.

Photoconductor (189)

A photoconductor (189) was obtained in exactly the same manner as photoconductor (181), except that hexyl-4'-pentyloxybiphenyl-4-carboxylate, one of the phenyl compounds of No.7 in Table II, was used as the ferroelectric liquid crystal material.

Photoconductor (190)

A photoconductor (190) was obtained in exactly the same manner as photoconductor (182), except that hexyl-4'-pentyloxybiphenyl-4-carboxylate, one of the phenyl compounds of No.7 in Table II, was used as the ferroelectric liquid crystal material.

Photoconductor (191)

A photoconductor (191) was obtained in exactly the same manner as photoconductor (181), except that 4-(2-methylbutyl) phenyl-4'-octylbiphenyl-4-carboxylate, one of the ester compounds of Nos. 8–19 in Table II, was used as the ferroelectric liquid crystal material.

Photoconductor (192)

A photoconductor (192) was obtained in exactly the same manner as photoconductor (192), except that 4-(2-methylbutyl) phenyl-4'-octylbiphenyl-4-carboxylate, one of the ester compounds of Nos. 8–19 in Table II, was used as the ferroelectric liquid crystal material.

Photoconductor (193)

A photoconductor (193) was obtained in exactly the same manner as photoconductor (181), except that 4-(2-methylbutyl) phenyl-4'-octylbiphenyl-4-cyclohexane, one of the cyclohexane ring-containing compounds of Nos. 20–22 in Table II, was used as the ferroelectric liquid crystal material.

Photoconductor (194)

A photoconductor (194) was obtained in exactly the same manner as photoconductor (182), except that 4-(2-methylbutyl) phenyl-4'-octylbiphenyl-4-cyclohexane, one of the cyclohexane ring-containing compounds of Nos. 20–22 in Table II, was used as the ferroelectric liquid crystal material.

Photoconductor (195)

A photoconductor (195) was obtained in exactly the same manner as photoconductor (181), except that 4-(2-methylbutyl) phenyl-4'-octylbiphenyl-4-acetylate, one of the compounds of Nos. 23–30 in Table II having skeletons other than those of Nos. 1–22, was used as the ferroelectric liquid crystal material.

Photoconductor (196)

A photoconductor (196) was obtained in exactly the same manner as photoconductor (182), except that 4-(2-methylbutyl) phenyl-4'-octylbiphenyl-4-acetylate, one of the compounds of Nos. 23–30 in Table II having skeletons other than those of Nos. 1–22, was used as the ferroelectric liquid crystal material.

Photoconductor (197)

A photoconductor (197) was obtained in exactly the same manner as photoconductor (181), except that 4-(2-methylbutyl) phenyl-4'-pentylpyrimidine, one of the heterocycle-containing compounds of Nos. 31–40 in Table II, was used as the ferroelectric liquid crystal material.

Photoconductor (198)

A photoconductor (198) was obtained in exactly the same manner as photoconductor (182), except that 4-(2-methylbutyl) phenyl-4'-pentylpyrimidine, one of the heterocycle-containing compounds of Nos. 31–40 in Table II, was used as the ferroelectric liquid crystal material.

Photoconductor (199)

A photoconductor (199) was obtained in exactly the same manner as photoconductor (181), except that 4-(2-methylbutyl)- 4'-pentylphenyl-4-(2-chloro) benzene, one of the substituted ring-containing compounds of Nos. 41–43 in Table II, was used as the ferroelectric liquid crystal material.

Photoconductor (200)

A photoconductor (200) was obtained in exactly the same manner as photoconductor (182), except that 4-(2-methylbutyl)- 4'-pentylphenyl-4-(2-chloro) benzene, one of the substituted ring-containing compounds of Nos. 41–43 in Table II, was used as the ferroelectric liquid crystal material.

Printing test

The same printing tests as in Example 6 were conducted using the above-mentioned photoconductors. Table XXIV shows the results of evaluation of the printing tests and the surface potentials of the photoconductors.

As in the previous cases, the comparison photoconductor of Example 6 had a fog of 0.1 or greater in all of the printing tests, the surface potential of the photoconductor was a high voltage of 100 V or greater against the bias, independently of the printing tester used, and its deviation was 50 V or greater. In contrast, although the front section printing concentration of the photosensor of Example 8 was roughly the same as the comparison photoconductor, the background fog was reduced to 0.03 or less. Also, with all of the printing testers, charging was effected to about the same voltage as the bias, while the deviation in surface potential was 5 V or less. The reduced background fog is believed to have been possible because of stable charging of the photoconductor.

TABLE XXIV

| Photo-conductor | Printing test | Front section printing concen-tration (O.D.) | Background fog (ΔO.D.) | Surface potential ($V_s$) | Surface potential deviation (V) | Printing quality |
|---|---|---|---|---|---|---|
| | | Evaluation of printing test and photoconductor surface potential (1) | | | | |
| (181) | (1) | 1.43 | 0.01 | 597 | 1 | o |
| | (2) | 1.35 | 0.01 | 594 | 2 | o |
| | (3) | 1.37 | 0.01 | 593 | 3 | o |
| (182) | (4) | 1.36 | 0.02 | 597 | 1 | o |
| (183) | (1) | 1.40 | 0.01 | 596 | 1 | o |
| | (2) | 1.38 | 0.01 | 593 | 1 | o |
| | (3) | 1.33 | 0.01 | 596 | 1 | o |
| (184) | (4) | 1.36 | 0.02 | 597 | 2 | o |
| (185) | (1) | 1.36 | 0.01 | 598 | 2 | o |
| | (2) | 1.35 | 0.01 | 594 | 2 | o |
| | (3) | 1.36 | 0.01 | 595 | 1 | o |
| (186) | (4) | 1.38 | 0.01 | 595 | 1 | o |
| | | Evaluation of printing test and photoconductor surface potential (2) | | | | |
| (187) | (1) | 1.36 | 0.01 | 596 | 1 | o |
| | (2) | 1.36 | 0.01 | 593 | 1 | o |
| | (3) | 1.38 | 0.01 | 595 | 2 | o |
| (188) | (4) | 1.37 | 0.02 | 596 | 0 | o |
| (189) | (1) | 1.41 | 0.01 | 595 | 1 | o |
| | (2) | 1.40 | 0.01 | 595 | 2 | o |
| | (3) | 1.41 | 0.01 | 595 | 1 | o |
| (190) | (4) | 1.43 | 0.01 | 596 | 1 | o |
| (191) | (1) | 1.40 | 0.01 | 596 | 1 | o |
| | (2) | 1.33 | 0.01 | 594 | 2 | o |
| | (3) | 1.39 | 0.01 | 593 | 2 | o |
| (192) | (4) | 1.37 | 0.02 | 594 | 1 | o |
| | | Evaluation of printing test and photoconductor surface potential (3) | | | | |
| (193) | (1) | 1.37 | 0.01 | 596 | 1 | o |
| | (2) | 1.36 | 0.01 | 595 | 2 | o |
| | (3) | 1.37 | 0.01 | 595 | 1 | o |
| (194) | (4) | 1.31 | 0.02 | 596 | 0 | o |
| | (1) | 1.41 | 0.01 | 596 | 1 | o |
| (195) | (2) | 1.40 | 0.01 | 595 | 2 | o |
| | (3) | 1.41 | 0.01 | 593 | 1 | o |
| (196) | (4) | 1.41 | 0.01 | 595 | 1 | o |
| (197) | (1) | 1.39 | 0.01 | 596 | 1 | o |
| | (2) | 1.38 | 0.01 | 594 | 1 | o |
| | (3) | 1.36 | 0.01 | 595 | 0 | o |
| (198) | (4) | 1.38 | 0.02 | 596 | 1 | o |
| | | Evaluation of printing test and photoconductor surface potential (4) | | | | |
| (199) | (1) | 1.36 | 0.01 | 596 | 1 | o |
| | (2) | 1.35 | 0.01 | 595 | 2 | o |
| | (3) | 1.37 | 0.01 | 595 | 2 | o |
| (200) | (4) | 1.36 | 0.02 | 596 | 0 | o |

Example 11 [High molecular substance with equivalent work function of 4.10 or greater, electret]

Preparation of photoconductors

Photoconductor (201)

One part of a butadiene derivative, one part of a polycarbonate and 0.05 part of nitrile rubber, as the electrification enhancer were dissolved and dispersed in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer to obtain photoconductor (201).

Photoconductor (202)

Indium tin oxide was vapor deposited to a film thickness of 100 Å onto a glass cylinder (ϕ30 mm, 7740 product of Corning) to make a transparent conductive support. This transparent conductive support has an electrical conductivity in terms of surface resistance of $10^2$ Ω/□, and a transparency in terms of total light transmittance of 90% or greater. A photoconductor (202) was prepared in exactly the same manner as the photoconductor (201), except that the support for the photoconductor was a transparent conductive support.

Photoconductor (203)

The support used for the photoconductor was the same as used for photoconductor (201). The support was dip coated with a solution prepared by dissolving one part of cyanoethylated pullulan in 10 parts (by weight) of acetone, and then dried at 100° C. for one hour to form a 1 μm thick intermediate layer. A mixture containing one part of α-oxothitalphthalocyanine, one part of a butadiene derivative, one part of a polycarbonate, 0.05 part of a polyethylene resin (particle size: 0.5 μm) and 20 parts of 1,1,2-trichloroethane dispersed and mixed for 24 hours using a hard glass bowl and a hard glass pot was then applied onto the above-mentioned intermediate layer and dried at 100° C. for one hour, thus forming a photosensitive layer with a thickness of about 15 μm to obtain photoconductor (203).

Photoconductor (204)

A photoconductor (204) was obtained in exactly the same manner as photoconductor (203), except that the support was the transparent conductive support used for photoconductor (202).

Photoconductor (205)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was further dip coated with TOSUPURAIPU (product of Toshiba Silicone) as an adhesive layer for the insulator layer and dried at 90° C. for 30 minutes, and then dip coated with a mixture containing one part of the silicon-based coating agent TOSUGADO (product of Toshiba Silicone) and 0.05 part of polyvinylbutyral resin, and allowed to harden at 90° C. for 1 hour, thus forming an insulator layer with a thickness of about 1 μm to obtain photoconductor (205).

Photoconductor (206)

A photoconductor (206) was obtained in exactly the same manner as photoconductor (205), except that the support was the transparent conductive support used for photoconductor (202).

Photoconductor (207)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was then dip coated with a solution prepared by dissolving one part of polystyrene resin in 20 parts of dichloromethane, thus forming a film with a thickness of 0.1 μm to obtain photoconductor (207).

Photoconductor (208)

A photoconductor (208) was obtained in exactly the same manner as photoconductor (207), except that the support was the transparent conductive support used for photoconductor (202).

Photoconductor (209)

One part of a butadiene derivative and one part of a polycarbonate were dissolved in 17 parts of dichloromethane to prepare an application solution. The above-mentioned non-transparent drum ② with a charge generating layer was dip coated with this solution, and dried at 90° C. for one hour to prepare a charge carrier layer with a thickness of about 15 μm, thus forming the photosensitive layer. This photosensitive layer was then coated with a 5% aqueous solution of poly γ-methylglutamic acid and dried, and then subjected to polling treatment at a temperature of 90° C. and a DC electric field of −200 V, thus forming an electret layer on the surface to obtain photoconductor (209).

Photoconductor (210)

A photoconductor (210) was obtained in exactly the same manner as photoconductor (209), except that the support was the transparent conductive support used for photoconductor (202).

Printing test

The same printing tests as in Example 7 were conducted using the above-mentioned photoconductors. The printing testers and printing evaluation criteria were the same as in Example 7.

Table XXV shows the results of evaluation of the printing tests and the surface potentials of the photoconductors. As in the previous case (Example 7), the comparison photoconductor had a fog of 0.1 or greater in all of the printing tests. Furthermore, the surface potential of the comparison photoconductor was a high voltage of 100 V or greater against the bias, independently of the printing tester used, and its deviation was 50 V or greater. In contrast, although the front section printing concentration of the photoconductor of Example 9 was roughly the same as the comparison photoconductor, the background fog was reduced to 0.03 or less. Also, with all of the printing testers, charging was effected to about the same voltage as the bias, while the deviation in surface potential was 6 V or less. The reduced background fog is believed to have been possible because of stable charging of the photoconductor.

TABLE XXV

| Photo-conductor | Printing test | Front section printing concen-tration (O.D.) | Background fog (ΔO.D.) | Surface potential ($V_s$) | Surface potential deviation (V) | Printing quality |
|---|---|---|---|---|---|---|
| | | Evaluation of printing test and photoconductor surface potential (1) | | | | |
| (201) | (1) | 1.41 | 0.01 | 595 | 2 | o |
| | (2) | 1.40 | 0.01 | 594 | 5 | o |
| | (3) | 1.38 | 0.02 | 598 | 3 | o |
| (202) | (4) | 1.38 | 0.01 | 599 | 1 | o |
| (203) | (1) | 1.42 | 0.01 | 597 | 1 | o |
| | (2) | 1.39 | 0.02 | 596 | 2 | o |
| | (3) | 1.40 | 0.01 | 599 | 1 | o |
| (204) | (4) | 1.39 | 0.02 | 598 | 3 | o |
| (205) | (1) | 1.37 | 0.01 | 596 | 1 | o |
| | (2) | 1.39 | 0.01 | 593 | 2 | o |

TABLE XXV-continued

| Photo-conductor | Printing test | Front section printing concen-tration (O.D.) | Background fog (ΔO.D.) | Surface potential ($V_s$) | Surface potential deviation (V) | Printing quality |
|---|---|---|---|---|---|---|
| | (3) | 1.42 | 0.02 | 596 | 5 | o |
| (206) | (4) | 1.38 | 0.01 | 597 | 6 | o |
| | | Evaluation of printing test and photoconductor surface potential (2) | | | | |
| (207) | (1) | 1.39 | 0.01 | 597 | 1 | o |
| | (2) | 1.37 | 0.02 | 598 | 2 | o |
| | (3) | 1.38 | 0.02 | 598 | 2 | o |
| (208) | (4) | 1.37 | 0.01 | 597 | 1 | o |
| (209) | (1) | 1.41 | 0.02 | 596 | 1 | o |
| | (2) | 1.41 | 0.01 | 595 | 2 | o |
| | (3) | 1.42 | 0.02 | 595 | 1 | o |
| (210) | (4) | 1.40 | 0.01 | 596 | 1 | o |

As described above, according to the present invention, there is provided an imaging apparatus comprising a photoconductor prepared by laminating a transparent or semi-transparent substrate, a transparent or semi-transparent conductive layer and a photoconductive layer, a developing agent comprising a carrier and toner situated on the photoconductive layer side of the photoconductor, and image exposure means for image exposure, provided on the transparent or semi-transparent substrate side of the photoconductor and positioned opposite the developing means, which apparatus performs light exposure and development with the developing agent roughly simultaneous with charging of the photoconductor, wherein means for supplying an additional potential ($V_f$) to the photoconductor is provided, so that the surface potential ($V_s$) of the photoconductor either approaches the developing bias ($V_b$) or is larger than the developing bias ($V_b$), thus making it possible to increase the margin of the carrier and toner mixing ratio (toner concentration), to obtain satisfactory printing properties over a long period of time, and to contribute greatly to the miniaturization and cost-lowering of photoprinting devices.

Furthermore, according to the present invention, an electrophotographic photoconductor with a photosensitive layer and, if necessary, an insulator layer on an electrically conductive support employs a photoconductor with at least an electrification enhancer on either the photosensitive layer or the insulator layer, thus making it possible to achieve a high chargeability (charging efficiency and stability) during charging, either by contact charging or in the rear photorecording process, and to contribute greatly to the miniaturization and cost-lowering of electrophotographic devices.

I claim:

1. An imaging apparatus comprising a photoconductor prepared by laminating a transparent or semi-transparent substrate, a transparent or semi-transparent conductive layer and a photoconductive layer, a developing agent comprising a carrier and toner situated on the photoconductive layer side of said photoconductor, and image exposure means for image exposure, provided on the transparent or semi-transparent substrate side of said photoconductor and positioned opposite a developing means, which apparatus performs light exposure and developing with the developing agent roughly simultaneous with electrification of the photoconductor, characterized by having means for supplying an additional potential to said photoconductor, so that the absolute value of the surface potential ($V_s$) of the photoconductor either approaches the absolute value of a developing bias ($V_b$) applied to the developing means or is larger than the absolute value of said developing bias ($V_b$).

2. The device according to claim 1, wherein the means for supplying the additional potential to the photoconductor is an electrification enhancer included in either the photoconductor or coated onto the surface of the photoconductor.

3. The device according to claim 1, wherein the means for supplying the additional potential to the photoconductor is an electrification enhancer coated onto the photoconductor.

4. The device according to any of claims 1, 2 or 3, wherein non-magnetic toner is used as said toner.

5. The device according to claim 2 or 3, wherein said electrification enhancer contains an ammonium fluoride salt represented by the following formula (I):

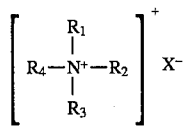

(I)

wherein each of $R_1$–$R_4$ is a hydrogen atom or organic group; at least one of groups $R_1$ to $R_4$ is a linear or branched fluorinated alkyl group of 1–69 carbon atoms and 3–66 fluorine atoms, which may have a hydroxyl group, chloromethyl group, carboxylic amide, sulfonic amide group, urethane group, amino group, $R_5$—O—$R_6$ group and/or $R_7$—$COOR_8$ group, in which case $R_5$, $R_6$, $R_7$ and $R_8$ are alkyl groups of 1–30 carbon atoms; at most three of groups $R_1$ to $R_4$ are independently hydrogen atoms or linear or branched alkyl, alkenyl or aryl groups of 1–30 carbon atoms (for example, phenyl, naphthyl, arylalkyl or benzyl groups); the aryl and aralkyl groups may be substituted at the aromatic nucleus with an alkyl group of 1–30 carbon atoms, an alkoxy group of 1–30 carbon atoms, a hydroxyl group or a halogen atom (for example, fluorine, chlorine or bromine); two of groups $R_1$ to $R_4$ may be bonded together to form a mononuclear or polynuclear cyclic system of 4–12 carbon atoms which may be broken with a hetero atom (for example, nitrogen, oxygen or sulfur), which may have 0–6 double bonds, and which is substituted with a fluorine atom, a chlorine atom, a bromine atom, an alkyl group of 1–6 carbon atoms, an alkoxy group of 1–6 carbon atoms, a nitro group or an amino group; $X^-$ is an organic or inorganic anion; and $R_1$ to $R_4$ may be substituted with a $COO^-$ or $SO^-_3$ group, in which case $X^-$ is unnecessary.

6. The apparatus according to claim 2 or 3, wherein said electrification enhancer contains a boron complex represented by the following formula (II):

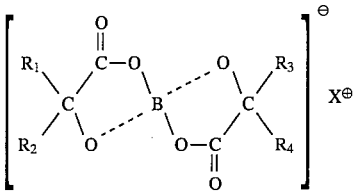

(II)

wherein $R_1$ and $R_4$ are hydrogen atoms, alkyl groups or substituted or non-substituted aromatic rings (including fused rings); $R_2$ and $R_3$ are substituted or non-substituted aromatic rings (including fused rings); and X is a cation.

7. The apparatus according to claim 2 or 3, wherein said electrification enhancer contains a boron complex represented by the following formula (III):

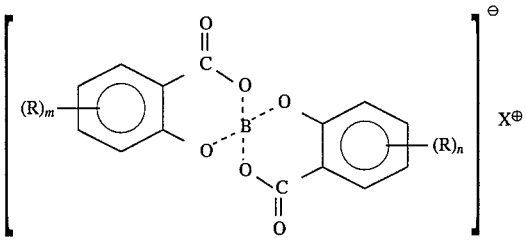

(III)

wherein R is a hydrogen atom, alkyl group, alkoxy group or halogen atom; m and n are 1, 2, 3 or 4; and X is a hydrogen ion, alkali metal ion, aliphatic ammonium ion (including substituted aliphatic ammonium ions), aromatic ammonium ion, alkylammonium ion, iminium ion, phosphonium ion or heterocyclic ammonium ion.

8. The apparatus according to claim 2 or 3, wherein said electrification enhancer contains a metal complex represented by the following formula (IV):

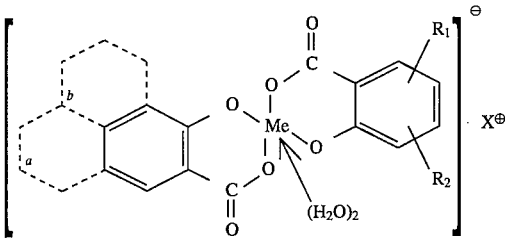

(IV)

wherein a or b is a benzene ring or cyclohexene ring which may have an alkyl group of 4–9 carbon atoms; each of $R_1$ and $R_2$ is H or an alkyl group of 4–9 carbon atoms (provided that both are not H), or a substituent which may have an alkyl group of 4–9 carbon atoms or which may form a benzene ring or cyclohexene ring; Me is Cr, Co or Fe; and X is a counter ion.

9. The apparatus according to claim 2 or 3, wherein said electrification enhancer contains a metal complex represented by the following formula (V):

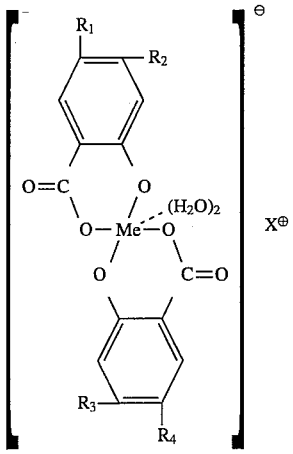

(V)

wherein each of $R_1$ to $R_4$ is H or an alkyl group, and Me is Cr, Cu or Fe.

10. The apparatus according to claim 2 or 3, wherein said electrification enhancer contains an imide compound represented by the following formula (VI):

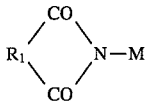

(VI)

wherein M is an alkali metal or ammonium ion; $R_1$ is

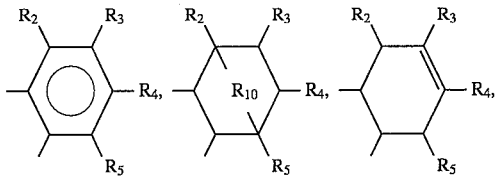

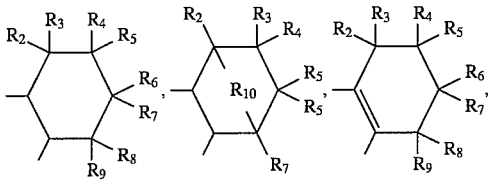

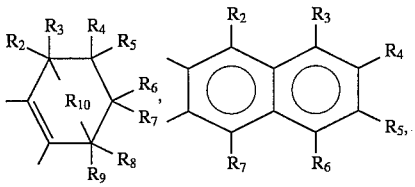

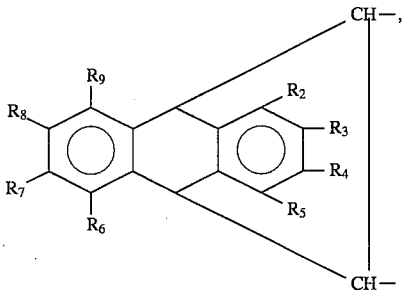

-continued

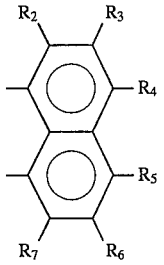

each of $R_2$, $R_3$, $R_4$, $R_5$, $R_6$, $R_7$, $R_8$ and $R_9$ is hydrogen, an alkyl group of 1–18 carbon atoms, a halogen,

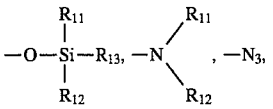

—$NO_2$ or $SO_3H$, and they may be the same or different; $R_{10}$ is

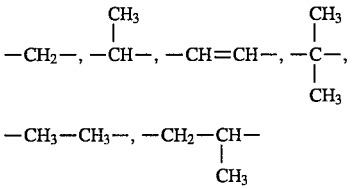

and each of $R_{11}$, $R_{12}$ and $R_{13}$ is hydrogen or an alkyl group of 1–5 carbon atoms, and they may be the same or different.

11. The apparatus according to claim 2 or 3, wherein said electrification enhancer contains an alkylphenol complex represented by the following formula (VII):

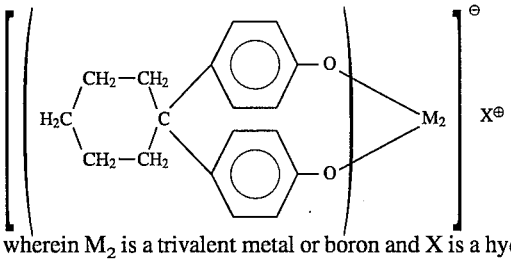

(VII)

wherein $M_2$ is a trivalent metal or boron and X is a hydrogen ion, alkali metal ion, an aliphatic ammonium ion (including substituted aliphatic ammonium ions), alicyclic ammonium ion or a heterocyclic ammonium ion.

12. The apparatus according to claim 2 or 3, wherein said electrification enhancer contains a zinc complex represented by the following formula (VIII):

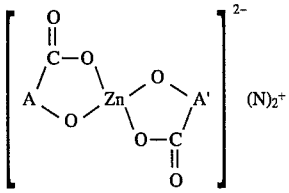

(VIII)

wherein each of A and A' is an aromatic oxycarboxylic residue selected from

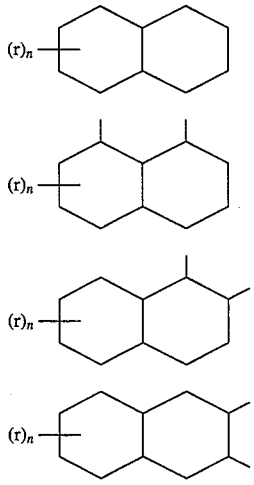

where (r) is an alkyl group or halogen atom and n is 0 or an integer 1 to 4; and M is hydrogen, an alkali metal, $NH_4$ or the ammonium of an amine.

13. The apparatus according to claim 2 or 3, wherein said electrification enhancer contains a metal complex represented by the following formula (IX):

(IX)

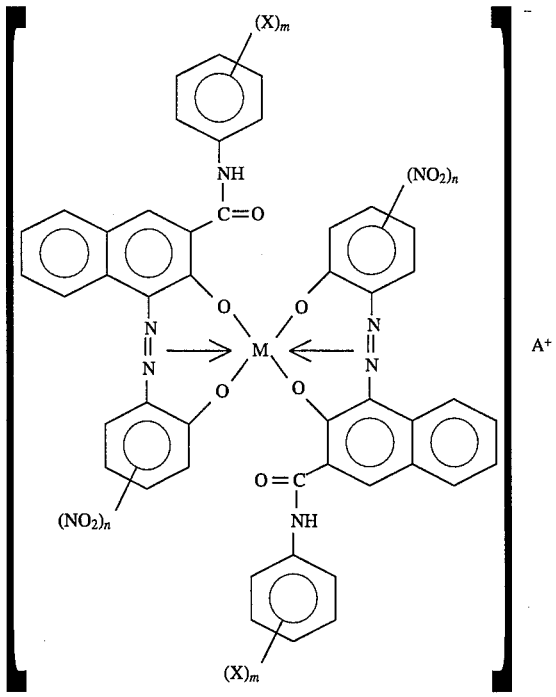

wherein X is hydrogen or a lower alkyl group, lower alkoxy group, nitro group or halogen atom; n is 1 or 2; m is an integer 1 to 3; each X may be the same or different; M is a chromium or cobalt atom; and $A^+$ is a hydrogen, sodium, potassium or ammonium ion.

14. The apparatus according to claim 2 or 3, wherein said electrification enhancer contains a metal complex represented by the following formula (X):

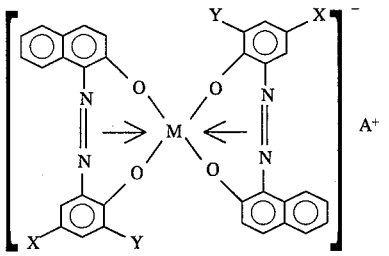

(X)

wherein X is a nitro group, sulfonamide group or halogen atom; Y is a halogen atom or nitro group (provided that X and Y are not both nitro groups); and M is a chromium or cobalt atom.

15. The apparatus according to claim 2 or 3, wherein said electrification enhancer contains a ferroelectric material.

16. The apparatus according to claim 2 or 3, wherein said electrification enhancer contains a high molecular substance with an equivalent work function of 4.10 or greater.

17. The apparatus according to claim 2 or 3, wherein said electrification enhancer contains a high molecular substance with electret-forming capabilities.

18. An electrophotographic photoconductor prepared by laminating a transparent or semi-transparent substrate, a transparent or semi-transparent conductive layer and a photoconductive layer, said photoconductor comprising at least one compound selected from the group consisting of:

i) an ammonium fluoride salt represented by the following formula (I):

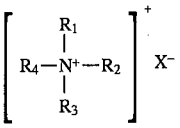

(I)

wherein each of $R_1$–$R_4$ is a hydrogen atom or organic group; at least one of groups $R_1$ to $R_4$ is a linear or branched fluorinated alkyl group of 1–69 carbon atoms and 3–66 fluorine atoms, which may have a hydroxyl group, chloromethyl group, carboxylic amide, sulfonic amide group, urethane group, amino group, $R_5$—O—$R_6$ group and/or $R_7$—$COOR_8$ group, in which case $R_5$, $R_6$, carbon atoms; at most three of groups $R_1$ to $R_4$ are independently hydrogen atoms or linear or branched alkyl, alkenyl or aryl groups of 1–30 carbon atoms (for example, phenyl, naphthyl, arylalkyl or benzyl groups); the aryl and aralkyl groups may be substituted at the aromatic nucleus with an alkyl group of 1–30 carbon atoms, an alkoxy group of 1–30 carbon atoms, a hydroxyl group or a halogen atom (for example, fluorine, chlorine or bromine); two of groups $R_1$ to $R_4$ may be bonded together to form a mononuclear or polynuclear cyclic system of 4–12 carbon atoms which may be broken with a hetero atom (for example, nitrogen oxygen or sulfur), which may have 0–6 double bonds, and which is substituted with a fluorine atom, a chlorine atom, a bromine atom, an alkyl group of 1–6 carbon atoms, an alkoxy group of 1–6 carbon atoms, a nitro group or an amino group; $X^-$ is an organic or inorganic anion; and $R_1$ to $R_4$ may be substituted with a $COO^-$ or $SO_3^-$ group, in which case X is unnecessary;

ii) a boron complex represented by the following formula (II):

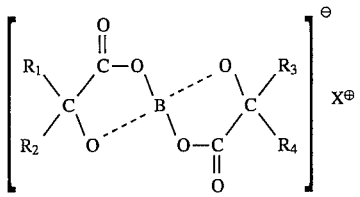

(II)

wherein $R_1$ and $R_4$ are hydrogen atoms, alkyl groups or substituted or non-substituted aromatic rings (including fused rings); $R_2$ and $R_3$ are substituted or non-substituted aromatic rings (including fused rings); and X is a cation, iii) a boron complex represented by the following formula (III):

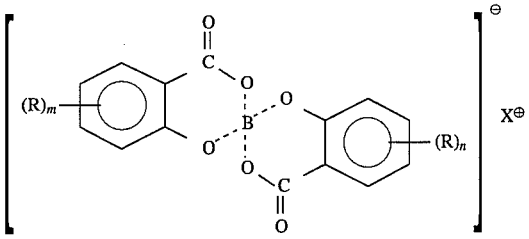

(III)

wherein R is a hydrogen atom, alkyl group, alkoxy group or halogen atom; m and n are 1, 2, 3 or 4; and X is a hydrogen ion, alkali metal ion, aliphatic ammonium ion (including substituted aliphatic ammonium ions), aromatic ammonium ion, alkylammonium ion, iminium ion, phosphonium ion or heterocyclic ammonium ion;

iv) a metal complex represented by the following formula (IV):

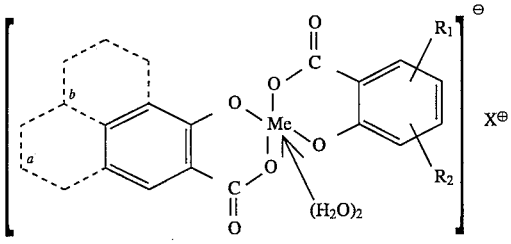

(IV)

wherein a or b is a benzene ring or cyclohexene ring which may have an alkyl group of 4–9 carbon atoms; each of $R_1$ and $R_2$ is H or an alkyl group of 4–9 carbon atoms (provided that both are not H), or a substituent which may have an alkyl group of 4–9 carbon atoms or which may form a benzene ring or cyclohexene ring; Me is Cr, Co or Fe; and X is a counter ion;

v) a metal complex represented by the following formula (V):

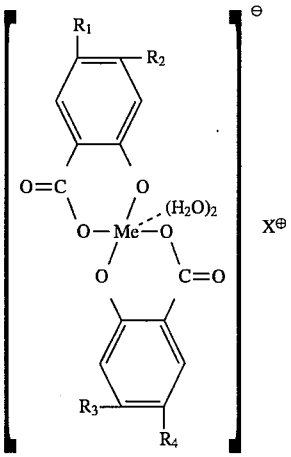

(V)

wherein each of $R_1$ to $R_4$ is H or an alkyl group, and Me is Cr, Cu or Fe;

vi) an imide compound represented by the following formula (VI):

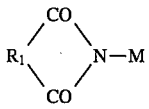

(VI)

wherein M is an alkali metal or ammonium ion; $R_1$ is

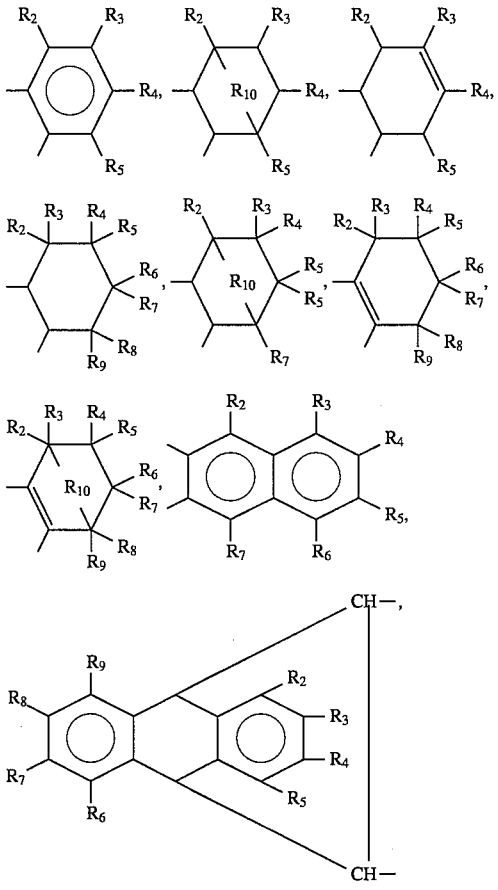

-continued

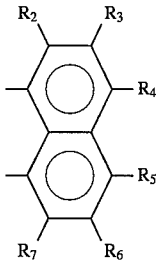

each of $R_2$, $R_3$, $R_4$, $R_5$, $R_6$, $R_7$, $R_8$ and $R_9$ is hydrogen, an alkyl group of 1–18 carbon atoms, a halogen,

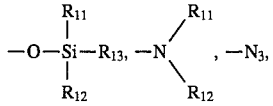

$—NO_2$, or $SO_3H$, and they may be the same or different; $R_{10}$ is

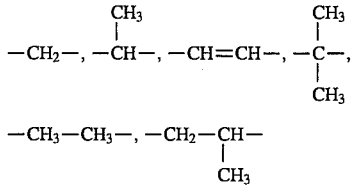

and each of $R_{11}$, $R_{12}$ and $R_{13}$ is hydrogen or an alkyl group of 1–5 carbon atoms, and they may be the same or different;

vii) an alkylphenol complex represented by the following formula (VII):

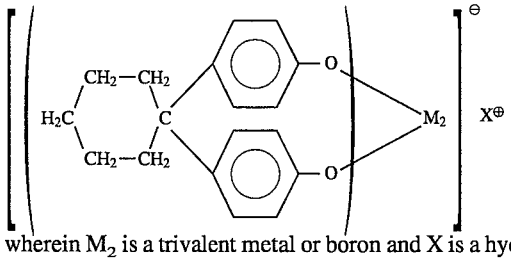

(VII)

wherein $M_2$ is a trivalent metal or boron and X is a hydrogen ion, alkali metal ion, an aliphatic ammonium ion (including substituted aliphatic ammonium ions), alicyclic ammonium ion or a heterocyclic ammonium ion;

viii) a zinc complex represented by the following formula (VIII):

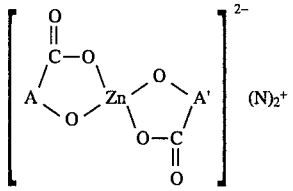

(VIII)

wherein each of A and A' is an aromatic oxycarboxylic residue selected from

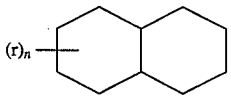

-continued

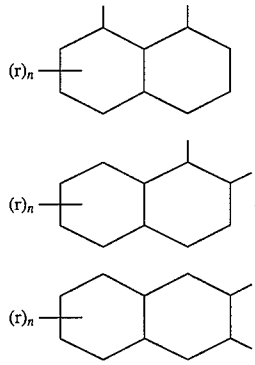

where (r) is an alkyl group or halogen atom and n is 0 or an integer 1 to 4; and M is hydrogen, an alkali metal, $NH_4$ or the ammonium of an amine;

ix) a metal complex represented by the following formula (IX):

(IX)

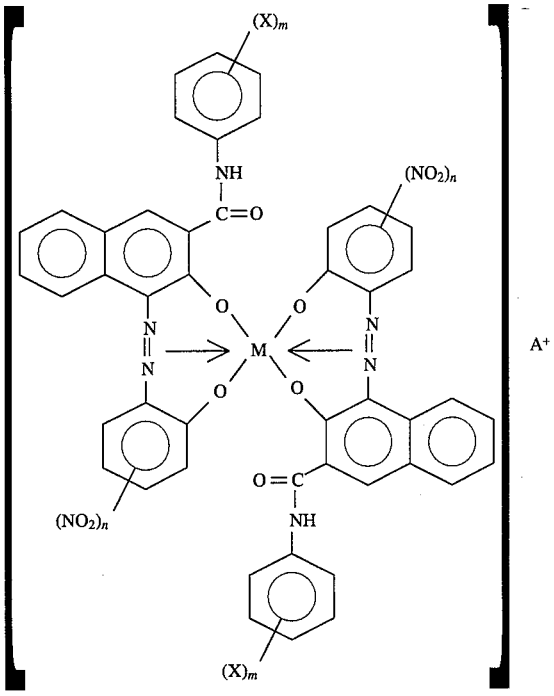

wherein X is hydrogen or a lower alkyl group, lower alkoxy group, nitro group or halogen atom; n is 1 or 2; m is an integer 1 to 3; each X may be the same or different; M is a chromium or cobalt atom; and $A^+$ is a hydrogen, sodium, potassium or ammonium ion; and x) a metal complex represented by the following formula (x):

(X)

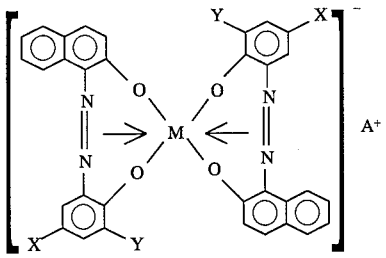

wherein X is a nitro group, sulfonamide group or halogen atom; Y is a halogen atom or nitro group (provided that X and Y are not both nitro groups); and M is a chromium or cobalt atom.

19. An electrophotographic photoconductor according to claim 18, which comprises voltage-applying electrifying means for uniformly electrifying the surface of the electrophotographic photoconductor, light exposure means for forming an electrostatic latent image on said photoconductor based on an image pattern, developing means for developing said electrostatic latent image into a toner image and transfer means for transferring said toner image onto recording paper, and which is used in an electrophotographic recording device wherein said electrifying means employs a contact electrifying method.

20. An electrophotographic photoconductor according to claim 18, wherein the photoconductor comprises a photosensitive layer and an insulating layer above it on an electroconductive support, and has said electrification enhancer in said insulating layer.

21. An electrophotographic photoconductor according to claim 18, wherein the photoconductor comprises a photosensitive layer and an insulating layer above it on an electroconductive support, and has said electrification enhancer as a coating on said insulating layer.

* * * * *